US006030463A

United States Patent [19]

Rusczyk

[11] Patent Number: 6,030,463

[45] Date of Patent: Feb. 29, 2000

[54] SYSTEM AND METHOD FOR ULTRASONIC CLEANING AND DEGREASING

[76] Inventor: Lester Lee Rusczyk, 343 Rte. 202A, Strafford, N.H. 03884

[21] Appl. No.: 09/122,222

[22] Filed: Jul. 24, 1998

Related U.S. Application Data

[60] Provisional application No. 60/054,931, Aug. 8, 1997.

[51] Int. Cl.[7] ..... B08B 3/12

[52] U.S. Cl. ..... 134/1; 134/147; 134/184

[58] Field of Search ..... 134/1, 184, 186, 134/147; 366/127

[56] References Cited

U.S. PATENT DOCUMENTS

| | | | |
|---|---|---|---|
| 2,950,725 | 8/1960 | Jacke et al. | 134/184 |
| 3,015,406 | 1/1962 | Nolte | 220/1 |
| 3,533,529 | 10/1970 | Helbig | 220/1 |
| 3,596,883 | 8/1971 | Berch | 134/184 |
| 3,937,236 | 2/1976 | Runnells | 134/184 |
| 4,887,716 | 12/1989 | Abraham | 206/427 |
| 4,903,718 | 2/1990 | Sullivan | 134/184 |
| 4,927,041 | 5/1990 | Hepburn | 220/20 |
| 4,930,532 | 6/1990 | Mayer | 134/184 |
| 5,114,494 | 5/1992 | Remec | 134/184 |
| 5,114,680 | 5/1992 | Obermiller et al. | 422/104 |

*Primary Examiner*—Randy Gulakowski
*Assistant Examiner*—Saeed Chaudhry
*Attorney, Agent, or Firm*—Kevin Mark Klughart

[57] ABSTRACT

A system and method of performing ultrasonic cleaning is disclosed whereby a conventional ultrasonic cleaning bath is augmented via the use of a cleaning target support structure and an optional mechanical isolator whereby the cleaning target is mechanically isolated from the ultrasonic cleaning bath. This isolation permits ultrasonic harmonics which are normally damped (suppressed) in amplitude due to conventional mechanical connections between the bath and the containment vessel to be fully applied to the cleaning target, resulting in substantial reduction in overall cleaning time and an improvement in cleaning efficiency. Various embodiments of the proposed system and method are disclosed, with several being preferred. Namely, the use of a circular floating-ballast to support a glass or plastic beaker used as the containment vessel is preferred as well as the use of a circular floating-ballast to support a plastic bag used as the containment vessel. Either of these configurations isolates the cleaning target from the sides of the ultrasonic bath. This isolation reduces the effective mass of the structure comprising the cleaning target, the containment vessel, and the containment vessel support (ballast means) and permits ultrasonic harmonics to fully affect cleaning with minimal harmonic damping. Consistent cleaning time improvements of 20–80% over conventional prior art basket-type and containment vessel support cover methods has been observed.

177 Claims, 37 Drawing Sheets

(27 of 37 Drawing Sheet(s) Filed in Color)

PRIOR ART

PRIOR ART

Bessel Function Excitation - Root 2 (5.520)

Bessel Function Excitation - Root 3 (8.654)

Bessel Function Excitation - Root 4 (11.792)

Bessel Function Excitation - Root 5 (14.931)

Bessel Function Excitation - Root 6 (18.071)

Bessel Function Excitation - Root 7 (21.212)

SYSTEM AND METHOD FOR ULTRASONIC CLEANING AND DEGREASING

PROVISIONAL PATENT APPLICATIONS

Applicant claims benefit pursuant to 35 U.S.C. § 119 for Provisional Patent Application titled A FLOATING BEAKER-POSITIONING DEVICE FOR ULTRASONIC CLEANERS, Ser. No. 60/054,931, filed Aug. 8, 1997 and submitted to the USPTO with Express Mail Label EI435202812US.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

CROSS REFERENCE TO RELATED APPLICATIONS

Disclosure Document Deposits

Applicant includes by reference and claims recorded date of conception by virtue of USPTO Disclosure Document Deposit Request FLOATING BEAKER POSITIONING DEVICE FOR ULTRASONIC CLEANING MACHINES, receipt 432155, mailed Jan. 12, 1998 to the USPTO with Express Mail Label EE046509055US and received by the USPTO Jan. 13, 1998.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Overview

Note that in this disclosure the term "ultrasonic cleaning" will be interpreted to mean ultrasonic cleaning and/or degreasing, as the systems and methods by which a cleaning target is degreased are generally considered to be a specific application of ultrasonic cleaning systems and methods. Similarly, the term "method" will be considered to encompass the various processes by which ultrasonic cleaning and/or degreasing may be affected.

Ultrasonic cleaning has found its most successful application in the removal of insoluble particulate contamination from hard substrate surfaces of what will generally be described as a cleaning target, or item to be cleaned. Contamination that is insoluble or emulsified can usually be removed with facility by means of conventional methods in conjunction with suitable solvents or detergent solutions.

Such techniques, however, cannot adequately remove particulate matter in the micron and sub-micron size range to the extent that is necessary, for example, for the critical cleaning required in the microelectronics and optical industries or for the preparation of surfaces prior to the application of thin films or coatings.

A number of methods have been used for the purpose of removing microparticulates from hard surfaces. These include pressure spraying or manual and mechanical scrubbing with solvents or detergent solutions; vapor degreasing; ion bombardment; plasma, chemical, or ultrasonic cleaning; and ultraviolet/ozone cleaning.

Ultrasonic Cleaning Principles

Ultrasonic cleaning consists of immersing a part to be cleaned (cleaning target) in a suitable liquid medium (cleaning fluid), agitating or sonicating that medium with a high frequency (typically 18 to 120 kHz) sound waves for a brief period of time (usually a few minutes), rinsing with clean solvent or water, and drying. The mechanism underlying this process is one in which microscopic bubbles in the liquid medium implode or collapse under the pressure of agitation to produce shock waves which impinge on the surface of the part. Through a scrubbing action, these shock waves displace or loosen particulate matter from the surface of the cleaning target. The process by which these bubbles collapse or implode is known as cavitation.

High intensity ultrasonic sound waves are known to exert powerful forces that are capable of eroding even the hardest surfaces. Quartz, silicon, alumina, and other materials can be etched by prolonged exposure to ultrasonic cavitation, and cavitation burn has been encountered following repeated cleaning of glass surfaces. The severity of this erosive effect has been known to preclude the use of ultrasonics in the cleaning of some sensitive or delicate components.

Sound Wave Types

A sound wave is produced when a solitary or repeated displacement is generated in a sound conducting medium, such as by a "shock" event or "vibratory" movement. The displacement of air by the cone of a radio speaker is a good example of "vibratory" sound waves generated by mechanical movement. As the speaker moves back and forth, the air in front of the cone is alternately compressed and rarefied to produce sound waves, which travel through the air until they are finally dissipated. These sound waves are produced by generating an alternating mechanical motion. There are also sound waves which are created by a single "shock" event. Thunder is an example, and in this case the air experiences an instantaneous change in volume as a result of an electrical lightning discharge. Shock events are sources of a single compression wave which radiates from the source.

Compression and Rarefaction

As a sound wave travels through a sound conducting medium, the molecules in the medium are influenced by adjacent molecules in much the same way the coils of a spring influence one another when they are alternately compressed or expanded.

Cavitation and Implosion

The compression and rarefaction described above may be described in terms of the coils of a spring similar to a Slinky toy spring. Here the coils of the Slinky toy spring represent individual molecules of a sound conducting medium. The molecules in the medium are influenced by adjacent molecules in much the same way that the coils of the spring influence one another. The compression generated by the sound source as it moves propagates down the length of the spring as each adjacent coil of the spring pushes against its neighbor. It is important to note that, although the wave travels from one end of the spring to the other, the individual coils remain in their same relative positions, being displaced first one way and then the other as the sound wave passes. As a result, each coil is first part of a compression as it is pushed toward the next coil and then part of a rarefaction as it recedes from the adjacent coil. In much the same way, any point in a sound conducting medium is alternately subjected to compression and then rarefaction. At a point in the area of a compression, the pressure in the medium is positive. At a point in the area of a rarefaction, the pressure in the medium is negative.

Cavitation

In elastic media such as air and most solids, there is a continuous transition as a sound wave is transmitted. In non-elastic media such as water and most liquids, there is continuous transition as long as the amplitude or 'loudness' of the sound is relatively low. As amplitude is increased, however, the magnitude of the negative pressure in the areas of rarefaction eventually becomes sufficient to cause the liquid to fracture because of the negative pressure, causing a phenomenon known as cavitation. Cavitation 'bubbles' are created at sites of rarefaction as the liquid fractures or tears because of the negative pressure of the sound wave in the liquid. As the wave fronts pass, the cavitation 'bubbles' oscillate under the influence of positive pressure, eventually growing to an unstable size. Finally, the violent collapse of the cavitation 'bubbles' results in implosions, which cause shock waves to be radiated from the sites of the collapse. The collapse and implosion of myriad cavitation 'bubbles' throughout an ultrasonically activated liquid result in the effect commonly associated with ultrasonics. It has been calculated that temperatures in excess of 10,000° F. and pressures in excess of 10,000 PSI are generated at the implosion sites of cavitation bubbles. It is these temperatures and pressures which account for the cleaning action observed in an ultrasonic tank.

Ultrasonic Harmonics

A given cleaning target may be contaminated with a wide variety of particulate matter having a wide range of particle sizes. It has been shown that to affect cleaning of cleaning targets with smaller particulate matter requires the cavitation of smaller and smaller air bubbles within the ultrasonic cleaning fluid. In the past this has been accomplished by using square wave excitation to "shock" the ultrasonic cleaning fluid with both a fundamental ultrasonic frequency and harmonics of this frequency. The higher frequency harmonics then resonate the smaller air bubbles and thus affect greater cavitation at the cleaning target surface.

As cleaning requirements have become more stringent, this approach has been found to be wanting since only the air bubbles of the size susceptible to resonance at the harmonics of the fundamental ultrasonic frequency are impacted by the use of a square wave excitation. Recent advances in ultrasonics have moved towards swept frequency ultrasonic excitations in which a wide range of fundamental frequencies is swept to thus generate a corresponding wide range of high frequency harmonics. The primary purpose for these advances has been to obtain more effective and more rapid cleaning of the cleaning target. Unfortunately, these techniques generally drastically increase the cost of the ultrasonic cleaning system.

Alternatives to this approach have attempted to generate ultrasonic energy sources which have higher amplitude and wider spectrum harmonic resonances in order to affect cavitation of smaller and smaller air bubbles. These techniques, while moderately successful, are generally expensive. As with the swept frequency technique, ultrasonic manufacturers are concentrating on making the ultrasonic energy source more efficient rather than improving the efficiency of the entire ultrasonic cleaning system.

Summary

Thus, from the foregoing discussion, it can be surmised that ultrasonic cleaning manufacturers have gone to great lengths to use ultrasonic harmonics to increase cavitation and thus affect faster and more effective cleaning. The ever-increasing requirements for higher quality cleaning, such as in the semiconductor and related industries, requires that cavitation of smaller air bubbles be performed, and this in general requires higher frequencies to be used to excite the ultrasonic cleaning bath. Furthermore, since there are in general many small bubbles to be cavitated, the amount of high frequency ultrasonic energy which is required to affect cavitation must be increased accordingly. There is a practical limit to increasing this energy level using conventional square-wave ultrasonic generators, and the use of other forms of ultrasonic excitation, such as piezoelectric methods, can be expensive.

DESCRIPTION OF THE PRIOR ART

The following U.S. patents may have relevance in the discussion of the presently disclosed invention:

U.S. Pat. No. 3,937,236—Runnells

U.S. Pat. No. 3,937,236 by Robert R. Runnells describes a ULTRASONIC CLEANING DEVICE which is the basis for most present day ultrasonic cleaning systems.

Referencing FIG. 1 which details the major components of the Runnells patent, the key portions of this ultrasonic cleaning system which are replicated in every present ultrasonic cleaning system is the use of a retaining template (104) with holes (105, 106) for retaining glass beakers (107, 108). In this configuration, the ultrasonic bath tub (102) contains a bath fluid which may be different from the cleaning fluid placed in the beakers (107, 108) that contained the cleaning target.

As an alternative to the cleaning configuration described above, Runnells discloses a basket system with holes (103) which may be used to contain cleaning target(s). In this configuration, the ultrasonic bath tub (102) contains a cleaning fluid and no effort is made to isolate the cleaning fluid from the ultrasonic bath.

The major deficiency in the Runnells implementation is in the mechanical connection of the retaining template (104) for retaining the glass beakers (107, 108) to the support basket (103). In some circumstances the retaining template (104) is directly supported by the edge of the ultrasonic bath tub (102). In either configuration, there exists a mechanical linkage between the glass beakers (107, 108), retaining template (104), and ultrasonic bath tub (102). This mechanical linkage means that some of the ultrasonic energy which is produced by the ultrasonic bath is wasted to affect movement of the beaker/template/tub combination, rather than being used to produce cavitation surrounding the cleaning target.

Furthermore, the fact that the glass beaker containment vessel (107, 108) is placed within a basket (103) which is placed at the bottom of the ultrasonic bath tub (102) does little to change the fact that a great deal of the energy which could be used to produce cavitation in the cleaning fluid is wasted in agitating the basket/beaker combination. In essence, the basket/beaker combination acts as a loss mechanism for ultrasonic energy.

This concept is best illustrated in FIG. 2, which depicts a typical Runnells beaker/basket combination in which a beaker (207) is held by a retaining template (204) in a basket (203) which is then placed on a support tray (201). All of these items represent items which dissipate ultrasonic energy when placed in an ultrasonic bath. The only element of this combination which provides some useful function in the context of the cleaning process is the beaker (207), which has as its sole purpose containment of the cleaning target.

The Runnells model for the construction of ultrasonic cleaning predominates as is the industry standard by which all major manufacturers design and construct their ultrasonic cleaning systems. Evidence of this teaching could be observed in the CleanTech '98 International Cleaning Technology Exposition (held May 19–21, 1998 at the Rosemont Convention Center in Rosemont, Ill.), in which this technology dominated the exposition to the exclusion of other approaches. Thus, the current art teaches the Runnells model to the exclusion of other ultrasonic cleaning methods.

U.S. Pat. No. 5,144,680—Obermiller et. al.

U.S. Pat. No. 5,144,680 by Patrice S. Obermiller and Kirsten K. Blumeyer describes a FLOATING LABORATORY TUBE HOLDER that can be used in a centrifuge. This device is essentially identical to that of the basket/cover assembly disclosed in the Runnells patent, except that it may be reconfigured as a support device or as a floatation device for use in cooling samples once they are removed from a heat bath or centrifuge.

Of significant import in the design of this device is Obermiller's design of the system to support a multiple number of test tubes. The thrust of this system is the processing of multiple sample tubes simultaneously. Unfortunately, this configuration is functionally identical to that of the Runnells retaining template (104) in FIG. 1, with the exception that the Obermiller device supports more containment vessels. In terms of an target goal of increasing overall cavitation, the increased mass of this combined structure actually reduces cavitation by linking the mechanical movement of all the containment vessels, thus dampening the ultrasonic standing waves within the ultrasonic bath.

Furthermore, the loss mechanisms present in metal (heat conduction, viscous friction, elastic hysteresis, and scattering) all contribute to internal damping of ultrasonic energy within structures like the Obermiller device and basket schemes used in the Runnells patent. See Theodore Hueter & Richard Bolt, SONICS at 371 (LOC # 55-6388, John Wiley & Sons, 1955).

U.S. Pat. No. 4,930,532—Mayer

U.S. Pat. No. 4,930,532 by Stanley E. Mayer describes a BEAKER HOLDER FOR USE WITH ULTRASONIC CLEANING DEVICE. This device is essentially a single container vessel retaining assembly designed to mechanically suspend a beaker in an ultrasonic cleaning bath. This retaining assembly includes a ring-shaped member which receives a beaker containing cleaning fluid and supports the beaker by means of a U-shaped wire which supports the bottom wall of the beaker.

The deficiencies of the Meyer device mimic that of the Runnells method. Namely, the mechanical linkage of the beaker to the sidewalls of the ultrasonic tank means that as the sidewalls of the tank move, this energy is transported to the ring-shaped member and the supporting U-shaped wire and subsequently to the containment beaker vessel. This results in a movement of the beaker and a reduction in effective energy transported to the part being cleaned within the beaker. It should be noted that any mechanical movement of the containment vessel if in phase with the movement of the sidewalls of the ultrasonic tank will tend to reduce the energy which is transferred to the cleaning target.

U.S. Pat. No. 4,927,041—Hepburn

U.S. Pat. No. 4,927,041 by Michael J. Hepburn describes a SELF-STABILIZING FLOATING COOLER. This patent teaches that a containment vessel can be constructed so as to be floatable and self-stabilizing. The field of art surrounding this patent does not pertain to the ultrasonic cleaning art and furthermore cooler devices are inherently poor transmitters of both thermal and ultrasonic energy, making this device and its variants unsuitable for use in ultrasonic cleaning applications.

U.S. Pat. No. 4,887,716—Abraham

U.S. Pat. No. 4,887,716 by Tim Abraham describes a FLOATING BEVERAGE CARRIER WITH COLLAPSIBLE PORTIONS and teaches a system by which cans and bottles may be suspended in a floatation device. This device employs a support method similar to that of the Mayer patent, but applies it to the art of floating beverage coolers. The Abraham device specifically targets a multiple can floatating device. As such, this approach increases the overall total mass of the flotation device and results in a system which would be unsuitable for use in the ultrasonic cleaning arts. In essence, the Abraham patent discloses a support method which is a multiple compartment version of the Meyer patent, but applied to the floating beverage container art.

U.S. Pat. No. 3,533,529—Helbig

U.S. Pat. No. 3,533,529 by Jim D. Helbig describes a FLOATING BEVERAGE BOWL and teaches a system by which a beverage may be suspended in a bowel and floated above the surface of another liquid, such as a pool. This art applies generally to beverage dispensing/containment devices and has no specific application to the ultrasonic cleaning arts.

U.S. Pat. No. 3,015,406—Nolte

U.S. Pat. No. 3,015,406 by May E. Nolte describes a FLOATING SERVER and teaches a system by which food or a beverage may be suspended in a bowel and floated on the surface of another liquid. As with the Helbig patent, this art applies generally to food/beverage dispensing/containment devices and has no specific application to the ultrasonic cleaning arts. Furthermore, Nolte specifically discloses isolation of the bowl from the surrounding liquid support surface, making the teachings of this device inappropriate for ultrasonic cleaning applications.

Limitations of Current Technology

There are major technological issues which are problematic with the current technology of ultrasonic cleaning, which include among others the following:

Environmental Issues

The ultrasonic cleaning industry is becoming more sensitive to environmental pollution issues, requiring that more friendly and less toxic cleaning solutions be used as the cleaning fluid for ultrasonic cleaning. This presents a problem in that many of the newer cleaning fluids are not as effective as their previous toxic counterparts. What is needed in many circumstances is a method to make existing cleaning fluids more effective and increase their lifetime so as to reduce the overall chemical and/or biomedical waste generated by the ultrasonic cleaning process. Alternatively, a method to make existing environmentally friendly cleaning fluids more efficient is needed.

One significant issue related to that of the environment involves cleaning of medical instruments, dental appliances, and the like which later come in contact with the human body. In these circumstances the use of toxic cleaning agents is eschewed, as residue may be detrimental to any human who later comes in contact with the cleaning target. For this reason, the use of non-toxic cleaning fluids is mandatory in many medical applications of ultrasonic cleaning. Making these non-toxic cleaning agents as effective as possible is a continuing goal in the ultrasonic cleaning industry. Unfortunately, any cleaning agent will be ultimately limited in its effectiveness by the efficiency of the ultrasonic cleaning system in which it is used. The primary focus in the industry to date has been on making cleaning fluids more effective rather than making the ultrasonic cleaning system as a whole more efficient.

Biohazard Waste

A significant consideration in modern day medical ultrasonic cleaning is that of contamination caused by biohazardous waste materials. For example, cleaning of surgical instruments and the like may require that the cleaning fluid be isolated from the surrounding bath fluid to prevent contamination of either the operator or subsequent cleaning targets.

Current technologies as described by Runnells and others fail to consider this problem in their design. What is needed in many circumstances is an economical method of ultrasonic cleaning using a small amount of cleaning fluid which can then be disposed of using conventional biohazard disposal waste facilities. Current technologies make this difficult, and in essence require that a glass or plastic beaker be discarded along with each batch of cleaning fluid that is contaminated with biohazard waste. A more economical approach is desirable.

Ultrasonic Harmonics

Ultrasonic harmonic cleaning has been increasingly applied to situations where the contaminant feature size is very small. This has required an increase in operational frequency of the ultrasonic system so as to resonate these small particle impurities along with bubbles of their same relative size and generate effective cavitation which results in cleaning. To produce these required higher frequencies many manufacturers have resorted to swept frequency systems so as to affect as much particle resonance as possible within the cleaning fluid, while others have used ultrasonic harmonics to generate frequencies which are intended to excite these particles and affect cavitation at the harmonic frequencies of the ultrasonic system.

Both of these approaches (and combinations of them) fail to adequately service many applications, as the amount of harmonic energy imparted to the cleaning target is substantially attenuated by any materials in the ultrasonic tub which may dissipate or be receptive to these harmonics. Thus, energy which could be used to cavitate the cleaning target surface is wasted and not applied to the cleaning process. Additionally, since the harmonics of a square wave excitation may be expressed by the Fourier series $$f(t, A) = \frac{A}{2} + \frac{2A}{\pi}\sum_{k=0}^{\infty}\left\{\frac{(-1)^k}{2k+1}\cos\left[\frac{(2k+1)\pi}{2}t\right]\right\} \quad (1)$$

where t=time index (assuming unit period)

A=square wave amplitude it is clear that the odd harmonics in this representation have reduced amplitude as compared with the fundamental frequency (k=0) case. (See Erwin Kreyszig, ADVANCED ENGINEERING MATHEMATICS, ISBN 0-471-85824-2, at 594). Thus, to excite a third harmonic at the same level as the fundamental frequency of the square wave excitation in general requires nine times the power, since the power dissipated will be proportional to the excitation amplitude squared divided by the frictional loss of the system:

$$P(t, A) \propto \frac{A^2}{F_{LOSS}} \quad (2)$$

where

A=excitation amplitude $F_{LOSS}$=frictional loss

This situation restricts the effective cleaning of conventional ultrasonic systems in that to achieve high ultrasonic harmonic excitation amplitudes quickly requires fundamental power levels which are too large to practically generate.

A significant problem with both these approaches is that of increased cost. While these approaches do in fact improve ultrasonic cleaning in some applications, what is really needed is a method improving the ultrasonic cleaning efficiency of existing systems, especially in circumstances where the cleaning fluid has been changed to a less efficient but more environmentally friendly compound.

Energy Conservation

Existing ultrasonic cleaning systems affect cavitation by imparting ultrasonic energy into the bath fluid, the cleaning fluid, and eventually at the surface of the cleaning target. Traditionally, the primary method of affecting more (or faster) cleaning has been to impart more ultrasonic energy into the bath fluid/cleaning fluid combination. Variations of this have included increasing use of harmonics and the like, but nothing has been done to affect more efficient use of the ultrasonic energy to promote faster and more efficient cleaning of the cleaning target. In essence, the ultrasonic manufacturers have taken the "bigger hammer" approach to their designs by applying more energy (whether thermal or ultrasonic) to affect greater/faster cleaning.

One aspect of the energy consumption of current ultrasonic cleaning systems involves the use of bath heaters to increase the temperature of the bath and/or cleaning fluid to produce more effective cavitation. These heaters require additional energy to be active, and result in additional system losses which reduce overall energy efficiency. What would be desirable in many circumstances is an ultrasonic cleaning system which could perform effective cleaning in many circumstances without the need for ancillary heating. Such a system would also be less costly to manufacture than existing ultrasonic systems incorporating a heating element.

Present ultrasonic cleaning system design philosophy has several negative ramifications. First, existing ultrasonic systems are operated inefficiently from an energy conservation point of view, in that they consume energy which does not directly contribute to cavitation and thus is wasted during the cleaning process. Since ultrasonic cleaning is widely used in heavy parts cleaning industries, it would be desirable to have a system and method which affects ultrasonic cleaning in an energy-efficient manner, thus permitting great savings of energy to be had within the ultrasonic cleaning industry. Such a system does not exist within the context of the prior art, but is described and is a feature of the presently disclosed invention.

Time/Energy Conservation

An issue related to that of energy conservation is that of time conservation. In many circumstances the power consumption of a given ultrasonic system is constant. This is definitely true of many legacy systems, and newer systems permit a variety of methods to adjust the power transmitted to the cleaning target. However, the overall electrical power consumed by an ultrasonic cleaning system may in many cases be relatively constant irrespective of the power transmitted to the cleaning target. In these circumstances, the only method to reduce the total energy consumption of the system is to reduce the cleaning time required to affect proper cleaning of the cleaning target. Note that since the equation $$E=P\times T$$

where

E=total energy consumed (joules)

P=power consumption rate (watts/sec)

T=cleaning time (sec)

fixes the relation between the total energy consumption, the power rate and the cleaning time, given a fixed power consumption rate the only way to reduce total energy consumption is to reduce the cleaning time.

"Degassing" Time

Another factor plays heavily in the total time required to affect ultrasonic cleaning. In most circumstances, a cleaning fluid must be "degassed" to remove air bubbles and the like prior to inserting the cleaning target and starting the cleaning process. This degassing time varies heavily based on the cleaning fluid, ultrasonic system construction, temperature, and other factors, but may run from approximately 15 minutes or so to much longer times. The degassing requirement is necessary in many circumstances to increase the efficiency of the cleaning fluid within the context of the ultrasonic cleaning process.

This factor is noted by a leading text on the subject of ultrasonic cleaning:

> "If a liquid is exposed to intense sonic vibrations one can usually observe small gas bubbles formed within the liquid. Most liquids, unless they are specially treated, contain dissolved or entrained gasses. The amount of entrained gas depends on the pressure and temperature of the liquid. Under normal conditions the gas is very finely dispersed. It may be present in the form of molecules located at vacant sites of the quasi-crystalline structure of the liquid, or the gas may be contained in invisible bubbles of microscopic dimensions. Such bubbles constitute weak points within the liquid; the tensile strength is determined by the largest bubble present . . . . The entrained gas can be removed by boiling, spraying into a vacuum, and sonic degassing. It can also be forced into solution by high external pressures." See Theodore Hueter & Richard Bolt, SONICS, at 225–227 (LOC # 55-6388, John Wiley & Sons, 1955).

Thus, since it requires approximately ⅓ watt/cm$^2$ to affect degassing in water (Id.), there is a net energy loss associated with the degassing process which is proportional to the size of the ultrasonic cleaning tank. For example, a 1-liter bath run for 15 minutes would require a minimum energy E of $$\begin{aligned} E &= P\times T \\ &= \frac{1}{3}\frac{\text{W}}{\text{cm}^2}\times\frac{100\text{ cm}^2}{\text{liter}}\times 15\text{ min}\times\frac{60\text{ sec}}{\text{min}} \\ &= 30000\text{ joules} \end{aligned}$$

assuming that the 1-liter bath is configured as a cube 10 cm on a side. Id. at 41–42. This energy loss results in no effective processing of the cleaning target and is primarily a preliminary process which must be used to prepare the cleaning fluid for use in the ultrasonic cleaning process.

What would be desirable in many circumstances is a system wherein the degassing procedure is eliminated or reduced in time. This would provide the benefits of a rapid ultrasonic cleaning process, higher overall system thruput (in terms of cleaning targets per hour), and the potential for a significant reduction in the total amount of energy required to affect ultrasonic cleaning. While it is possible to affect some cleaning using non-degassed cleaning agents with current ultrasonic cleaning systems, current technology does not teach this as the preferable method, and in most cases cleaning fluid manufacturers specifically require that their products be degassed to achieve optimal cleaning efficiency.

Summary

The techniques and systems described above have been widely exploited throughout the ultrasonic cleaning industry, with all manufacturers employing essentially the same system as described in the Runnells patent and illustrated in FIG. 1. These manufacturers include among others Ney Ultrasonics (Bloomfield, Conn.); CAE Blackstone (Jamestown, N.Y.); Crest Ultrasonics (Trenton, N.J.); Artcraft Welding, Inc. (Campbell, Calif.); L&R Manufacturing Company (Kearny, N.J.); Branson Ultrasonics Corporation (Danbury, Conn.); and Health-Sonics Corporation (Pleasanton, Calif.). While this list is by no means exhaustive, it does indicate that the basic approach to ultrasonic cleaning by all these major commercial manufacturers is essentially identical.

Unfortunately, the limitations of current technology as described above apply equally well to the above manufacturers as well as other prior art embodiments of ultrasonic cleaning systems and their associated methods. What is needed is a different approach to current ultrasonic cleaning methods. Such an approach is adopted by the presently disclosed invention and its exemplary embodiments.

OBJECTS OF THE INVENTION

Accordingly, the objects of the present invention are to circumvent the deficiencies in the prior art and affect the following objectives:

1. Provide a method to improve the cavitation of an ultrasonic cleaning fluid contained within an ultrasonic cleaning bath;
2. Increase the amount of effective high frequency harmonic energy transferred to cleaning target without modification of the existing ultrasonic bath;
3. Permit the use of sweeping ultrasonic frequencies of narrower frequency ranges to affect more effective cleaning with less power than would be required with conventional ultrasonic cleaning systems;
4. Permit wide band sweeping ultrasonic frequencies to be more effective than would be possible using existing ultrasonic cleaning techniques;
5. Significantly reduce the amount of time required to affect ultrasonic cleaning by making the ultrasonic cleaning process more efficient;
6. Permit the ultrasonic cleaning of some cleaning targets which are currently ineffectively or poorly cleaned using current ultrasonic methodologies, thus making ultrasonic cleaning practical in some situations where it is not currently economic and/or effective;
7. Create a new class of 'ultraclean' cleaning targets by drastically improving the cleaning effectiveness possible using ultrasonic cleaning methods;
8. Increase the effective life of ultrasonic cleaning fluid by making the ultrasonic cleaning process more efficient;
9. Permit the effective use of ultrasonic cleaning fluids which have not been degassed, thus reducing energy consumption which is inherent in the use of degassed cleaning fluids;

10. Reduce the amount of time required to prepare an ultrasonic cleaning system by eliminating in some circumstances the necessity to degas the ultrasonic cleaning fluid;
11. Permitting a reduction in the overall amount of ultrasonic cleaning fluid required to affect a particular cleaning operation, thus reducing the overall cleaning cost associated with an ultrasonic cleaning operation;
12. Increase the heat concentration local to the cleaning target by preventing ultrasonic energy from being damped by metallic conduction away from the ultrasonic cleaning fluid and the associated cleaning target;
13. Increase the heat-induced cavitation at the cleaning target surface by preventing metallic conduction from dissipating energy which could be used to affect cavitation at the cleaning target and increase the temperature of the ultrasonic cleaning fluid by hydrostatic friction;
14. Permit in some circumstance the elimination of ancillary ultrasonic heaters by conserving the heat generated local to the cleaning target by preventing this heat from conducting and/or dissipating away from the ultrasonic cleaning fluid;
15. Decrease the amount of energy required to affect ultrasonic cleaning, thus resulting in overall power savings for the ultrasonic cleaning process and also an increase in the lifetime and reliability of ultrasonic cleaning systems;
16. Decrease the amount of energy wasted in generating the cleaning fluids required to affect ultrasonic cleaning, by eliminating some forms of cleaning fluids which require the expenditure of large amounts of energy for their manufacture, and replacing them with water-based cleaning fluids that may attain higher cleaning efficiencies when using the inventive teachings of the disclosed invention and its embodiments;
17. Reduce the amount of toxic cleaning fluids that are required for some cleaning applications by increasing their effective life and permitting substitution of non-toxic cleaning fluids in some applications;
18. Permit acid/alkali or other hazardous cleaning fluids to be managed and easily identified for safety purposes;
19. Permit more efficient use of cold sterilization for sterile medical ultrasonic cleaning;
20. Permit safe cleaning of cleaning targets which may be contaminated with biohazardous materials;
21. Reduce or eliminate the potential for contamination of the ultrasonic cleaning bath fluid or its operator by the cleaning target or the ultrasonic cleaning fluid;
22. Permit effective ultrasonic cleaning of articles which may be introduced into contact with humans without using toxic cleaning solutions;
23. Permit automatic rotation of a cleaning target within an ultrasonic bath without the need for external rotating means, thus providing more effective and uniform cleaning of the cleaning target;
24. Improve cleaning/degreasing effectiveness of cleaning targets which have 'blind holes', or other recessed areas which are not amenable to conventional mechanical cleaning methods;
25. Reduce the cost of ultrasonic cleaning by minimizing the amount of cleaning fluid required and minimizing the cleaning time required to affect acceptable cleaning for a given cleaning target.

These objectives are achieved by the disclosed invention which is discussed in the following sections.

BRIEF SUMMARY OF THE INVENTION

Briefly, the invention is a system and method permitting ultrasonic cleaning that minimizes the dampening effects of present ultrasonic cleaning systems and methods by isolating the cleaning target and/or containment vessel from the ultrasonic bath so as to permit more of the higher frequency ultrasonic harmonics to cavitate the cleaning fluid surrounding the cleaning target.

The present invention solves the problem present in the prior art by purposefully removing the mechanical connection between the containment vessel, the vessel support means, and the ultrasonic tank bath. This disconnection permits the total effective mass of the containment vessel and vessel support structure to be minimized, permitting the excitation of higher frequency harmonics within the structure to be affected, resulting in greater cavitation surrounding the cleaning target.

Furthermore, the present invention generalizes the concepts of the containment vessel and vessel support means as used in the prior art. Specifically, the present invention replaces these two components with a functionally singular element termed a cleaning target suspension support. This suspension support structure may include an optional containment vessel and vessel support means, but need not necessarily do so. The function of the suspension support is to support the cleaning target within the ultrasonic cleaning fluid, while simultaneously removing the mechanical connection between the cleaning target and the ultrasonic bath. This disconnection permits greater cavitation to occur at the surface of the cleaning target, resulting in more efficient cleaning of the cleaning target.

The mechanical disconnection mentioned previously may be implemented by a variety of means. In one preferred embodiment, the mechanical disconnection is affected by incorporating a floating-ballast means as the containment vessel support structure, and permitting this floating-ballast to maintain the containment vessel in an upright position while it is in place within the ultrasonic bath. The present invention discloses a variety of methods by which this floating-ballast may be affected, each of which permits an increase in cavitation over that permitted by the prior art.

In another preferred embodiment, the floating-ballast means mentioned above is augmented by pontoons to form a pontoon-ballast structure which collects ultrasonic energy from a wide field within the ultrasonic bath and applies this energy to the sidewalls of the containment vessel, permitting the excitation of additional harmonics within the containment vessel, and therefore enhancing cavitation at the cleaning target surface.

In a variety of preferred embodiments, the containment vessel consists of a conventional glass beaker, such as may be evidenced by the PYREX or KYMAX variety. However, the containment vessel can be consist of other materials, such as a plastic beaker or in some embodiments a plastic bag. The latter variants are especially useful in situations where the containment vessel and the cleaning fluid it contains must be discarded as a single entity, as in cases where the cleaning fluid is contaminated with biohazardous materials during the cleaning process.

Several of the presently disclosed invention embodiments have particular advantage with the use of cylindrical containment vessels such as glass beakers, as the formation of the floating-ballast can be constructed so as to increase the total ultrasonic energy transmitted to the beaker without substantially increasing its mass or damping harmonic resonances which the ultrasonic bath may excite within the beaker. This excitation of additional harmonics which result in the formation of higher amplitude Bessel function wavefronts within the glass beaker tend to cause increased cavitation activity at the center of the beaker, and as such result in greater cleaning efficiency over all surfaces of the cleaning target.

Furthermore, the floating nature of the containment vessel support in a variety of the invention embodiments permits the containment vessel to rotate, permitting a more uniform cavitation coverage over the surfaces of the cleaning target, resulting in more uniform cleaning than can be expected using conventional basket/retaining ring methods as in the Runnells patent. This self-rotating nature of several embodiments of the present invention permits automatic rotation of the cleaning target without the need for mechanized or manual movement of the cleaning target during the ultrasonic cleaning process. For some cleaning targets which must be rotated during the cleaning process to affect uniform cleaning, this can be a significant practical improvement over the prior art. Note that the uniform nature of the cleaning affected by this autorotation effect can in many cases reduce the overall cleaning time for a given cleaning target configuration.

The invention embodiments discussed to this point have assumed a rigid containment vessel. In some applications, however, this is not desirable. Several of the invention embodiments replace the conventional beaker used as the containment vessel with a plastic bag, which may optionally be of the resealable and/or disposable variety. This variant of the invention embodiment has great practical application in hazardous waste applications, where the containment vessel may be sealed and then properly disposed of using accepted procedures for hazardous industrial and/or biomedical waste. Specifically, it is envisioned that this variant will have widespread use in areas where biohazardous waste must be processed.

Other preferred embodiments of the present invention involve suspending the cleaning target within the cleaning fluid to affect a mechanical disconnection of the cleaning target and the ultrasonic bath body. This mechanical disconnection permits the ultrasonic wave energy to fully impact the cleaning target and produce effective cavitation a the surface of the cleaning target. This particular invention embodiment has wide application in situations where the cleaning target is heavy or mechanically unwieldy, and/or must be cleaned as a part of an automated production/assembly line process. Note that this invention embodiment may be combined with teachings of both the prior art and/or other invention embodiments to implement a hybrid approach to improve overall cavitation at the cleaning target.

Note that one significant disadvantage of methods taught by Runnells and others is the effect of nodes ("dead spots") within the ultrasonic bath, in which ultrasonic activity is at a minimum, resulting in little or no cavitation. The presently disclosed invention permits "dummy" ballasts to be placed within the ultrasonic bath so as to position ballast/vessel combinations judiciously at the ultrasonic anti-nodes (regions of high amplitude ultrasonic activity) within the bath, and thus affect maximum cavitation in the cleaning fluid surrounding the cleaning target without restricting the rotation of the cleaning target within the ultrasonic bath fluid. Also note that by reducing the dampening of ultrasonic harmonics within the bath fluid, the present invention tends to mitigate the effects of ultrasonic standing wave nodes within the bath fluid, thus providing a solution to a problem in the field of ultrasonics which has usually been attacked by making modifications to the ultrasonic energy source and/or the ultrasonic tank.

BRIEF DESCRIPTION OF THE DRAWINGS

The file of this patent contains at least one photograph executed in color. Copies of this patent with color photographs will be provided by the Patent and Trademark Office upon request and payment of the necessary fee.

For a fuller understanding of the advantages provided by the present invention, reference should be made to the following detailed description together with the accompanying drawings wherein:

Figure 1:
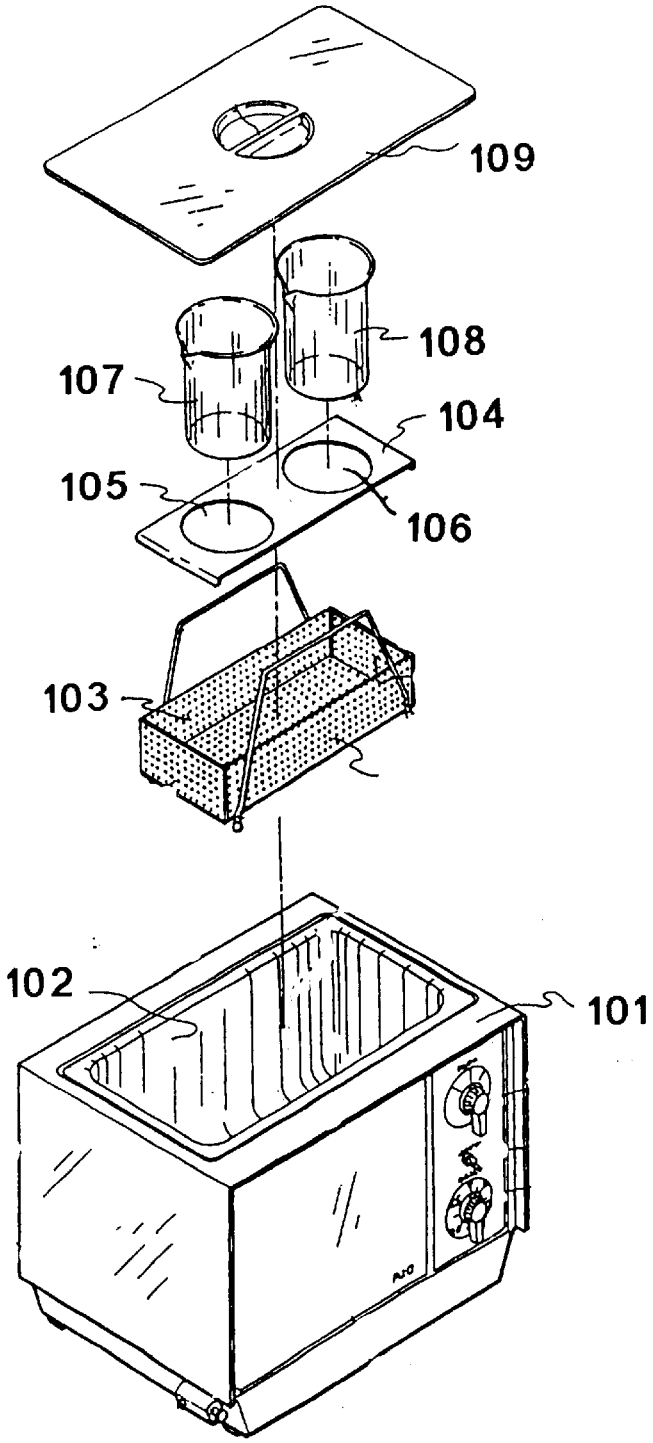
Figure 2:
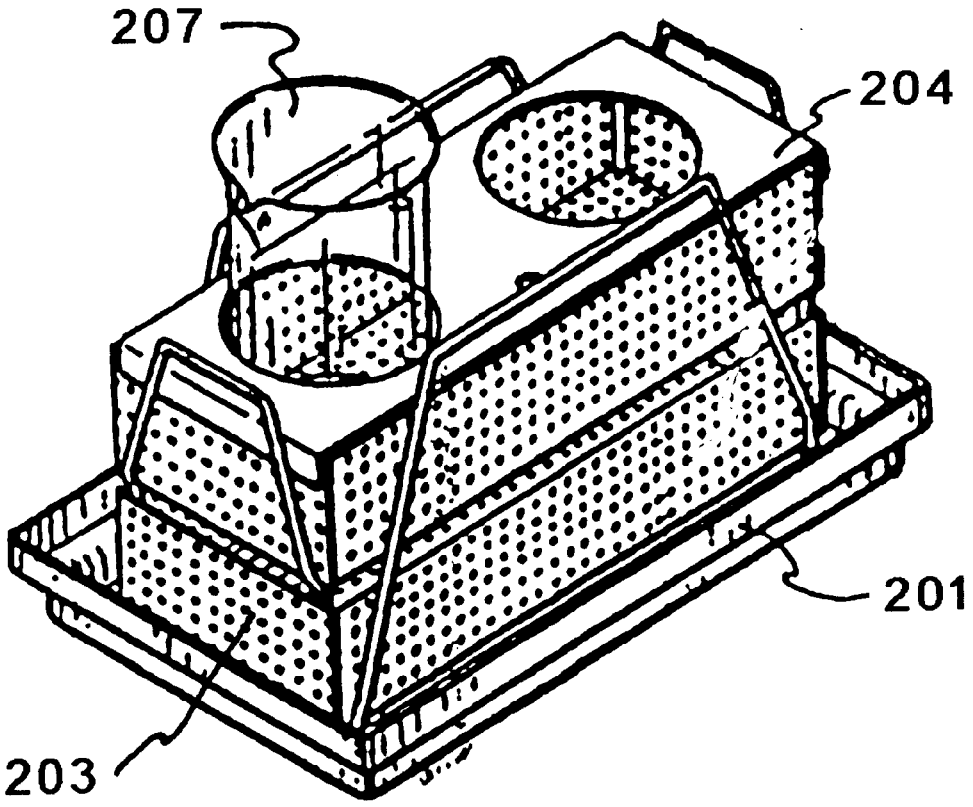
Figure 3:
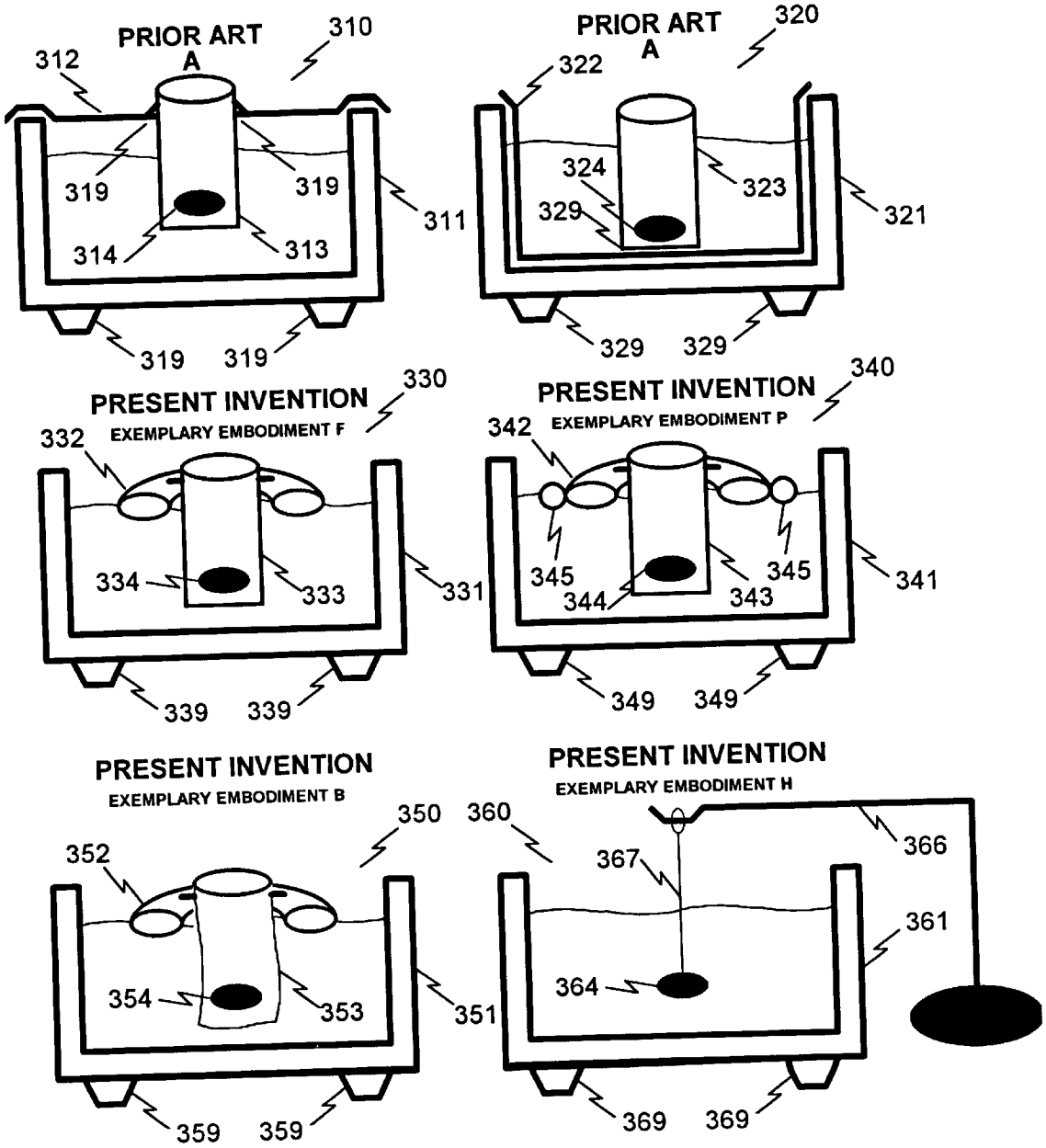
Figure 4:
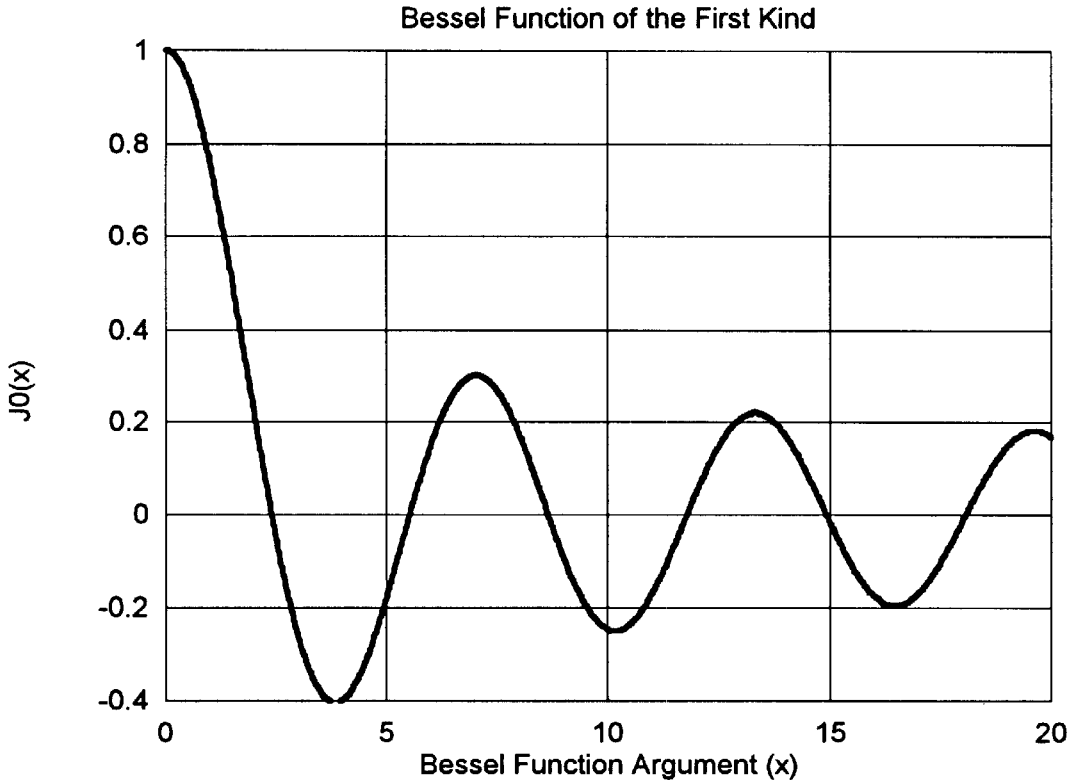
Figure 4:
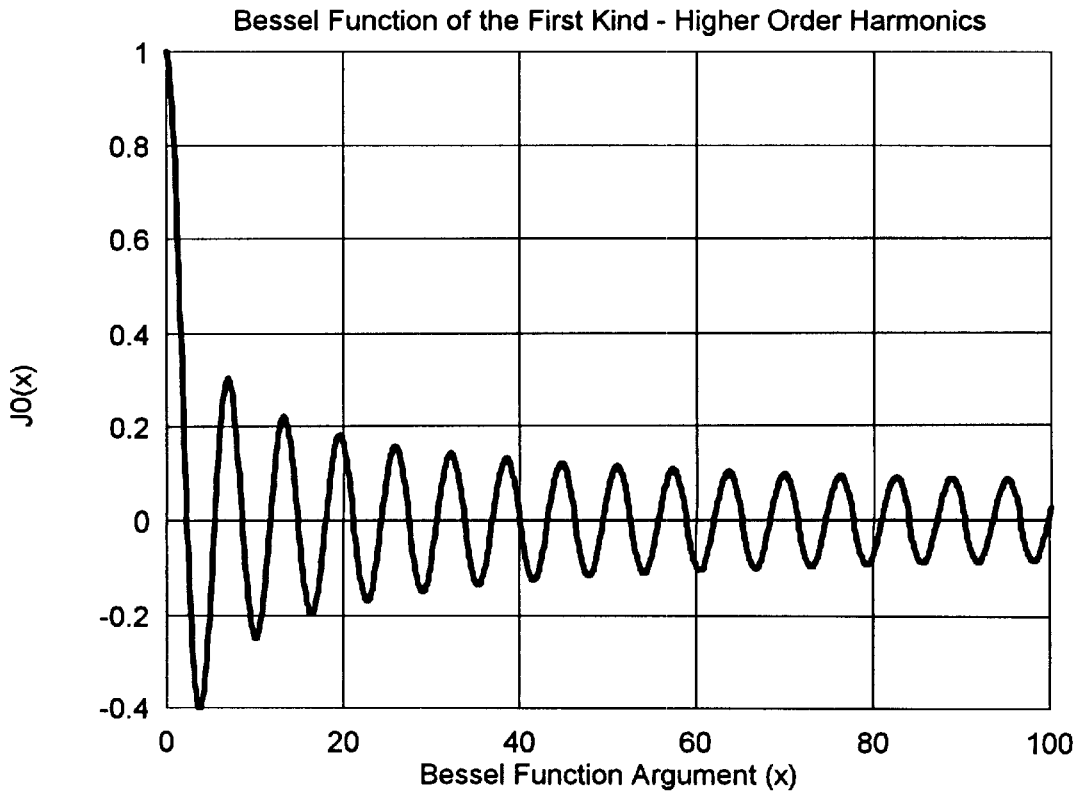
Figure 5:
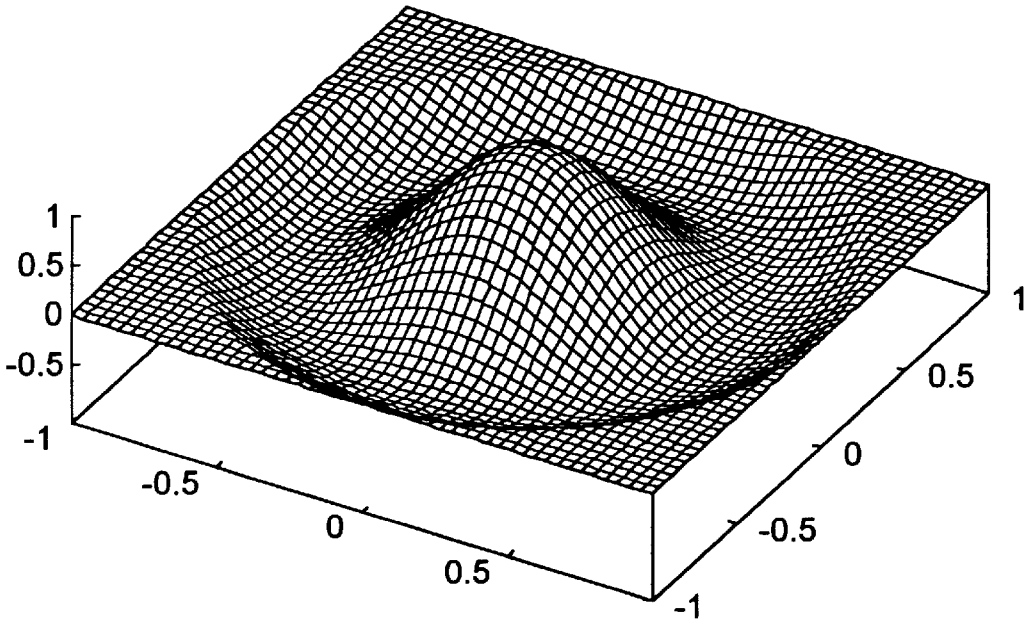
Figure 5:
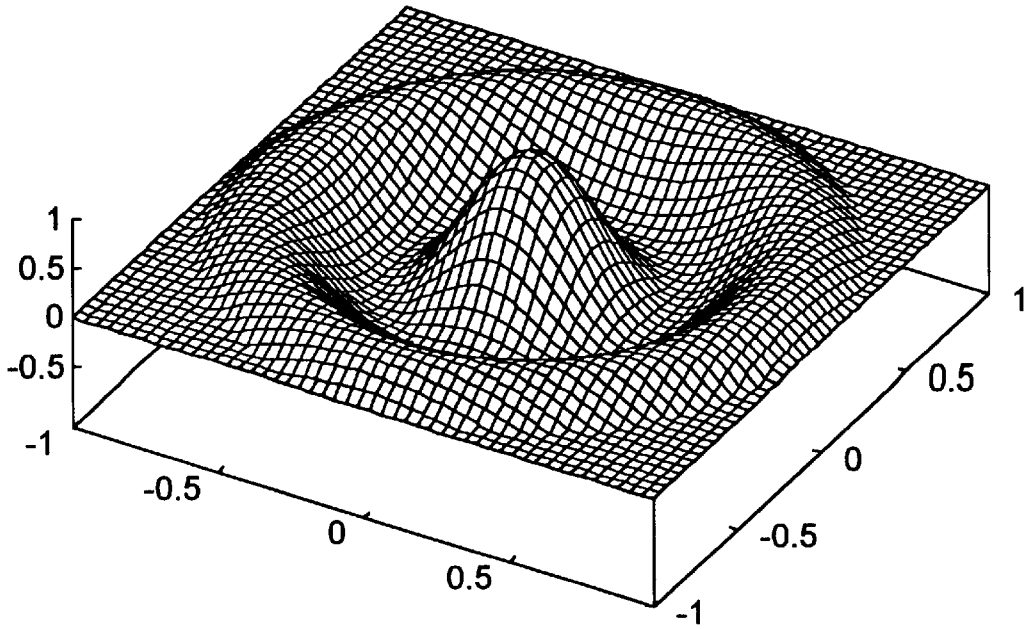
Figure 6:
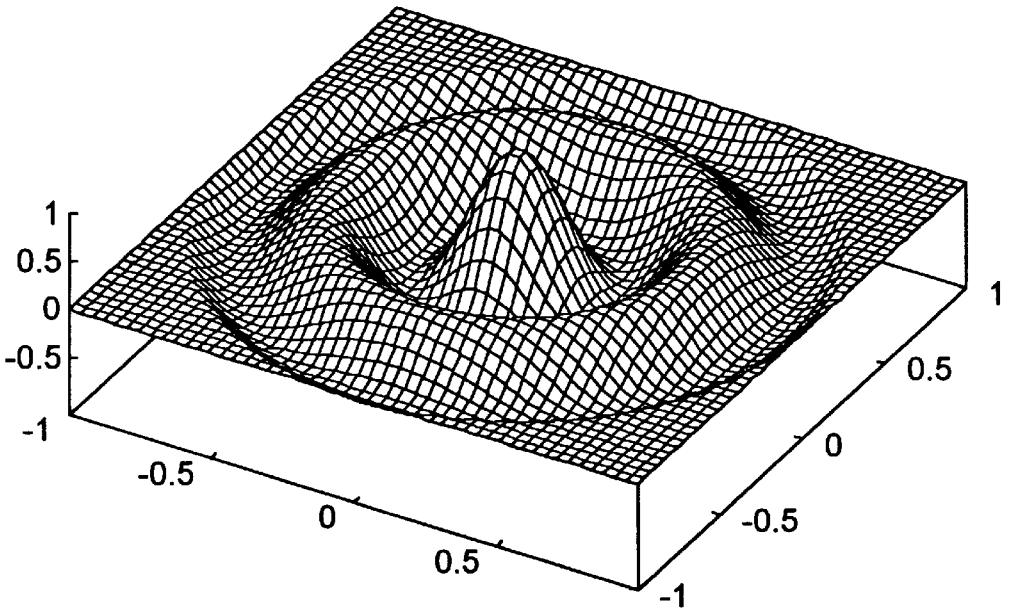
Figure 6:
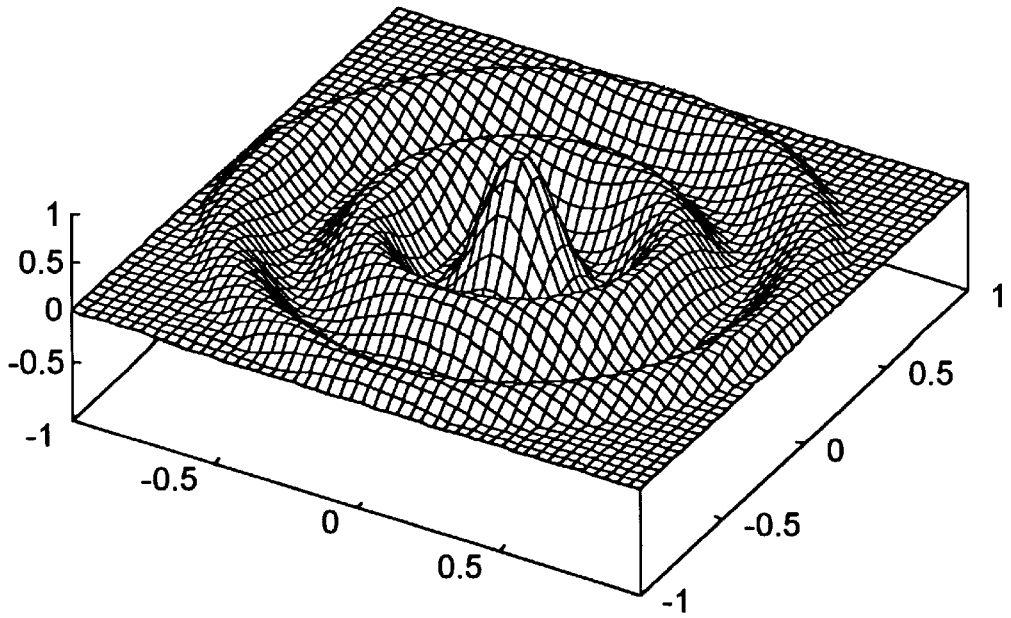
Figure 7:
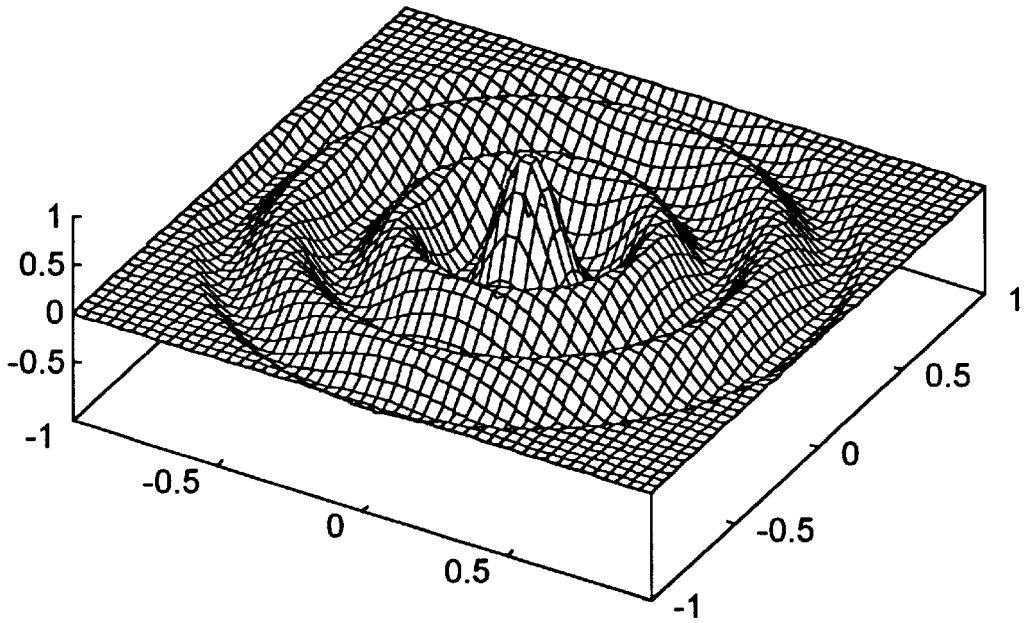
Figure 7:
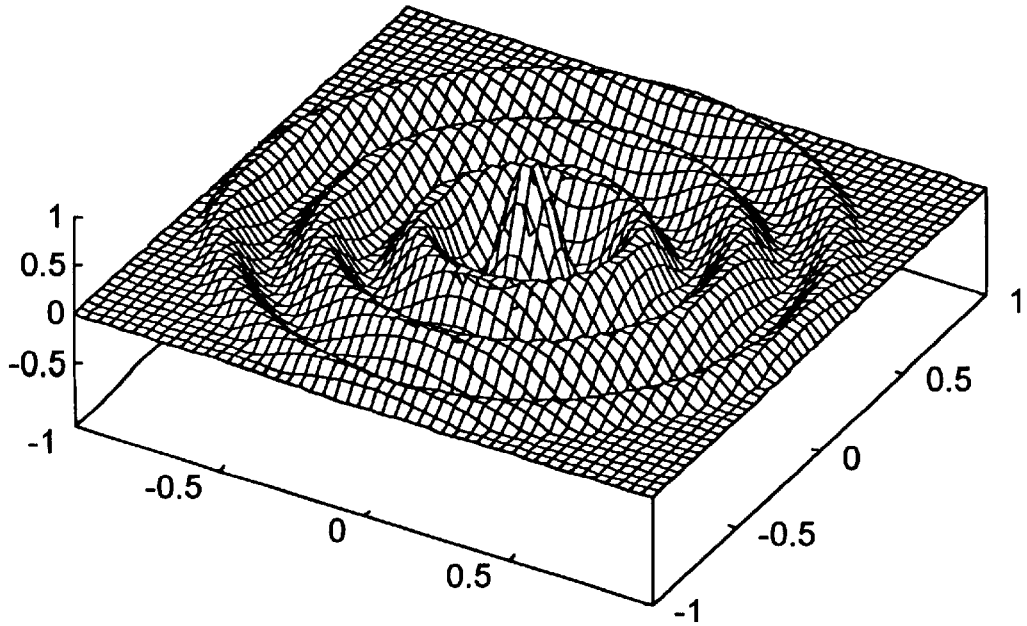
Figure 8:
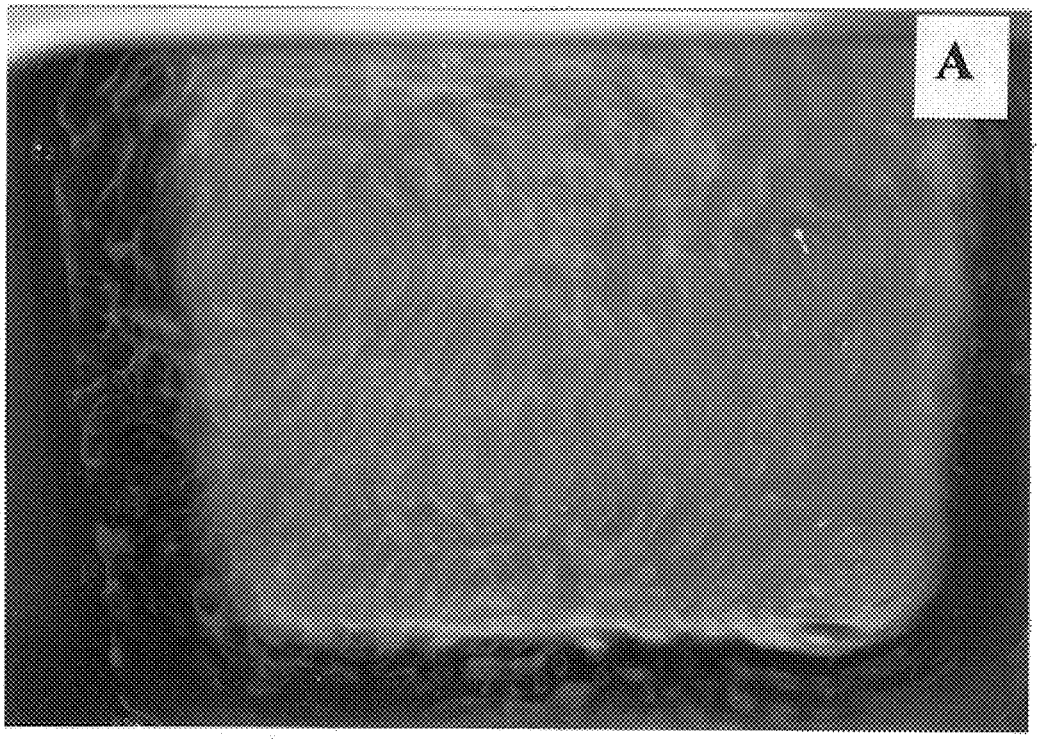
Figure 9:
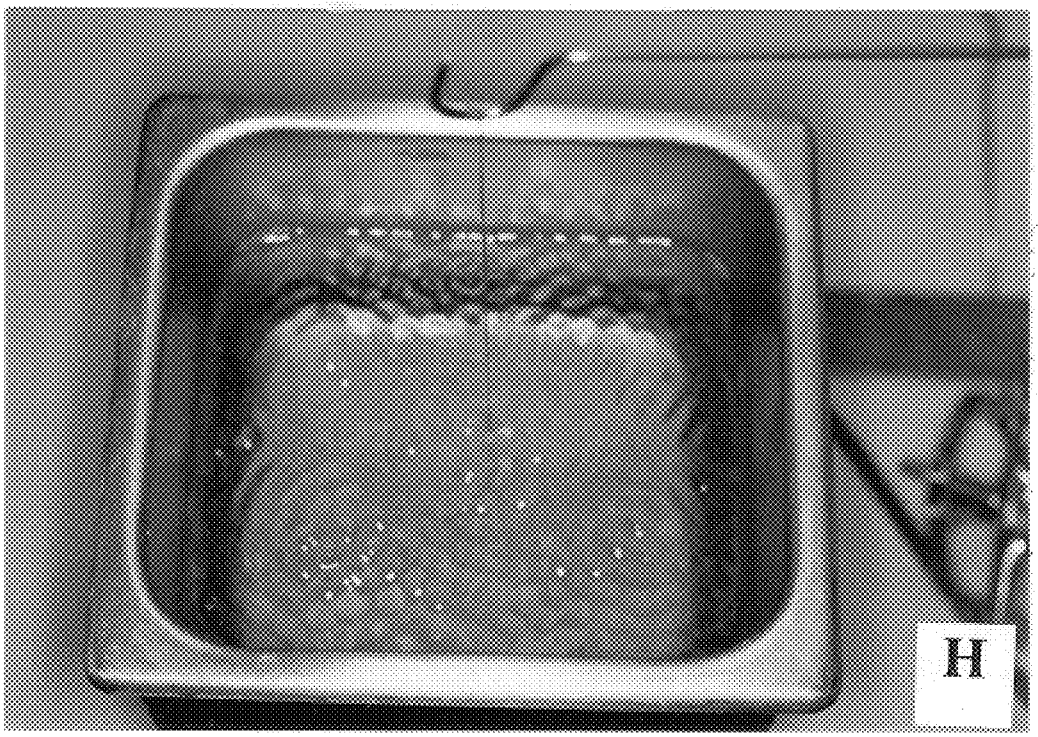
Figure 10:
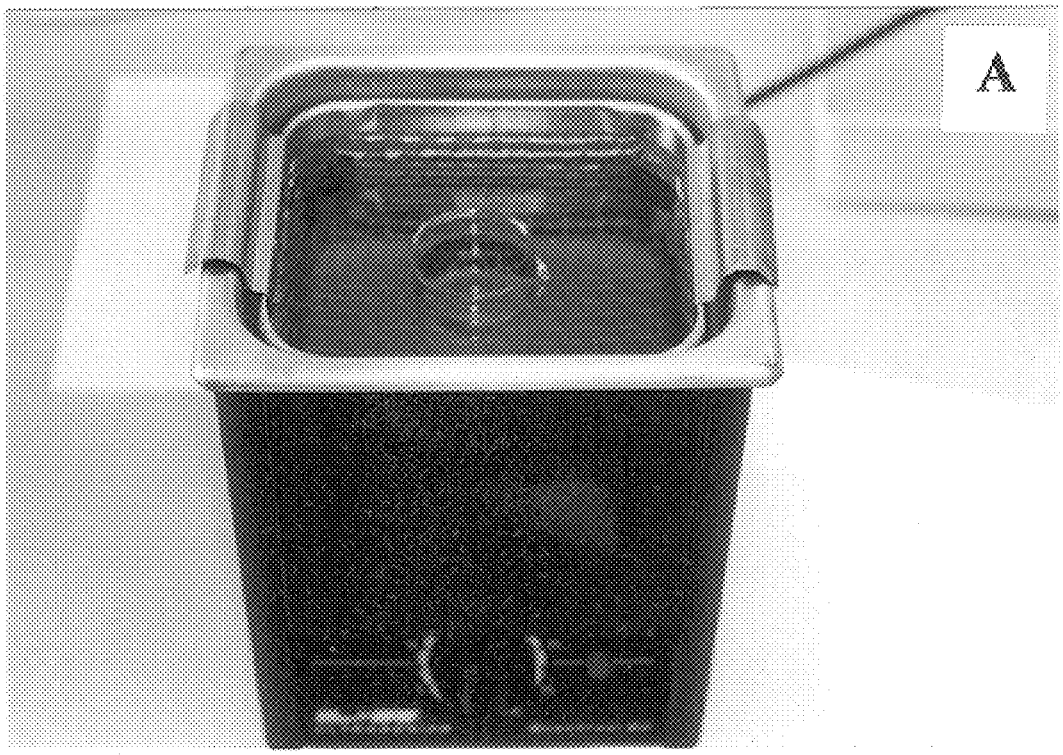
Figure 11:
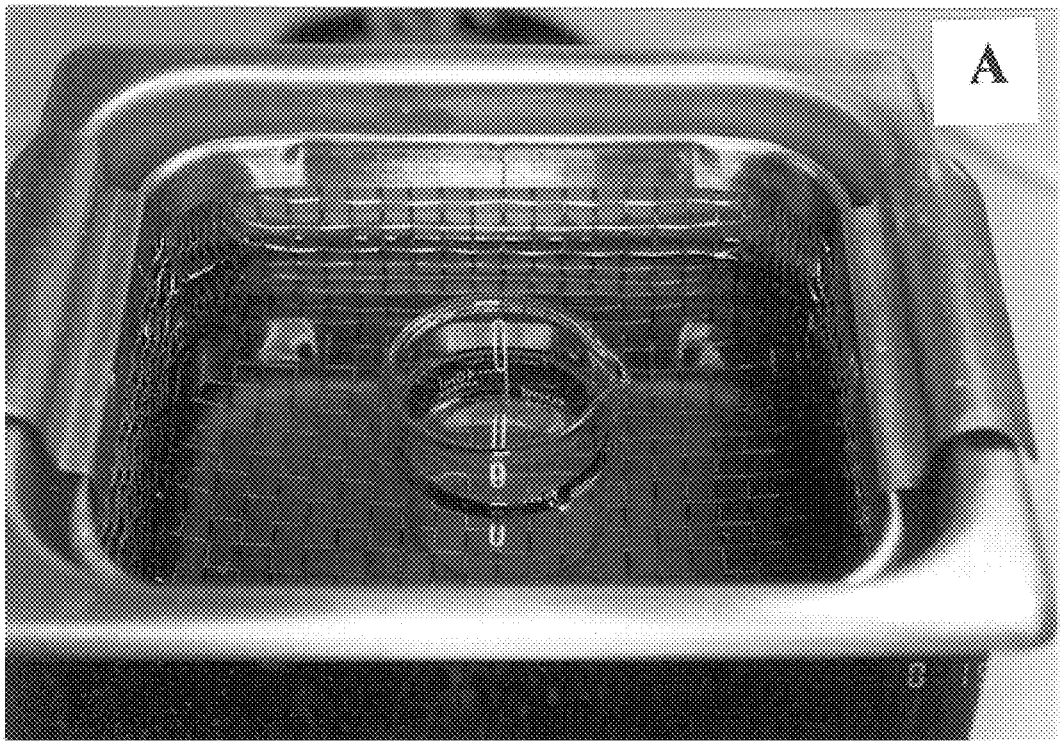
Figure 12:
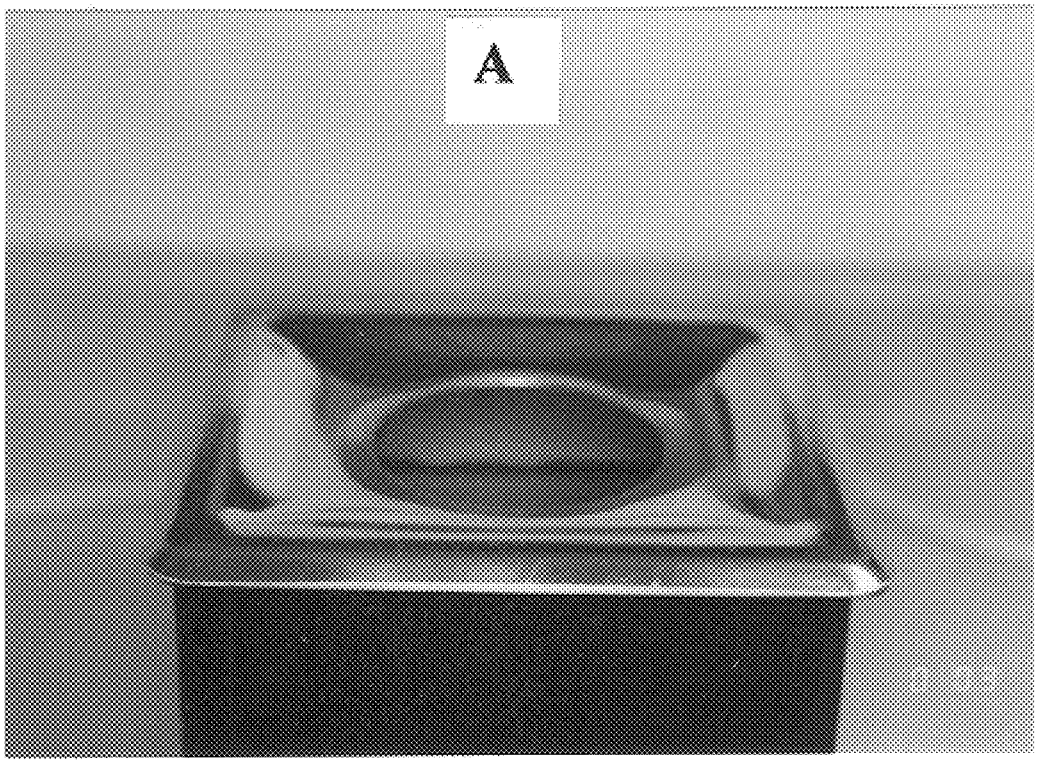
Figure 13:
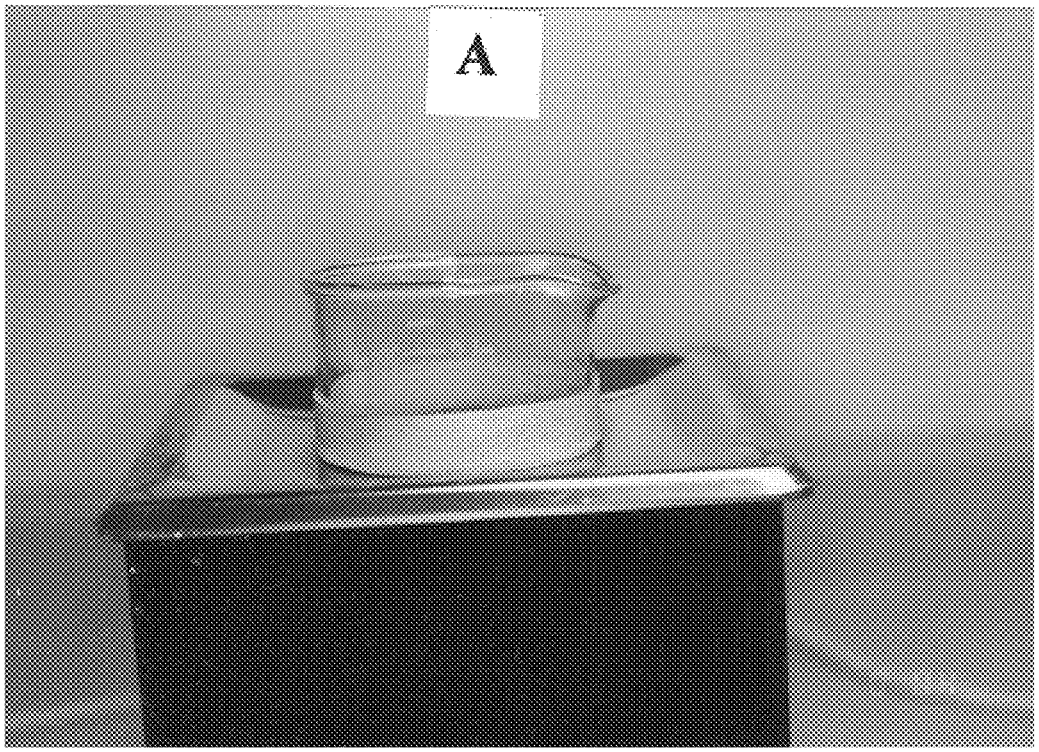
Figure 14:
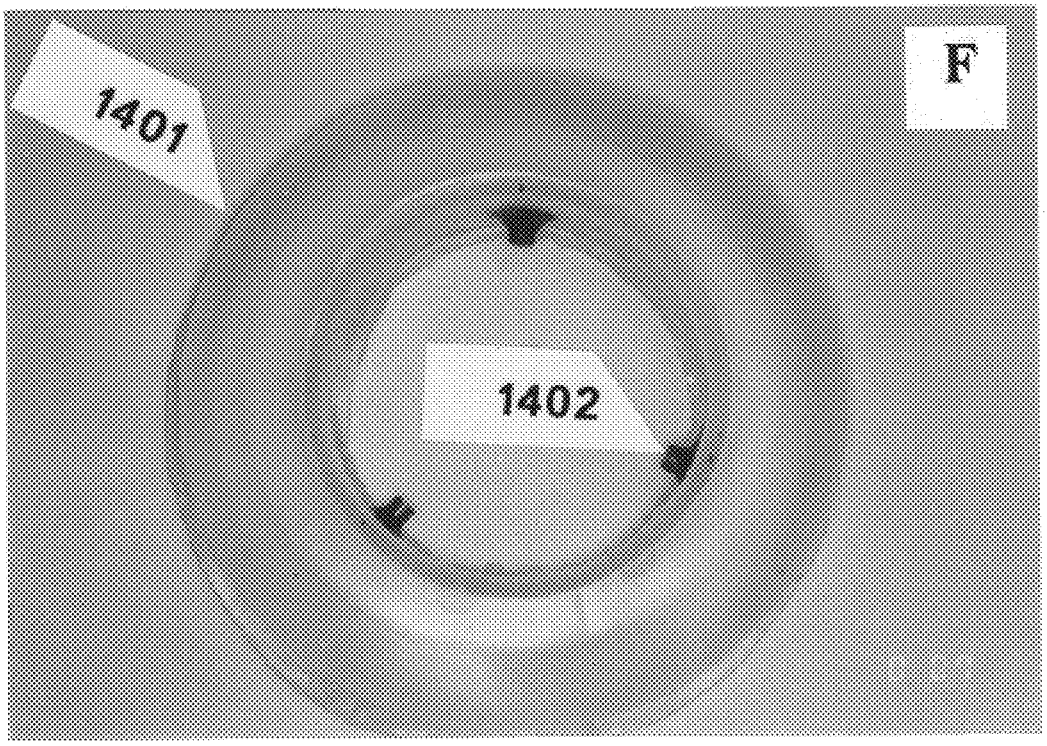
Figure 15:
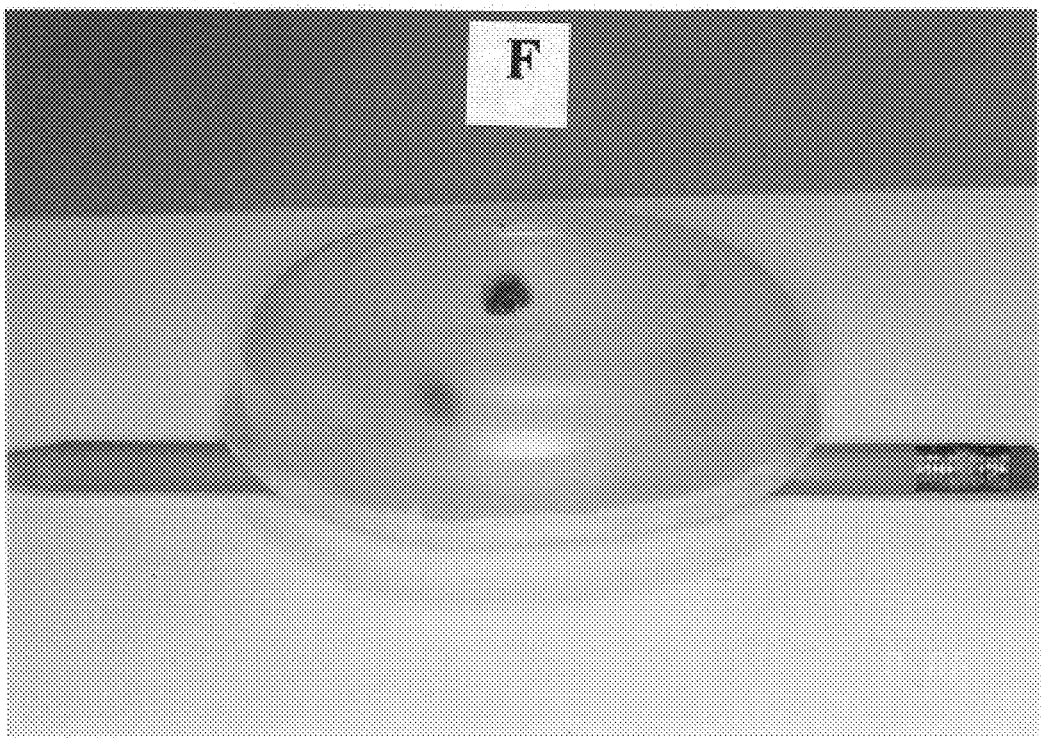
Figure 16:
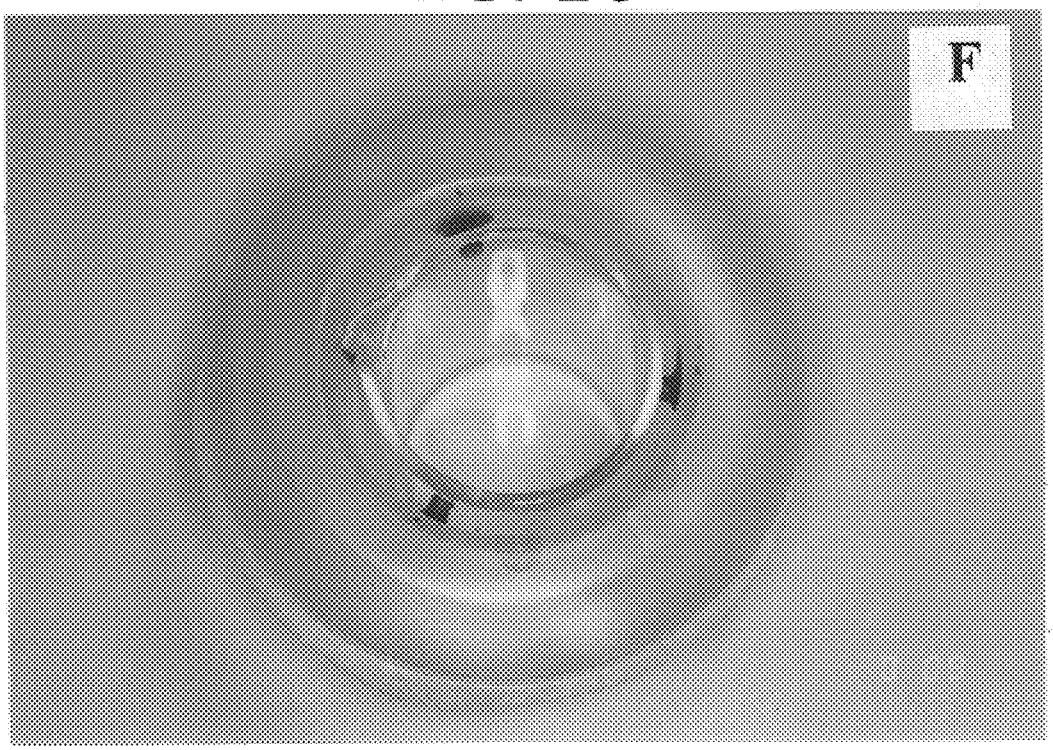
Figure 17:
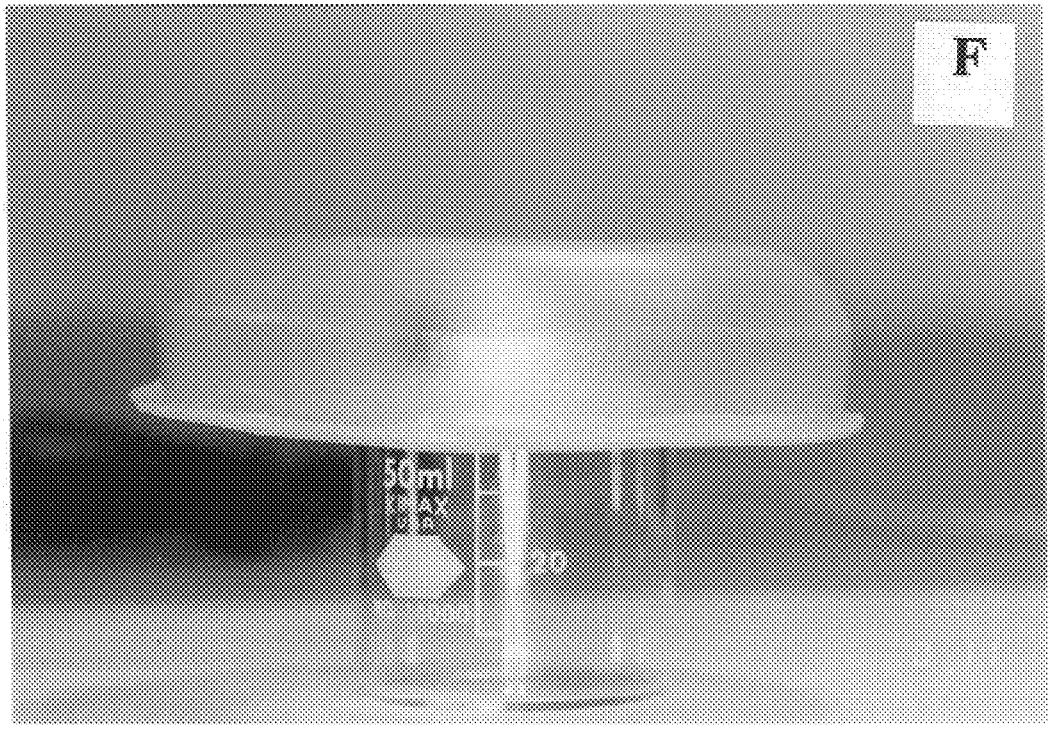
Figure 18:
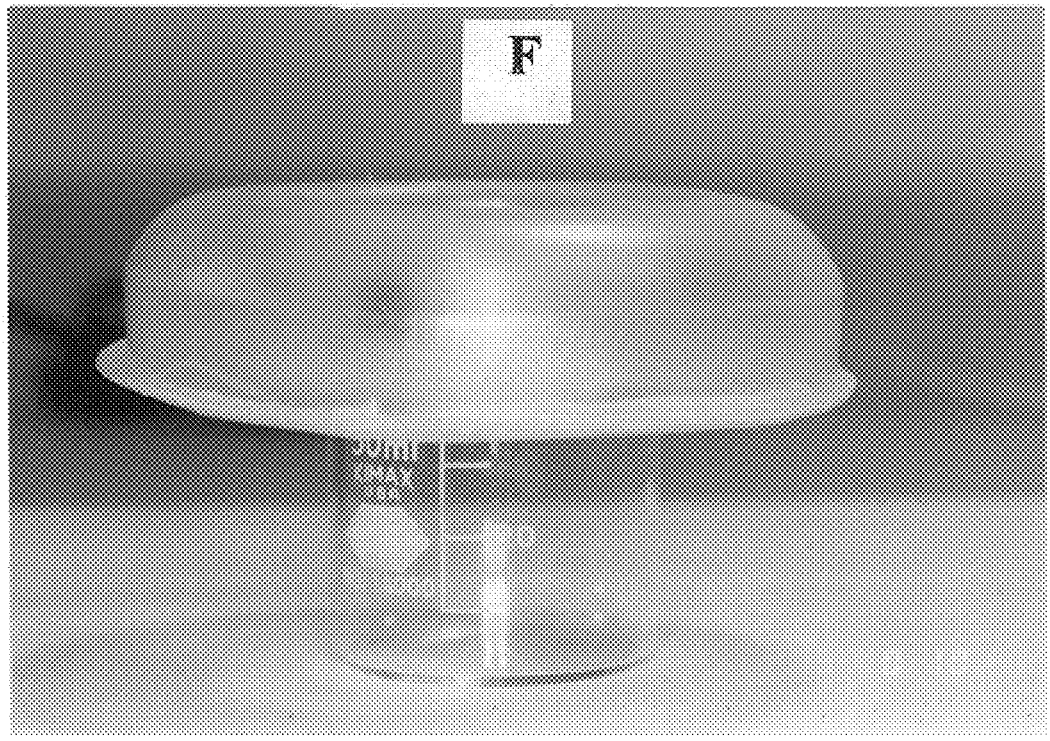
Figure 19:
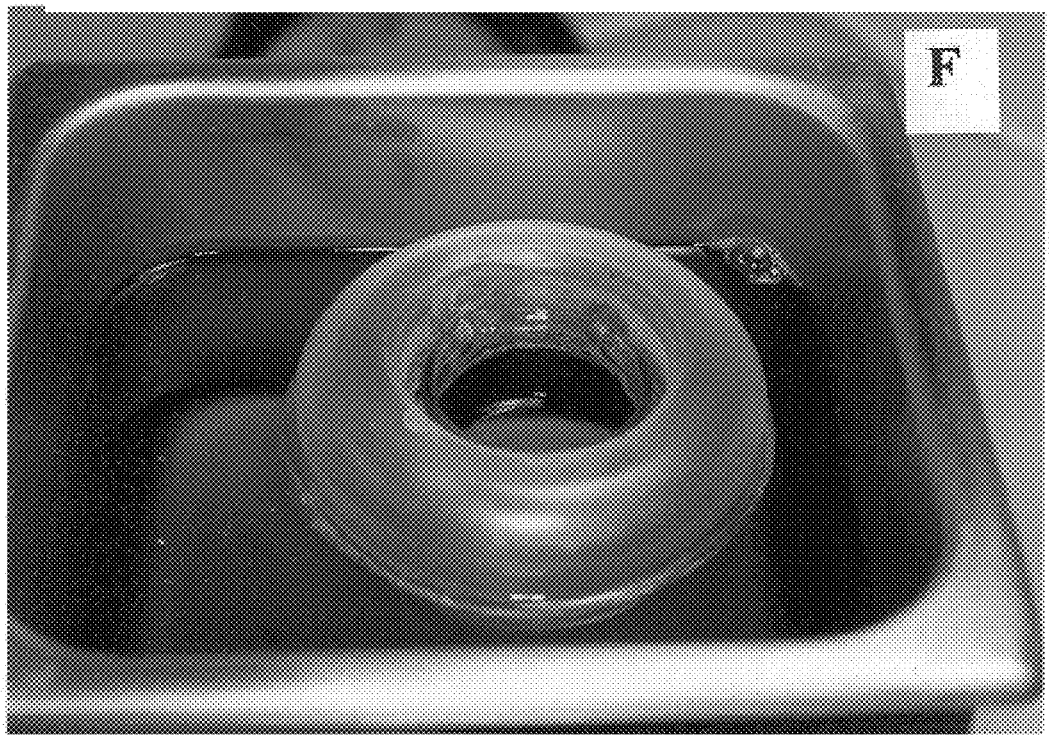
Figure 20:
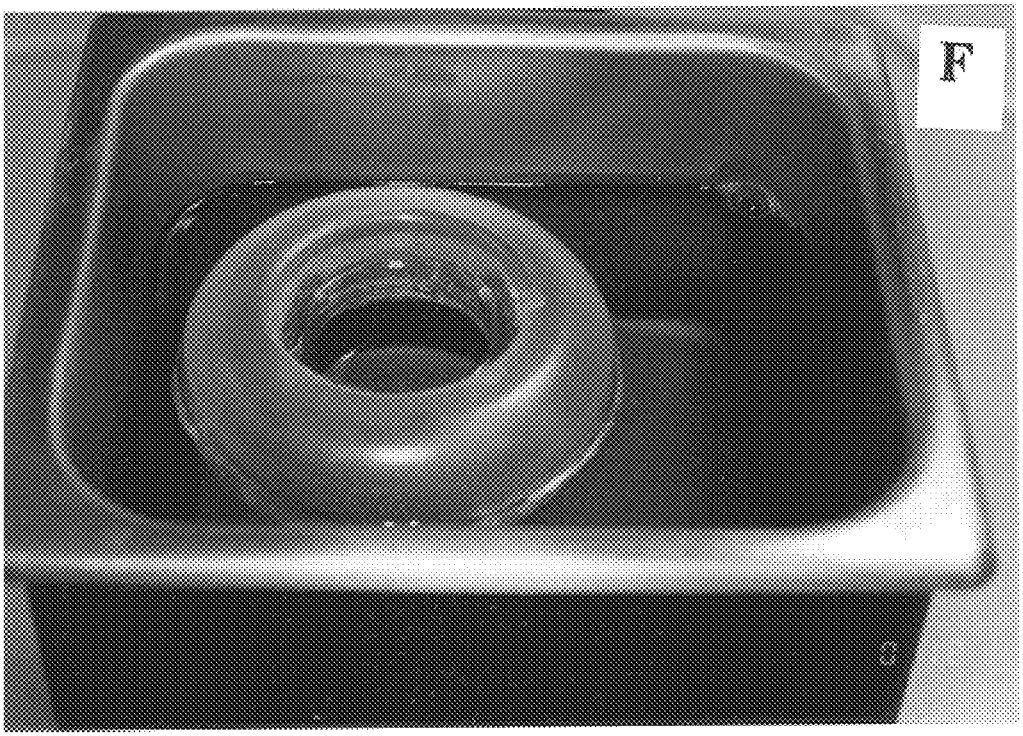
Figure 21:
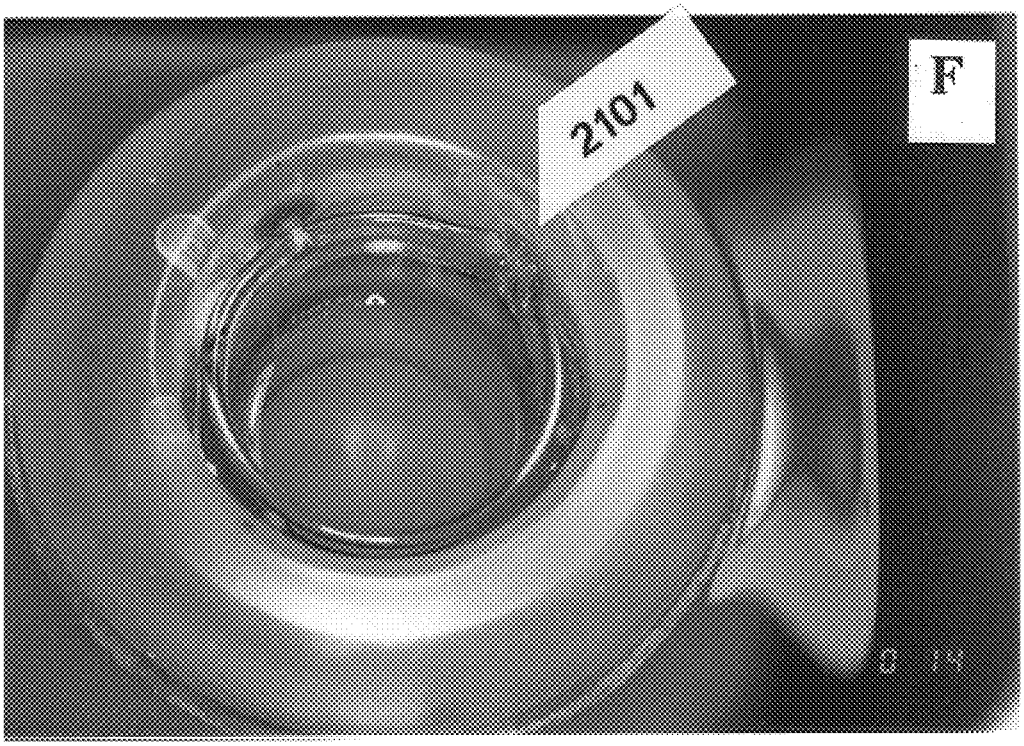
Figure 22:
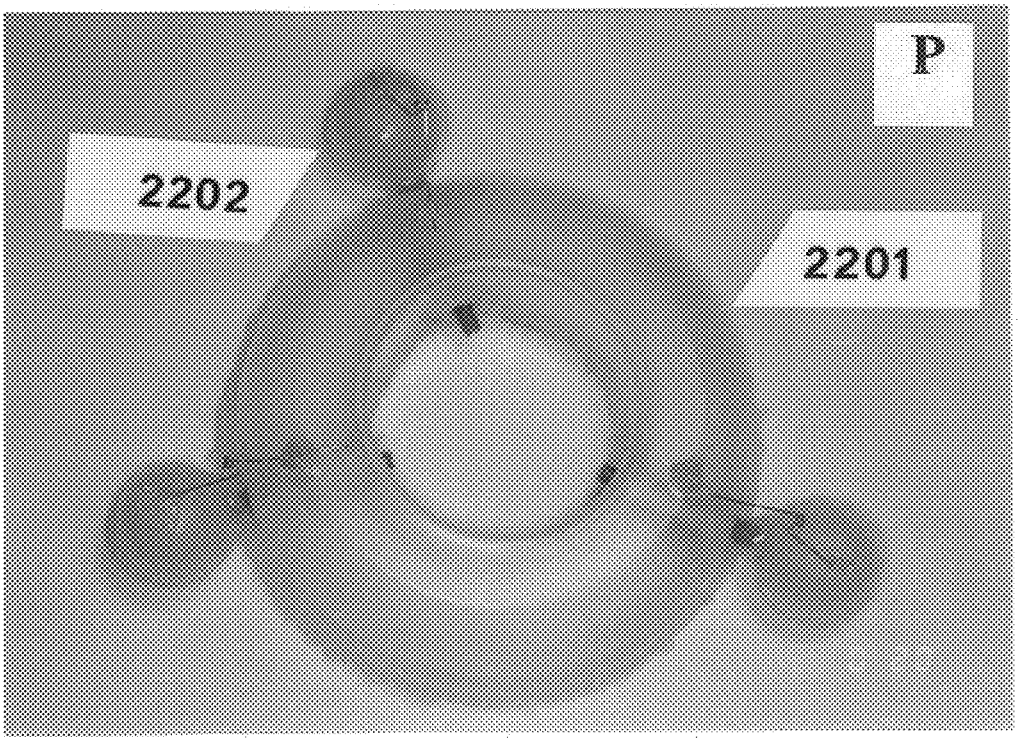
Figure 23:
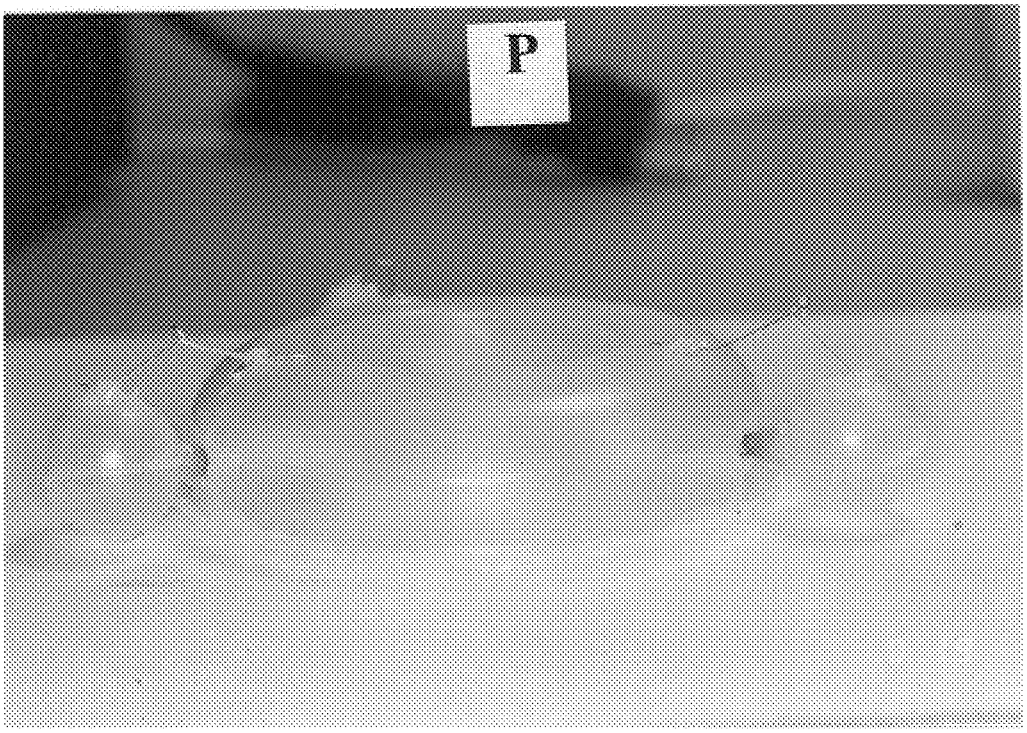
Figure 24:
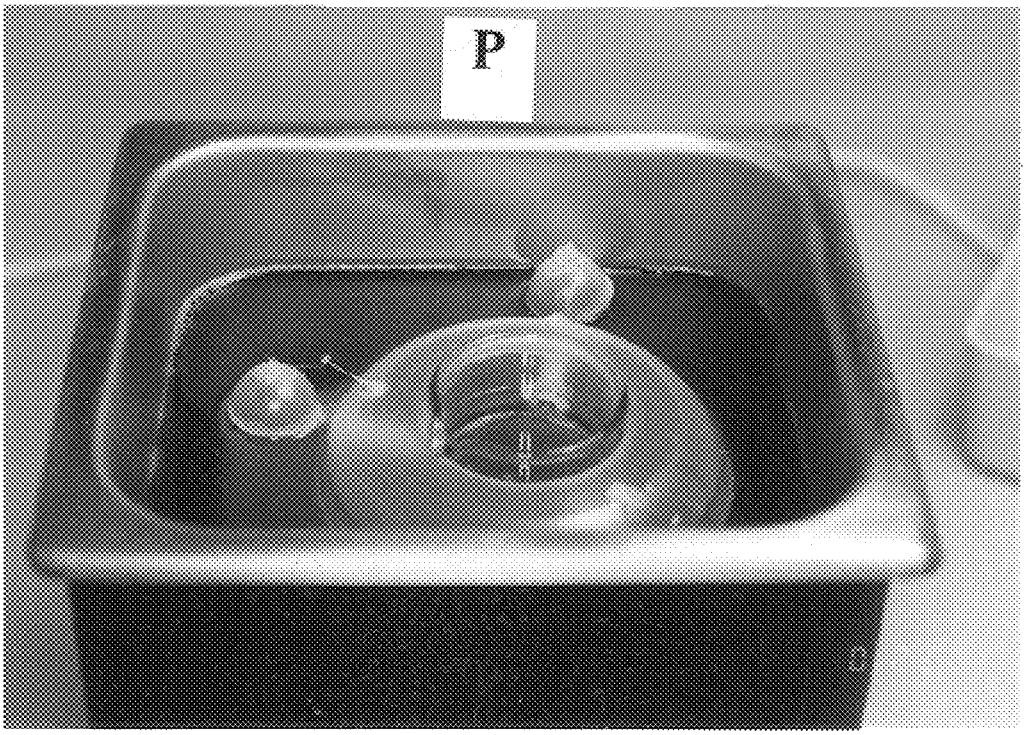
Figure 25:
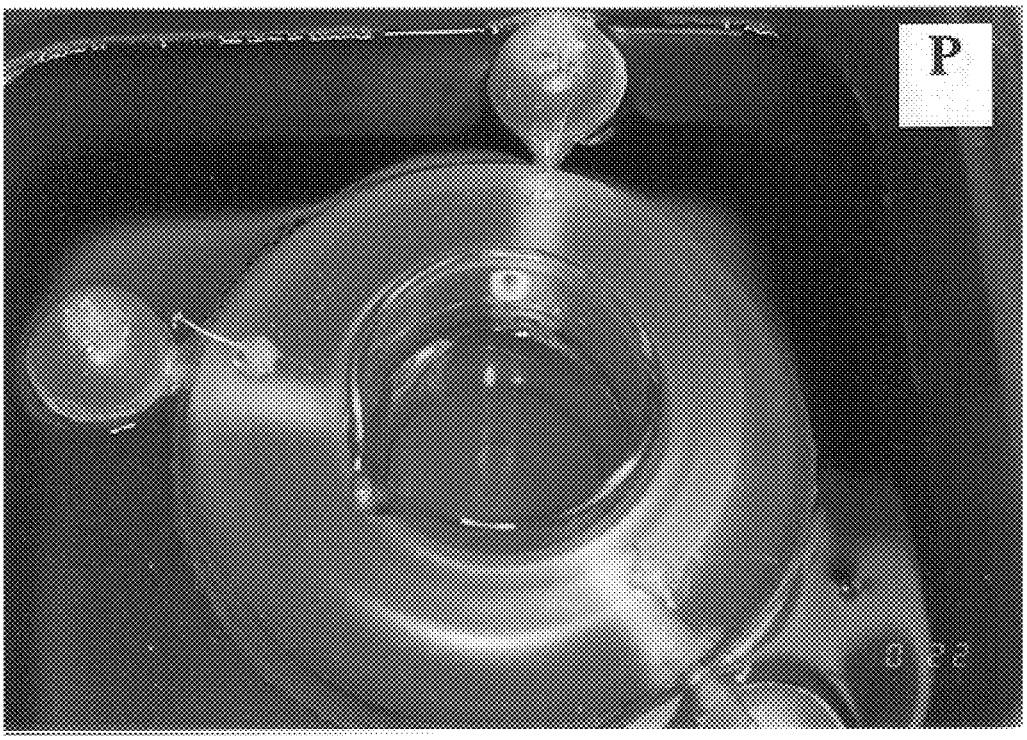
Figure 26:
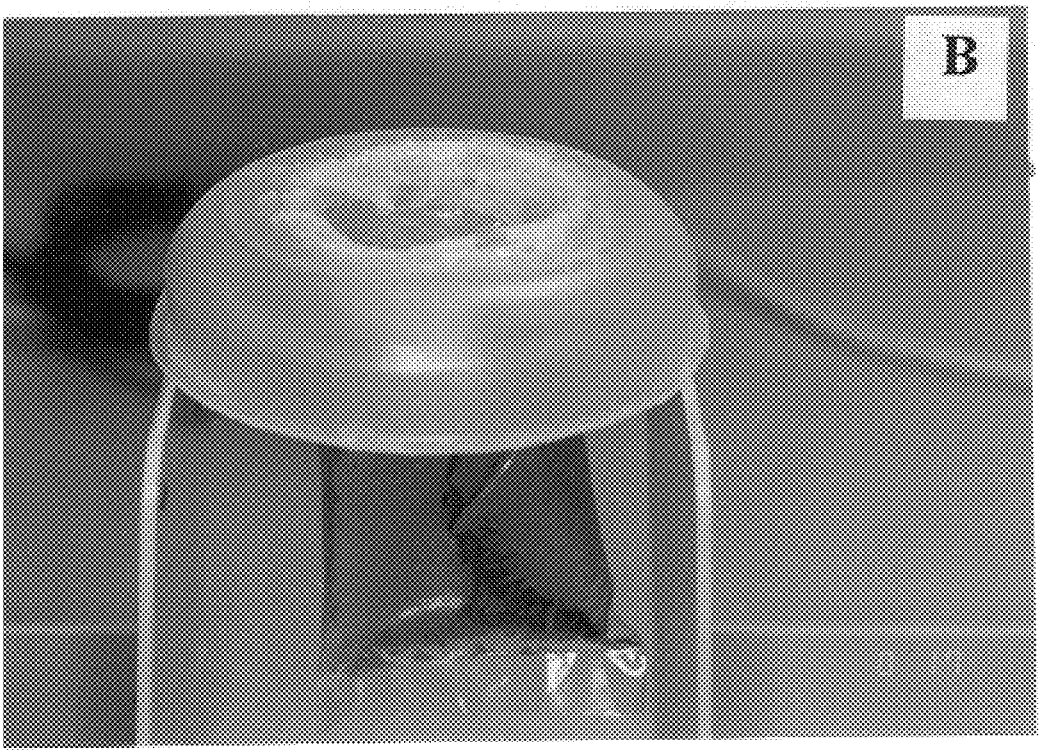
Figure 27:
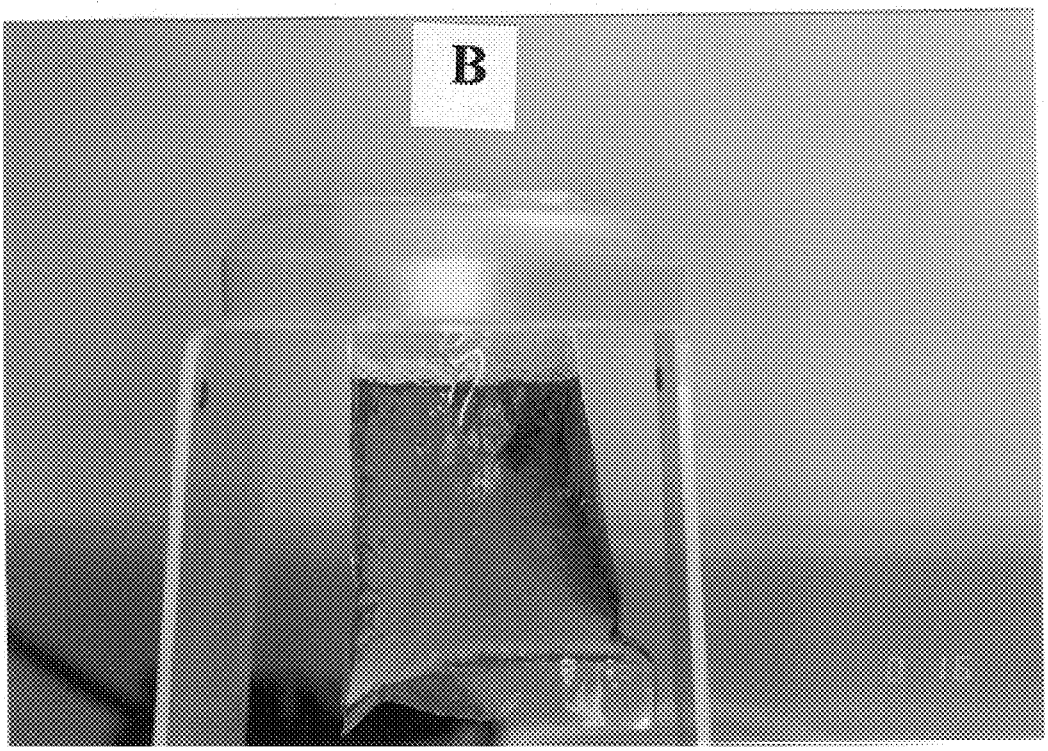
Figure 28:
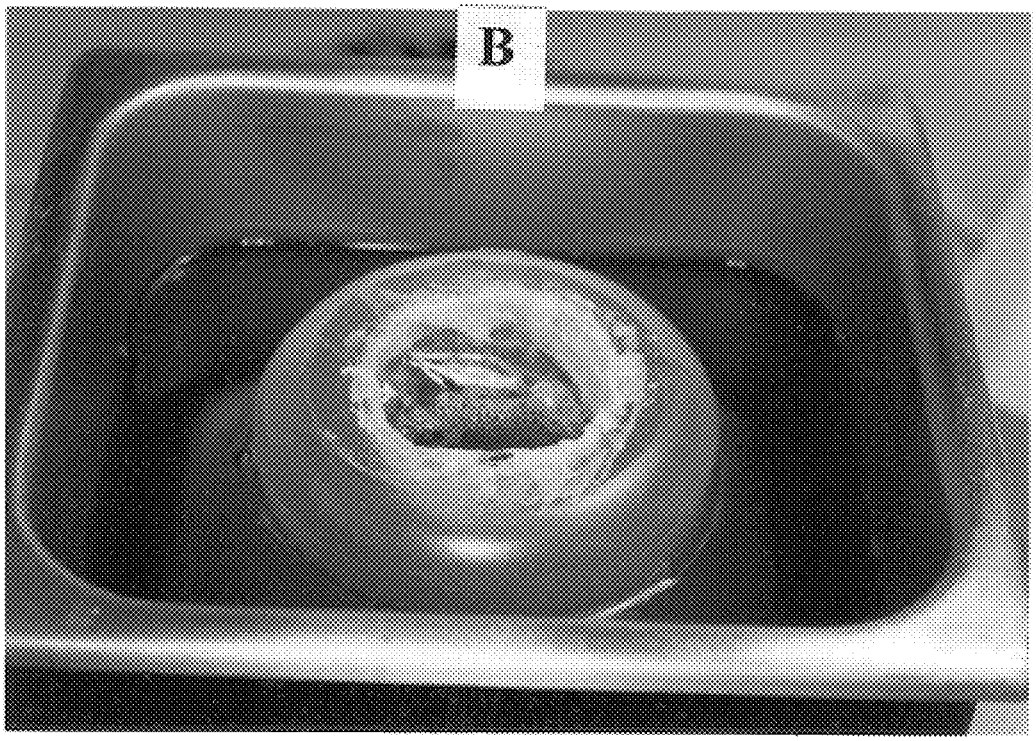
Figure 29:
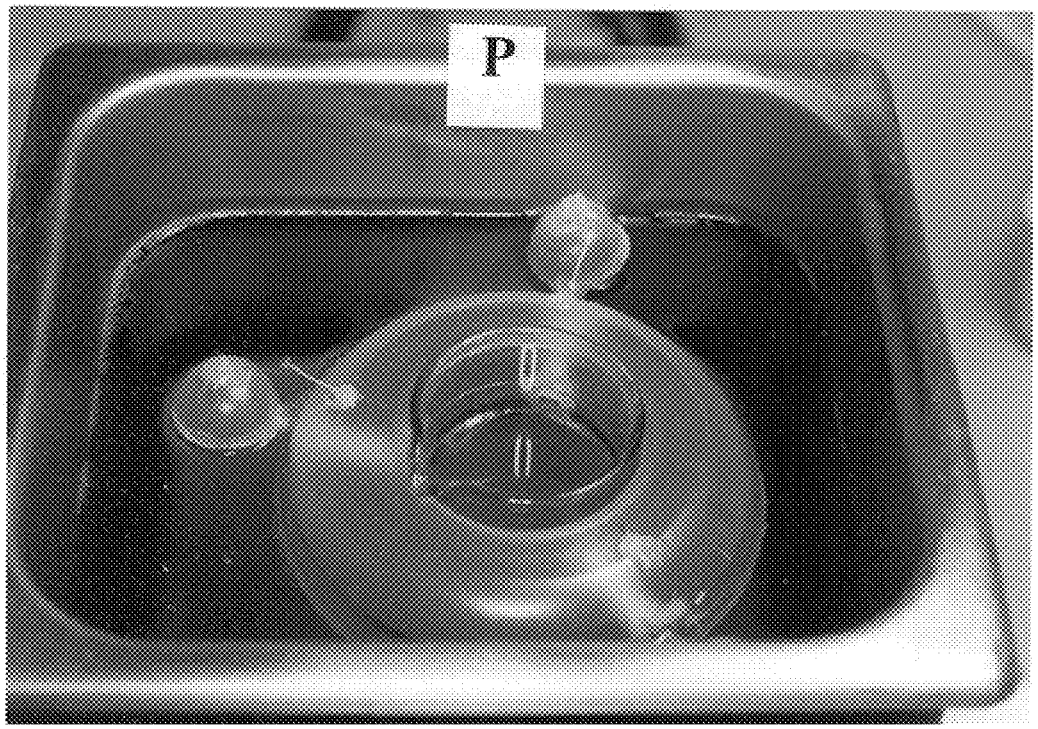
Figure 30:
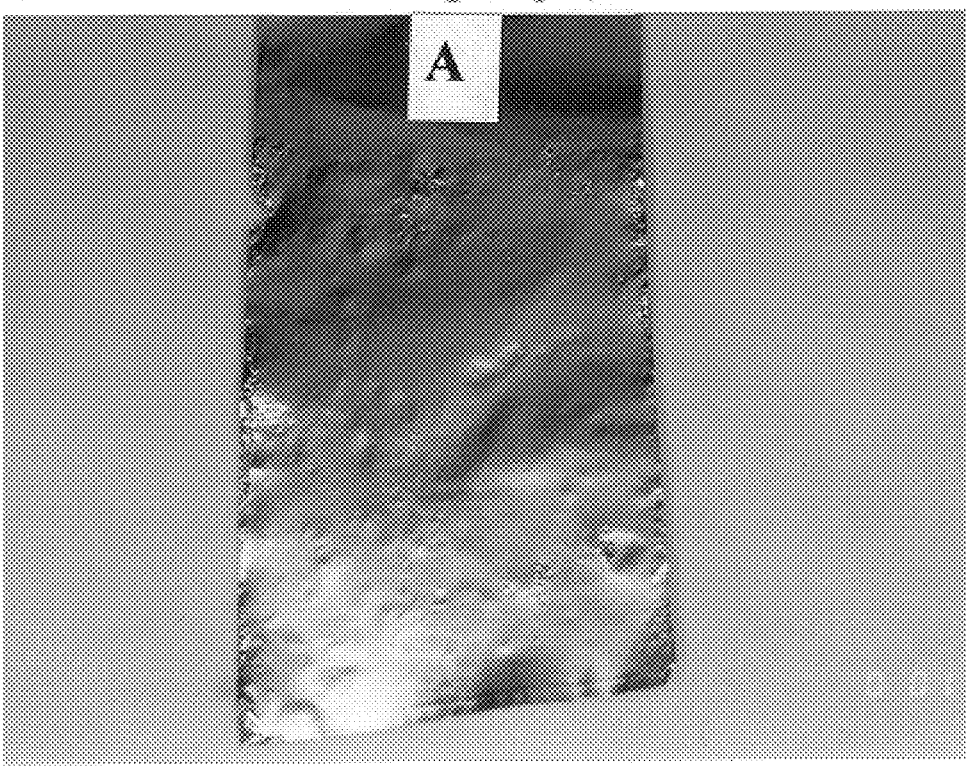
Figure 31:
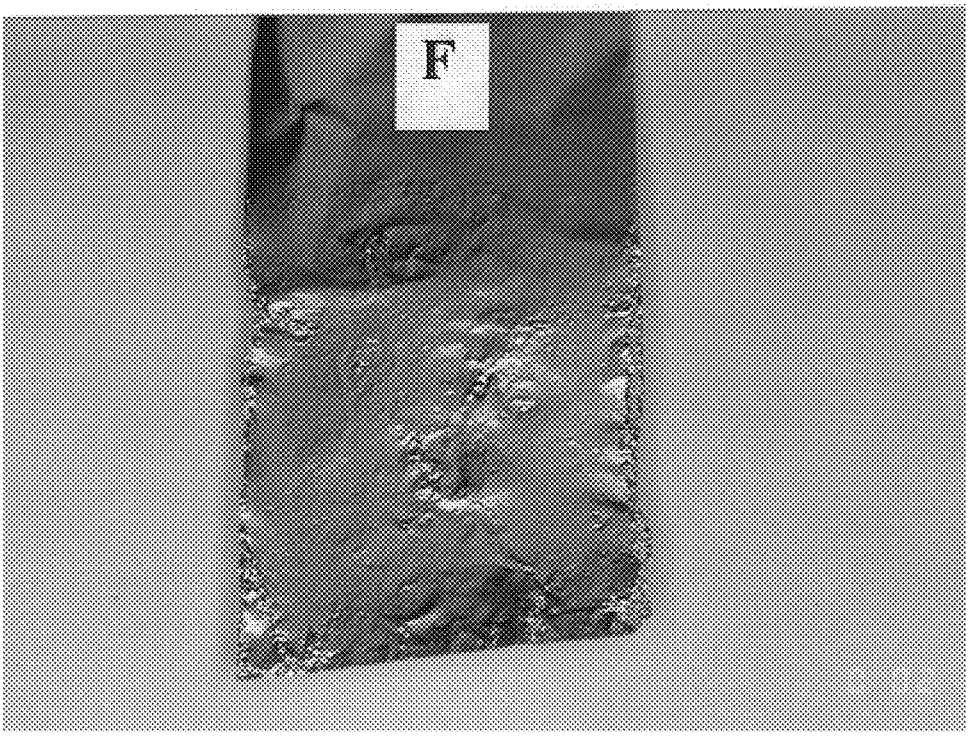
Figure 32:
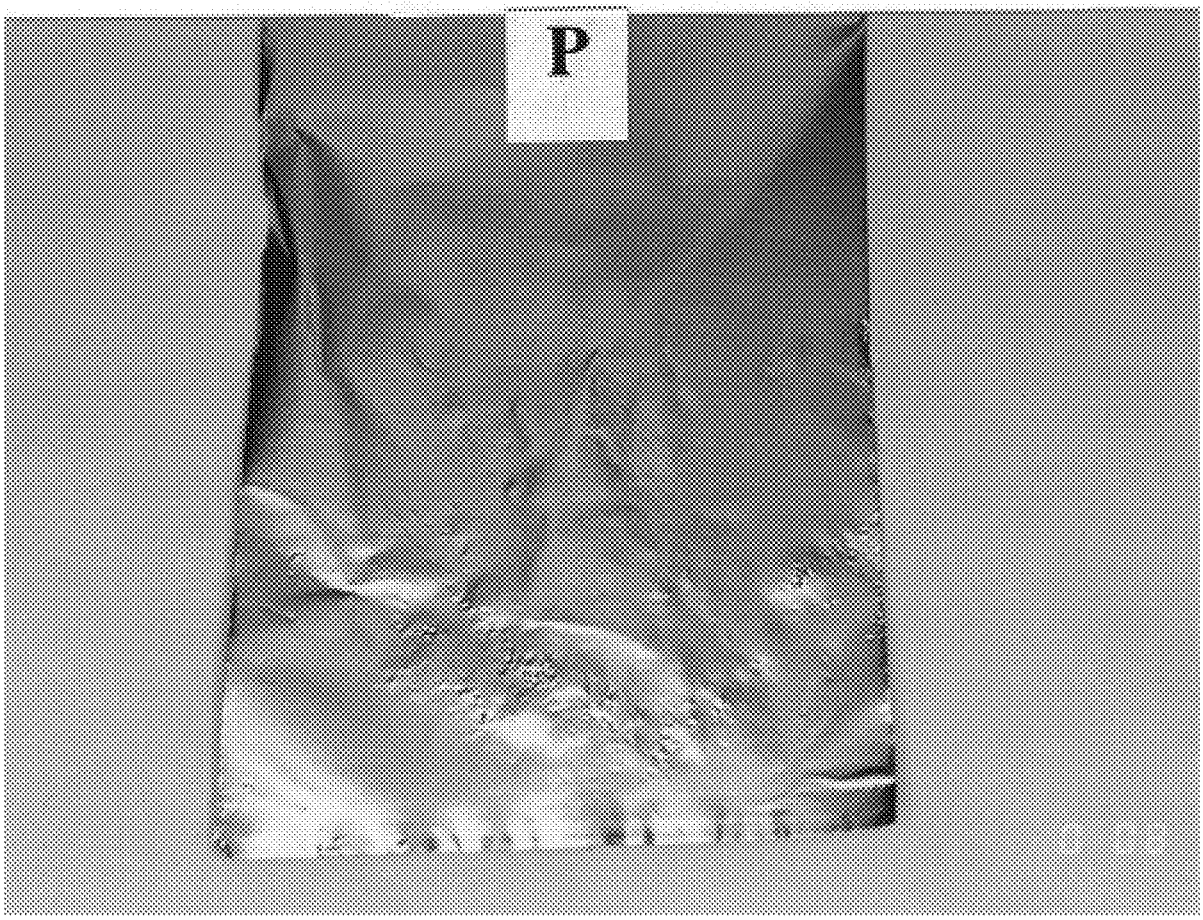
Figure 33:
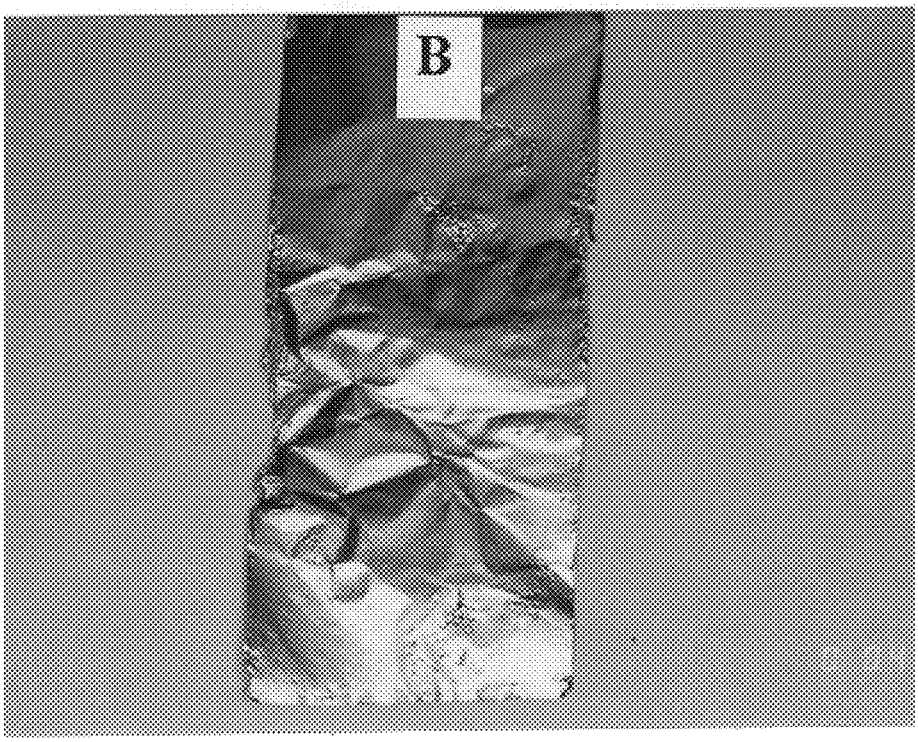
Figure 33:
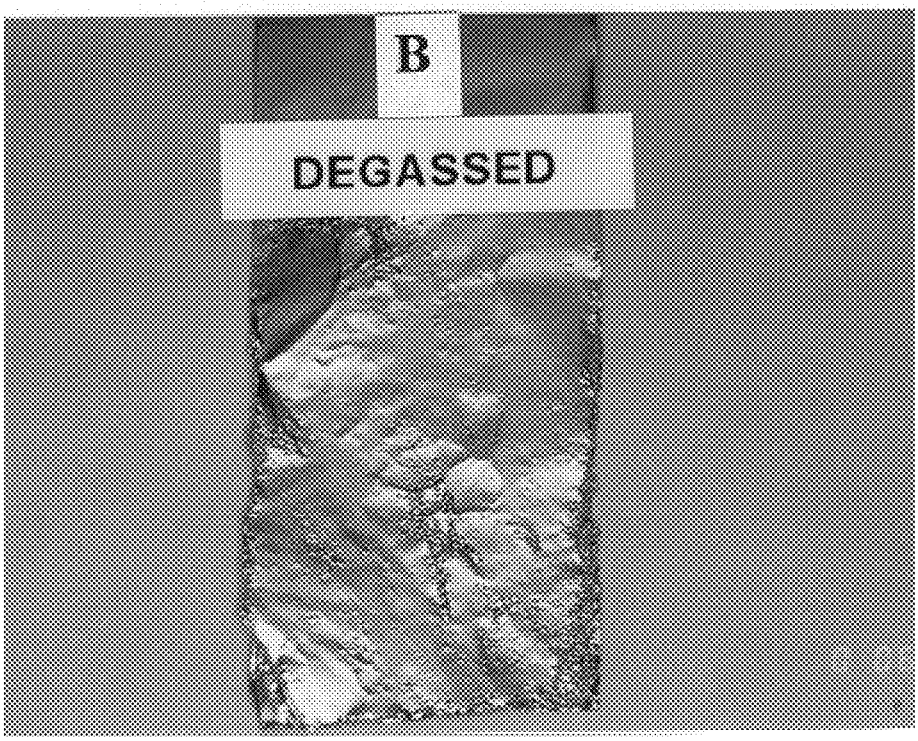
Figure 34:
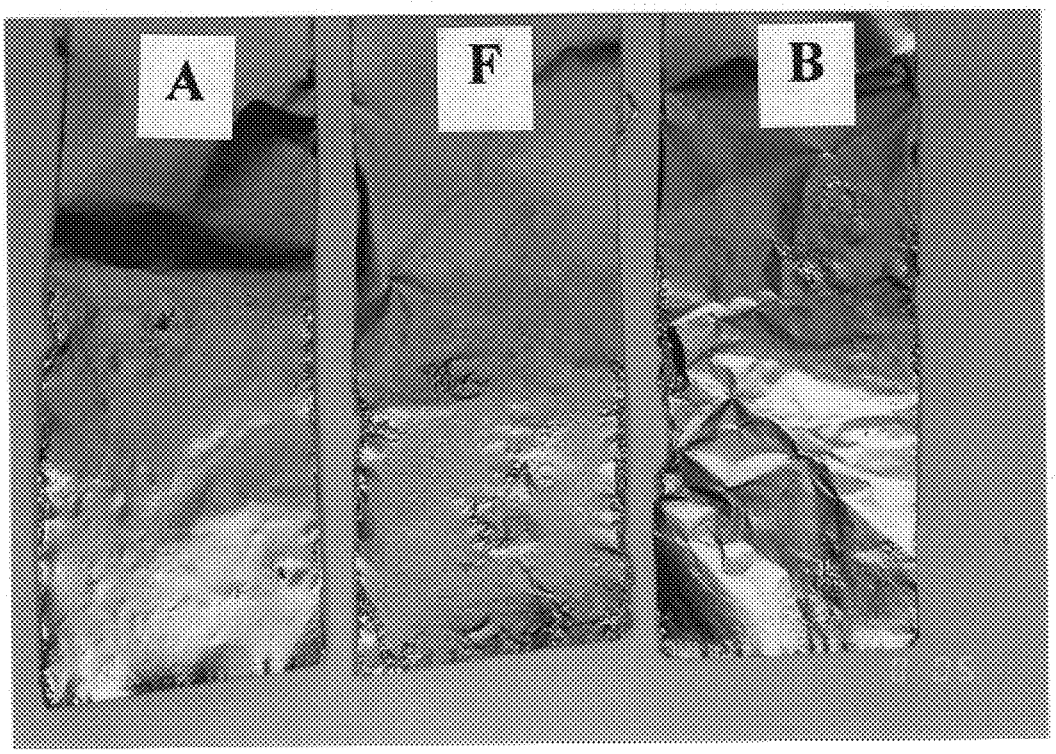
Figure 35:
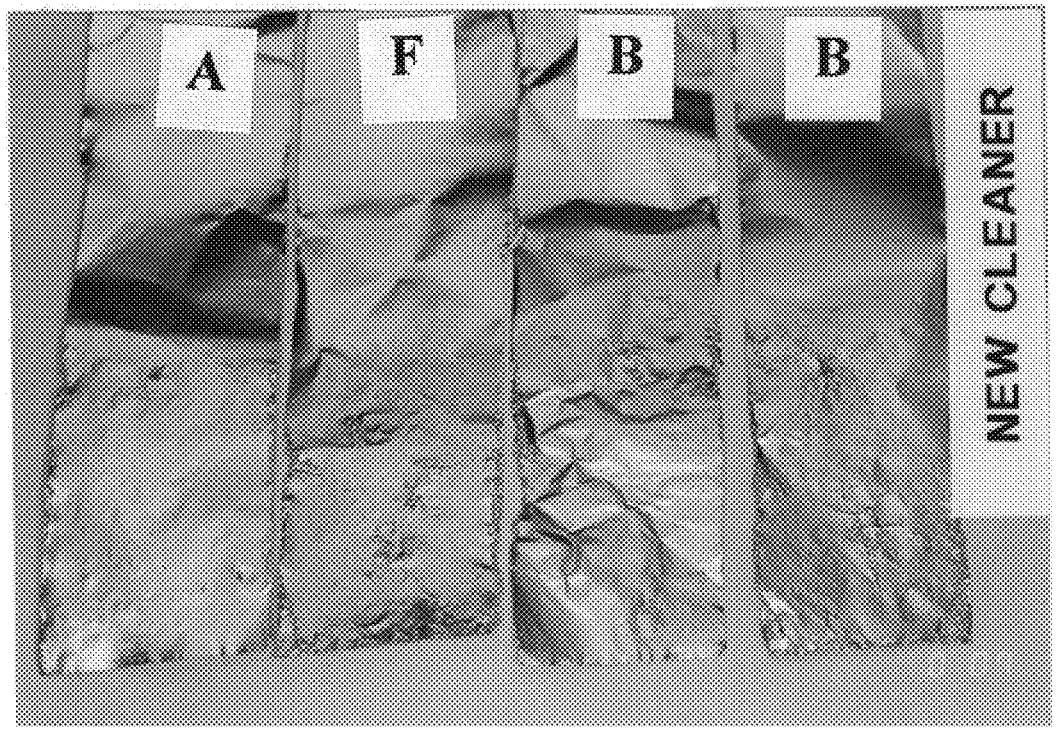
Figure 36:
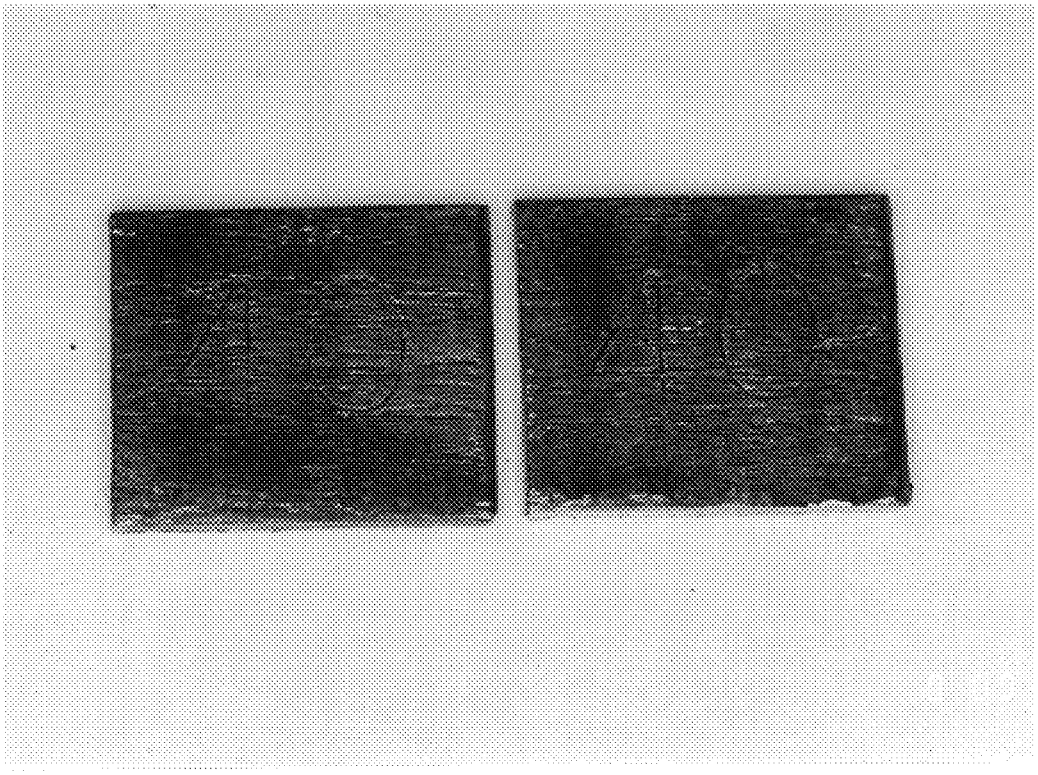
Figure 37:
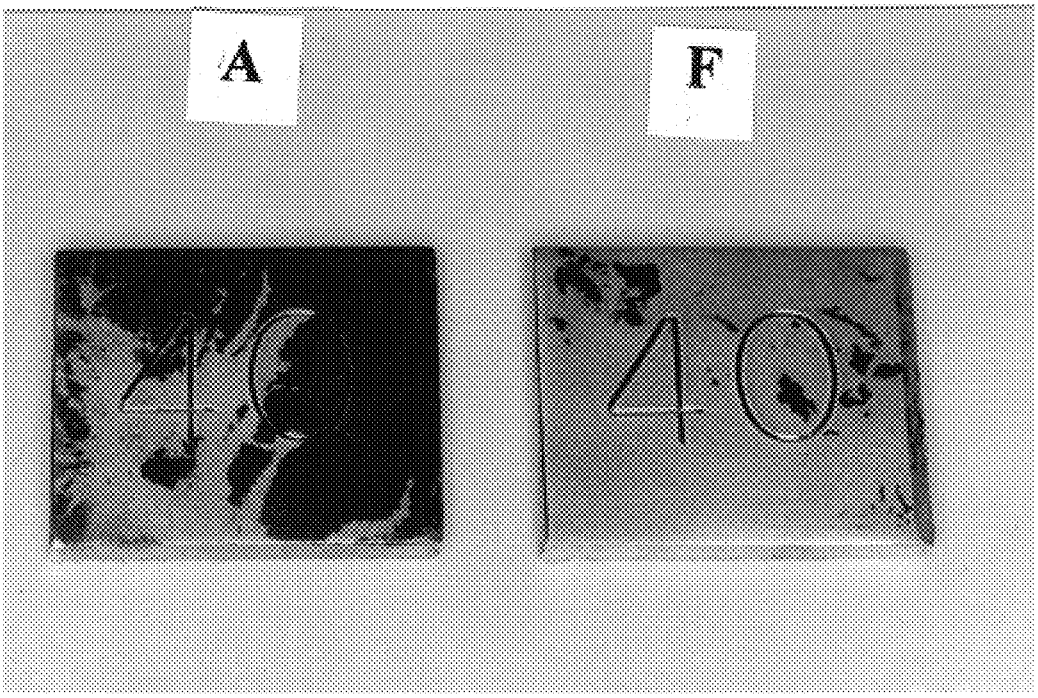
Figure 38:
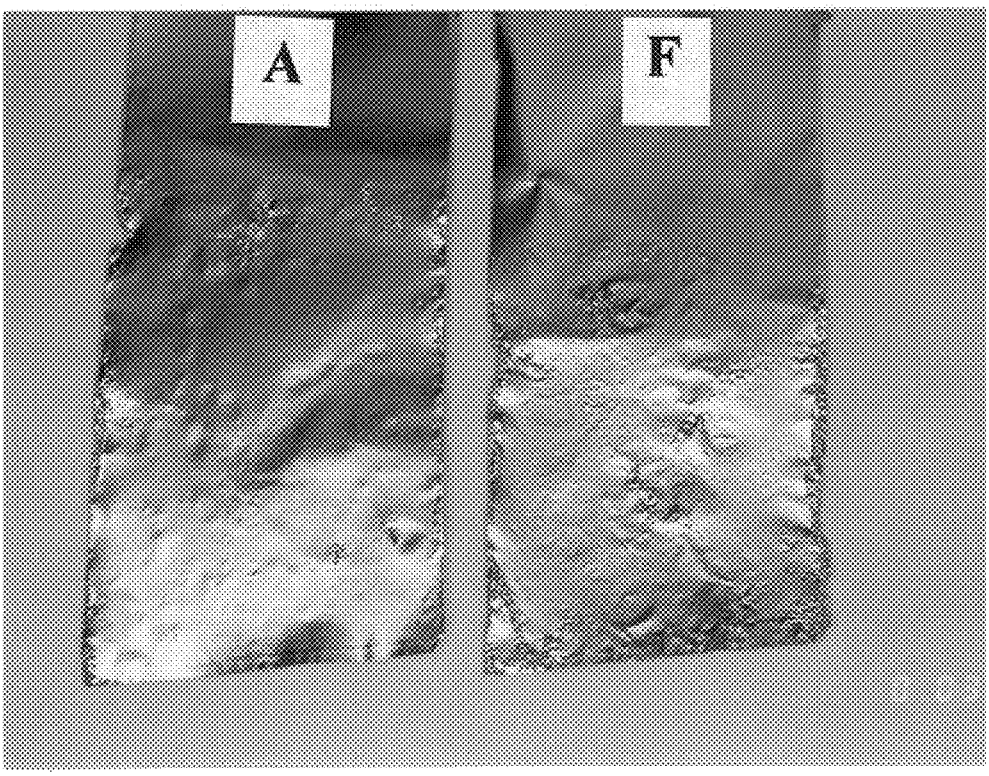
Figure 39:
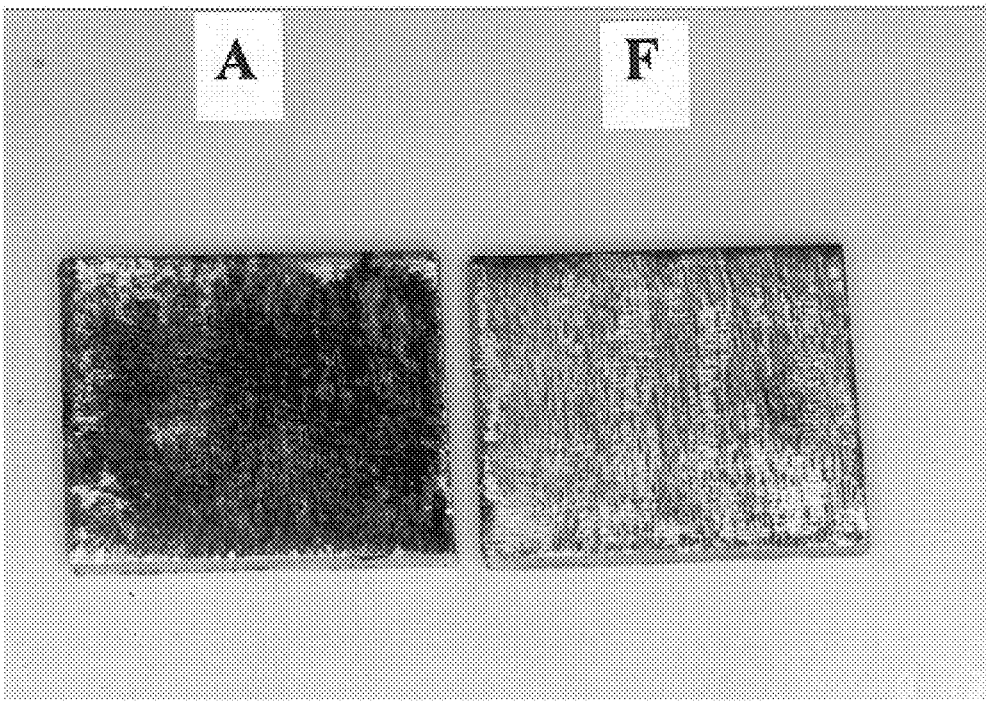
Figure 40:
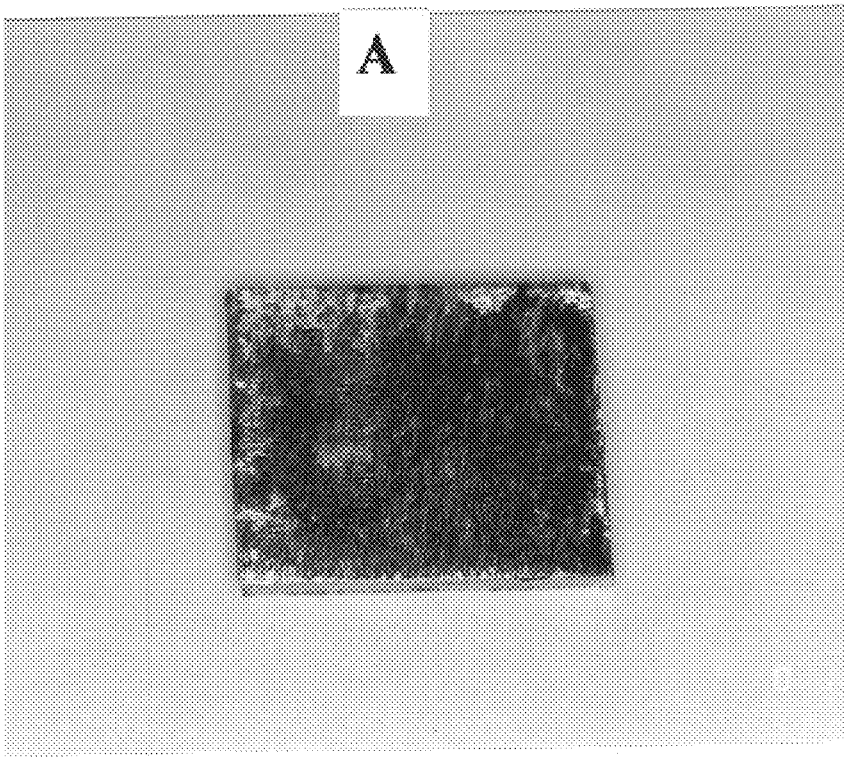
Figure 41:
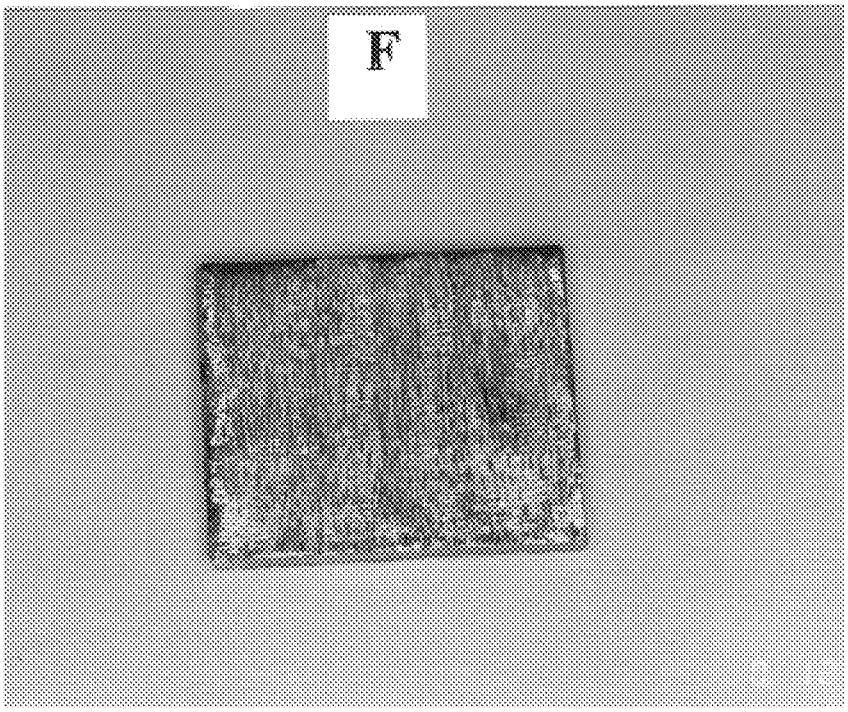
Figure 42:
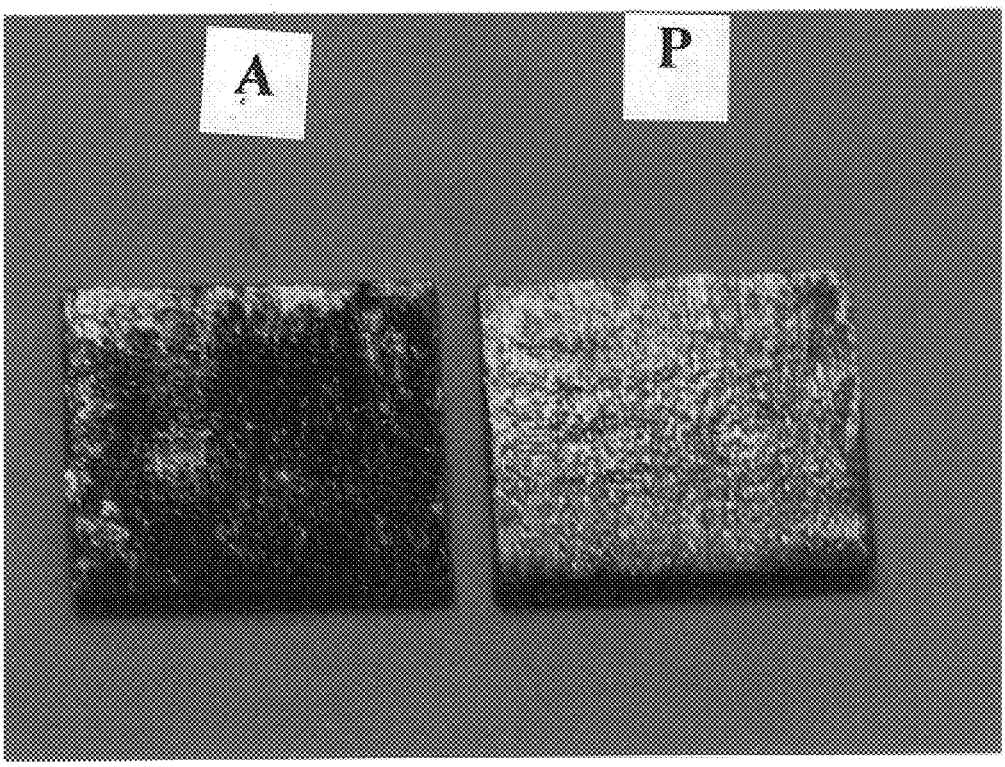
Figure 43:
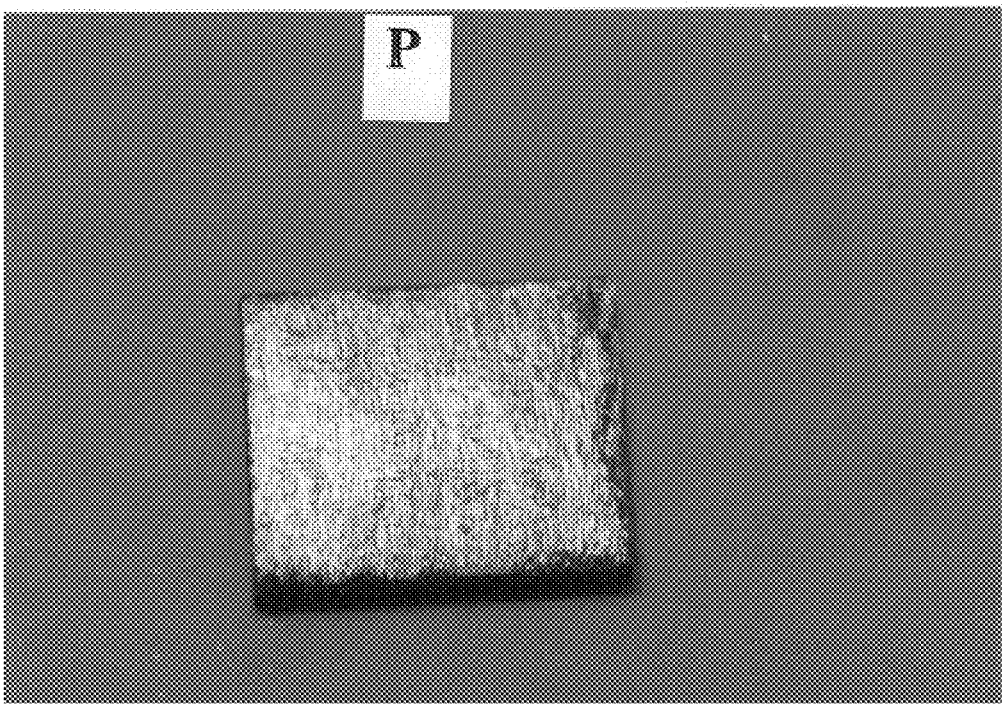
Figure 44:
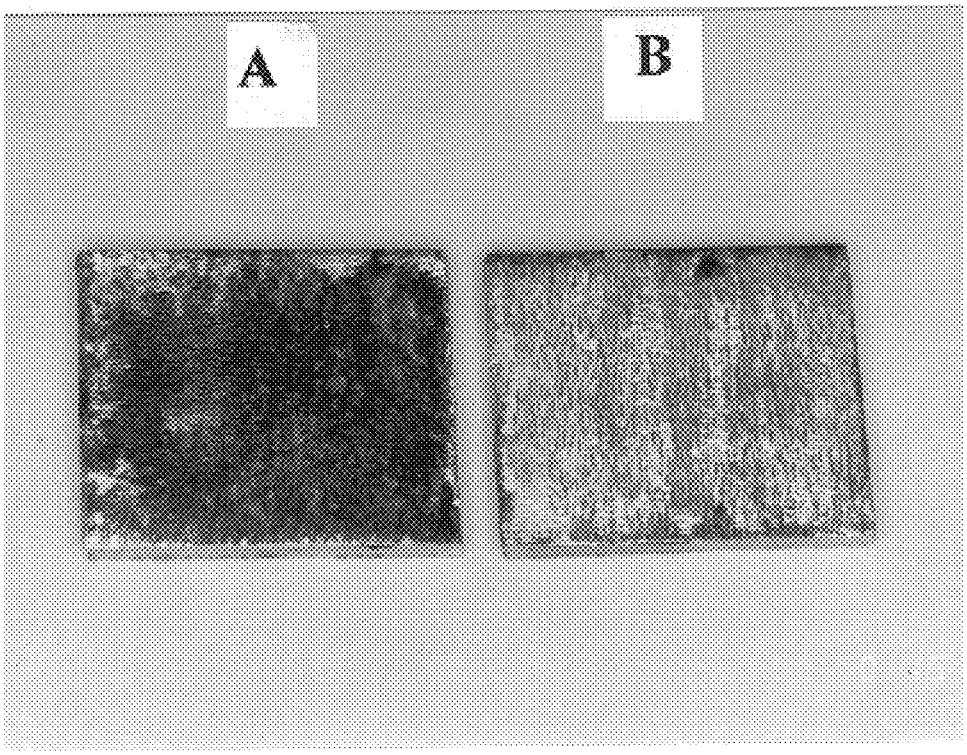
Figure 45:
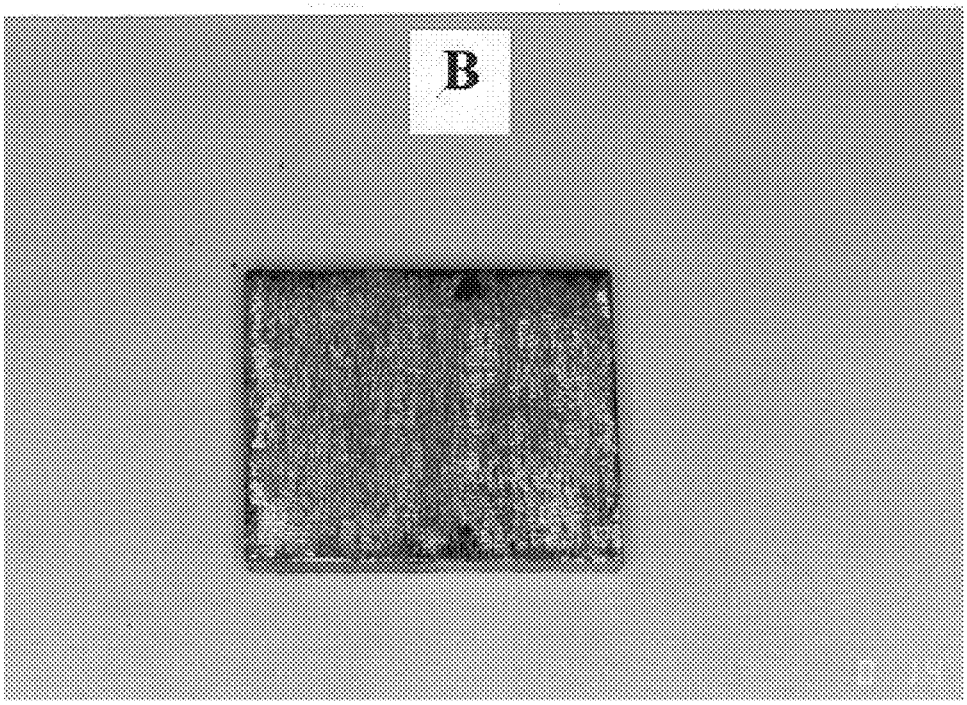
Figure 46:
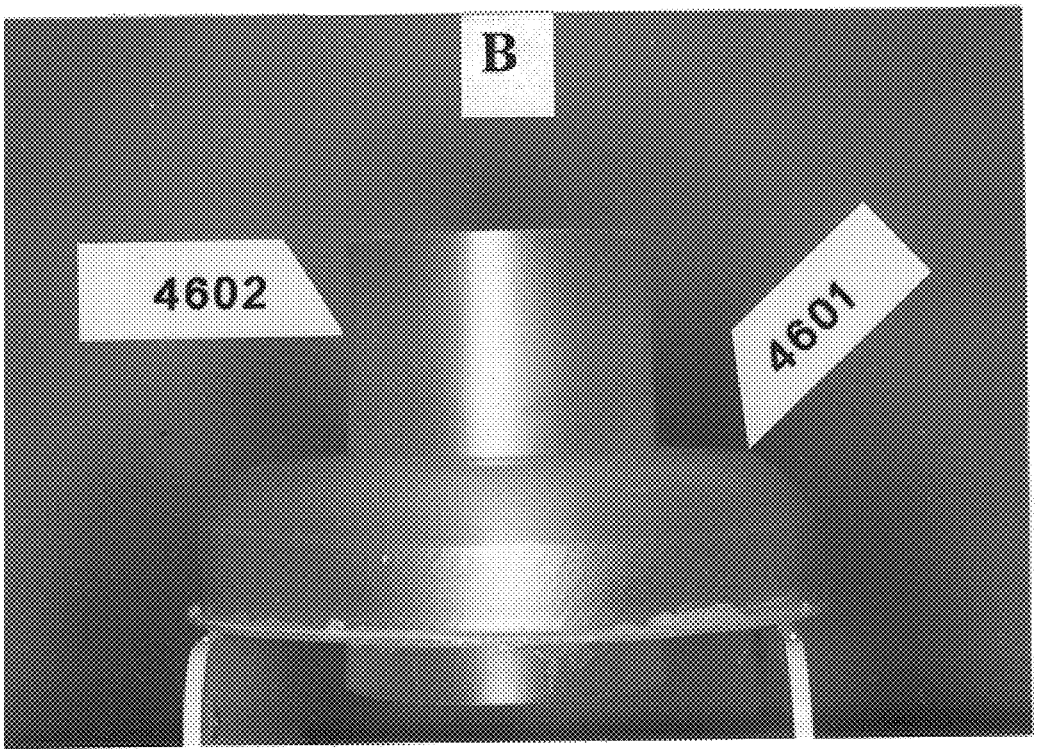
Figure 47:
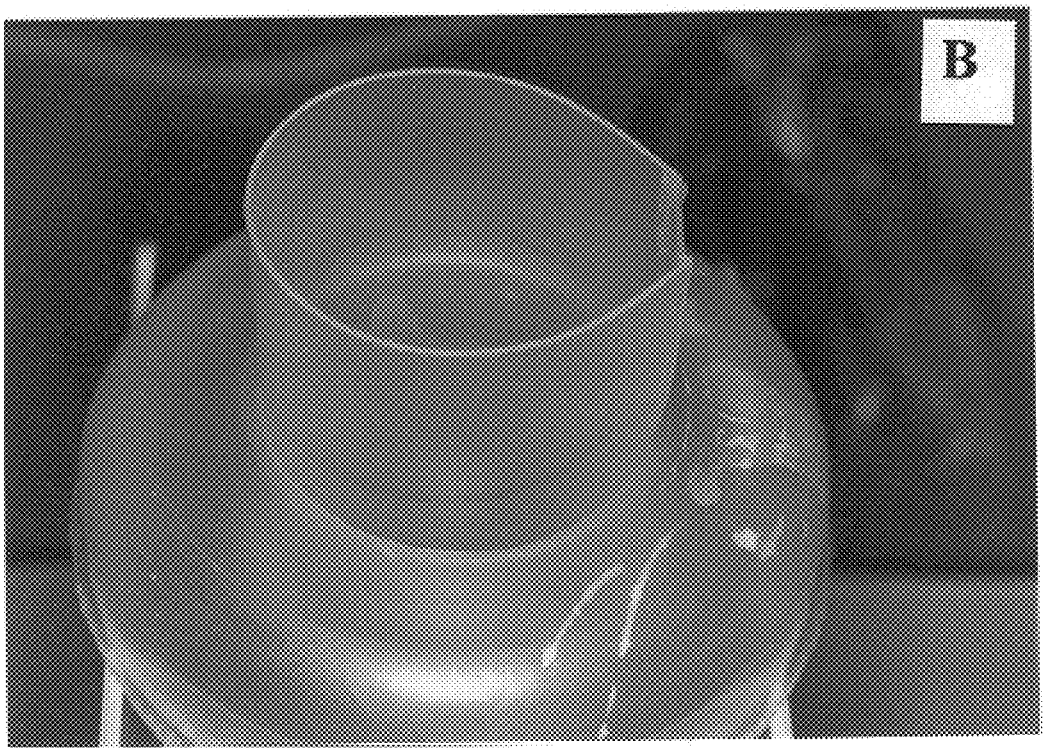
Figure 48:
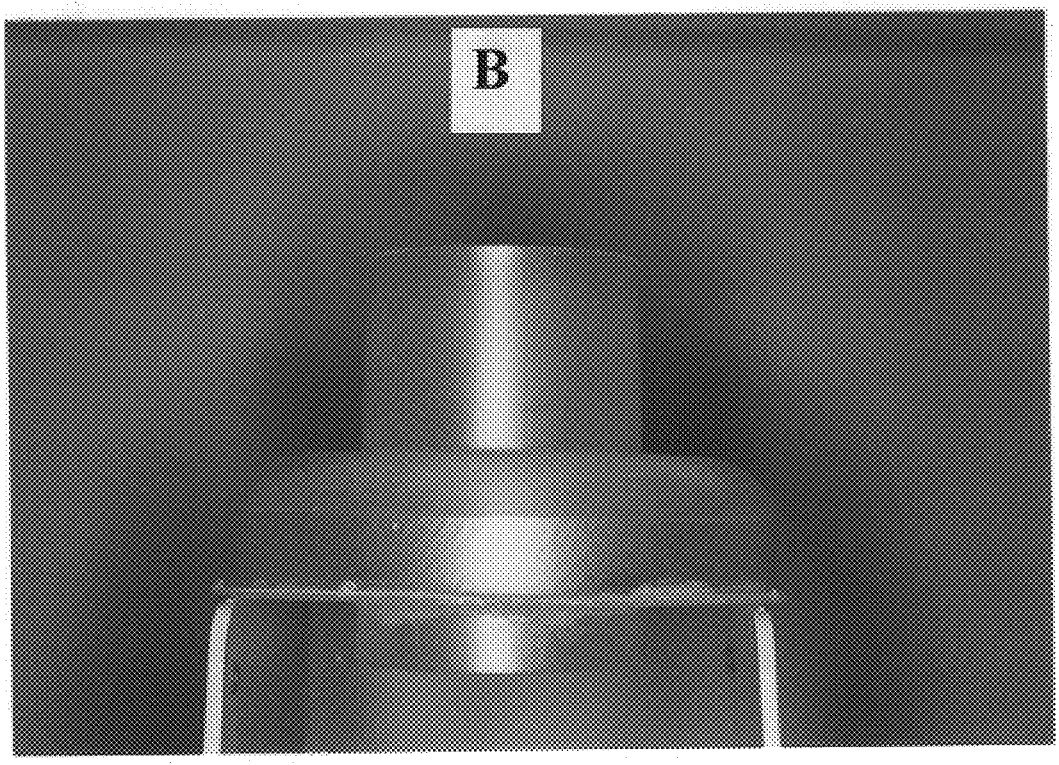
Figure 49:
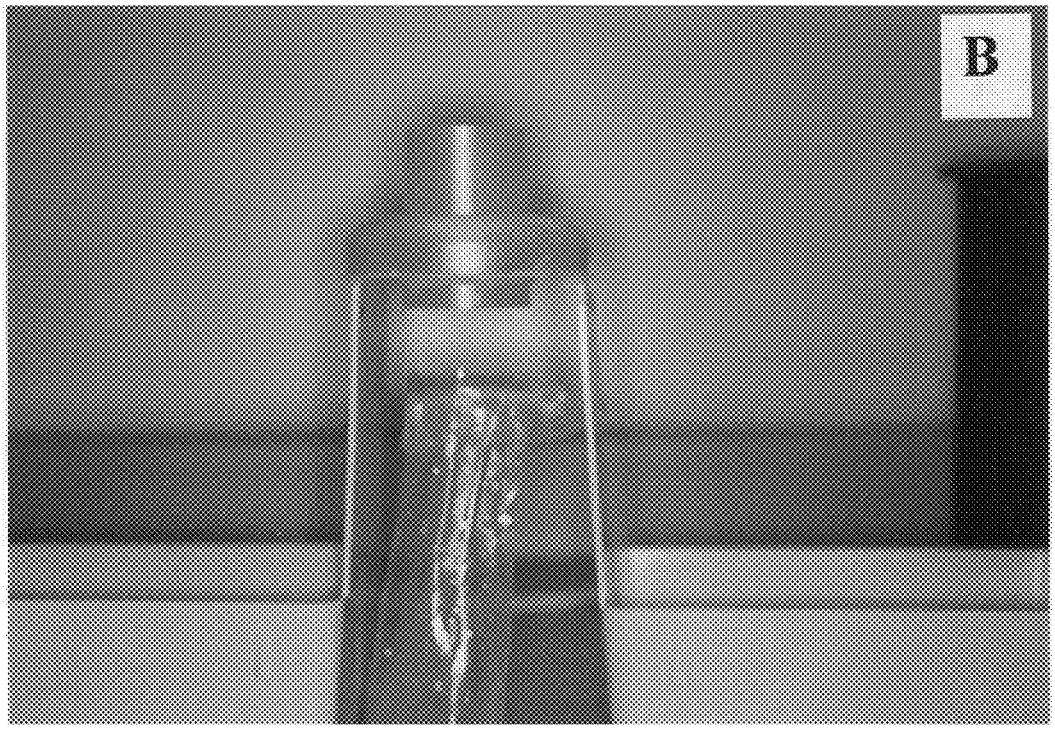
Figure 50:
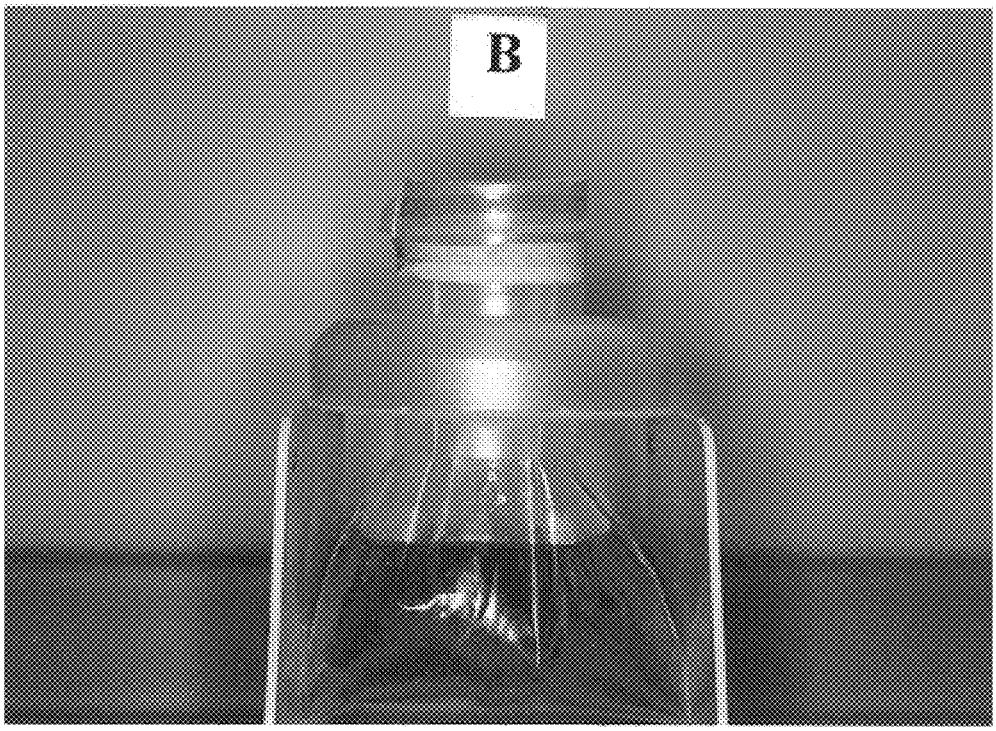
Figure 51:
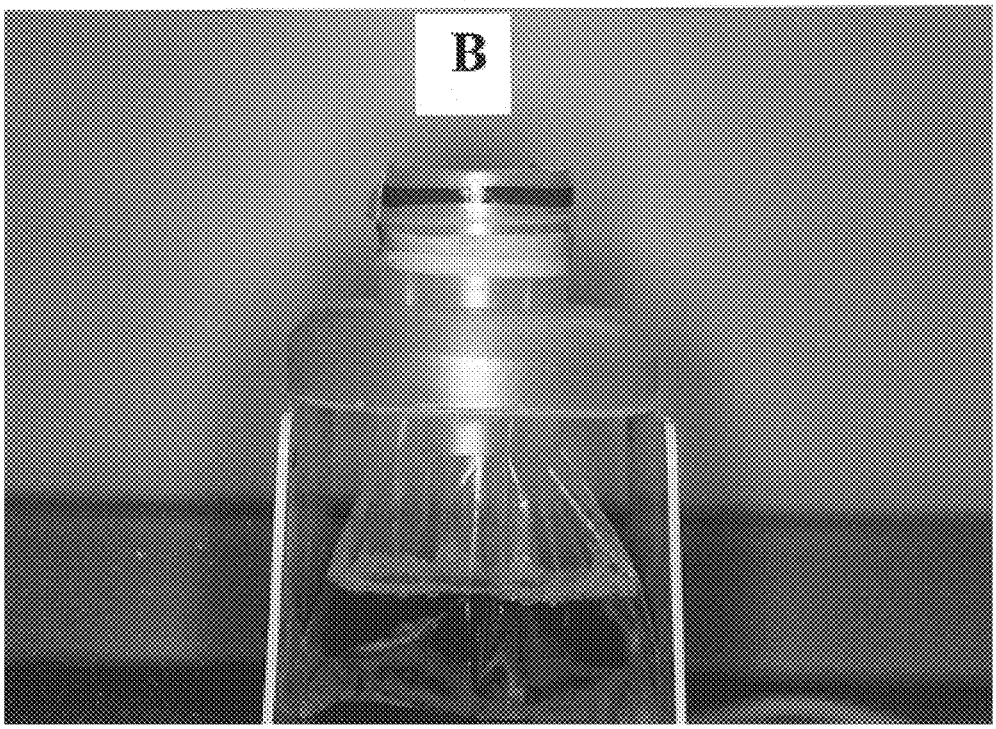
Figure 52:
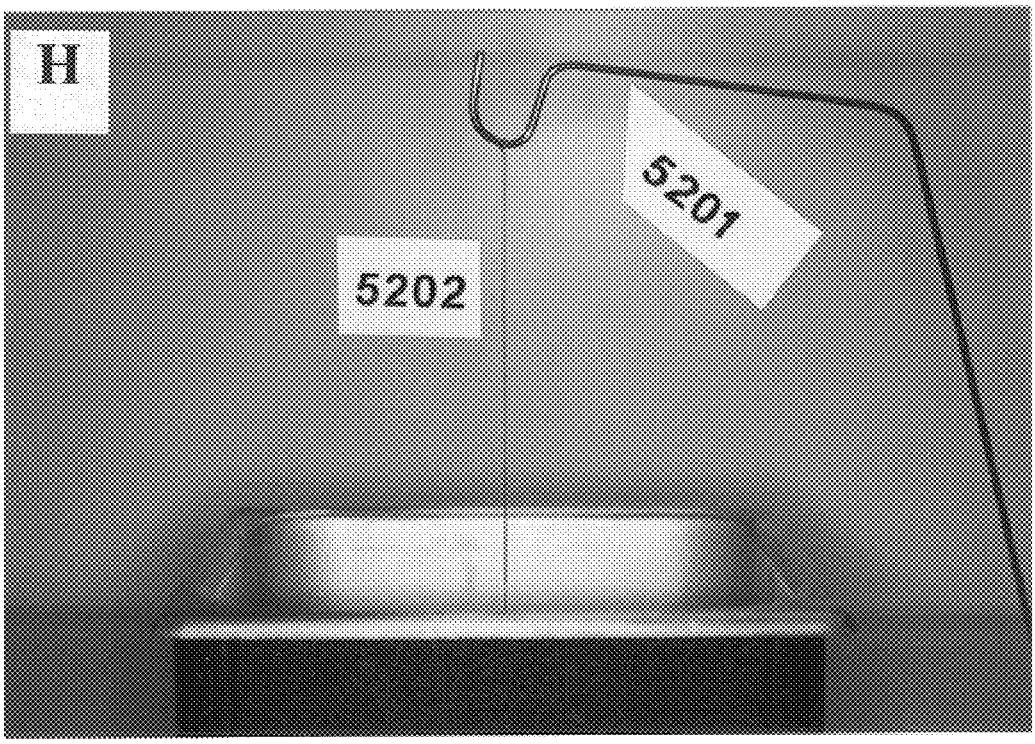
Figure 53:
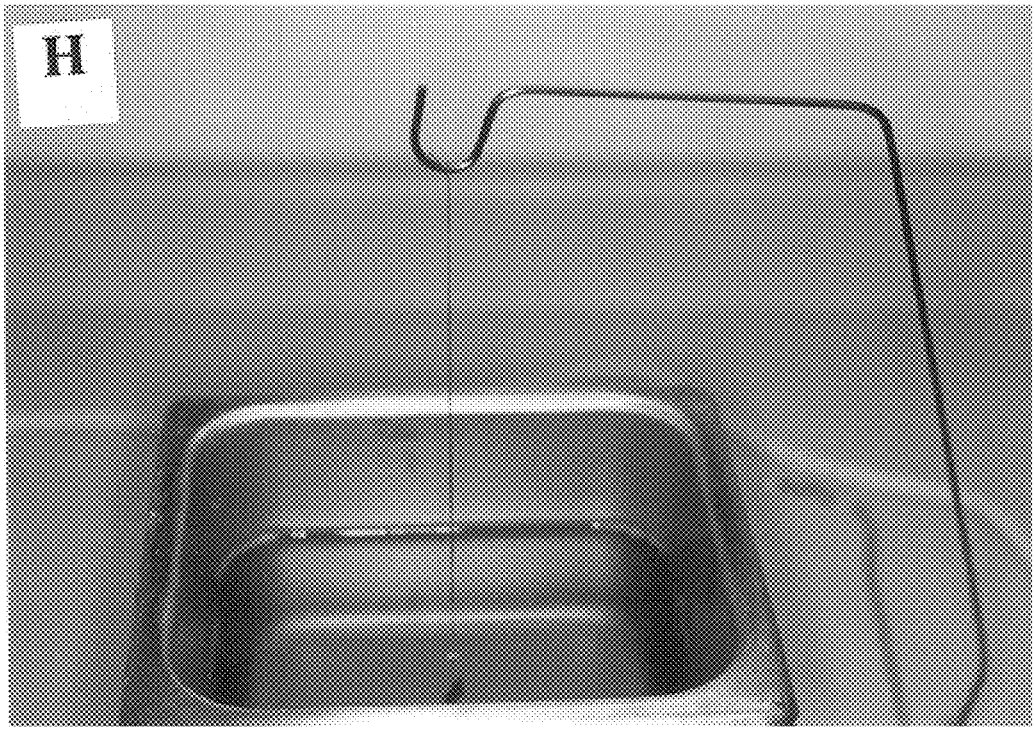
Figure 54:
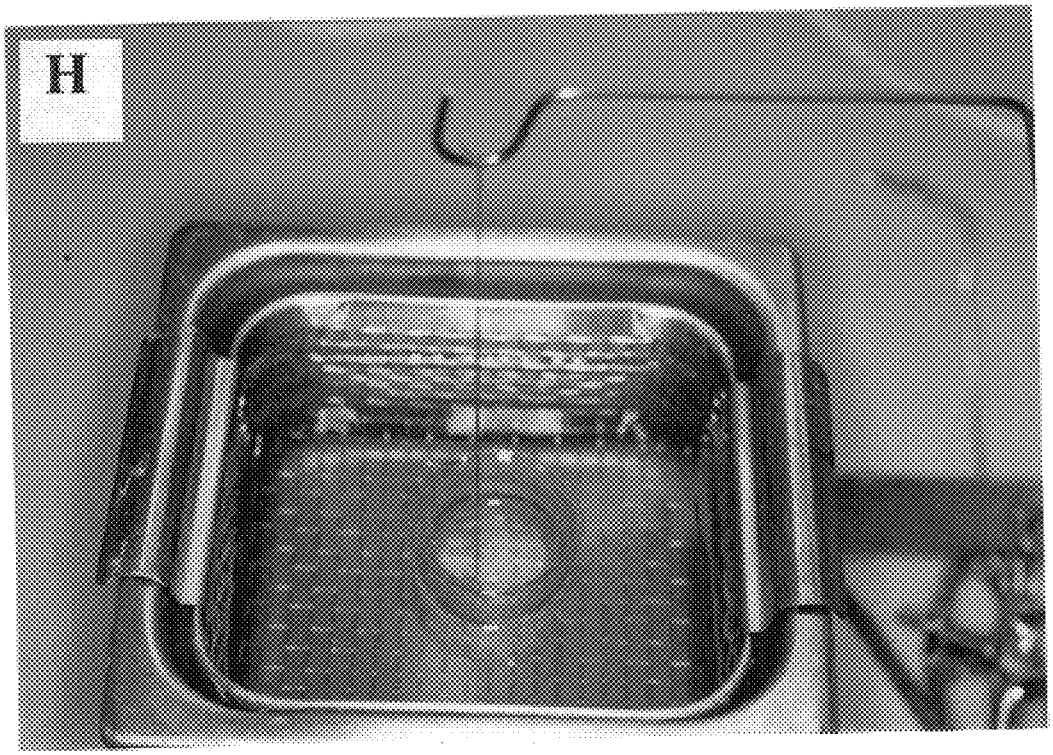
Figure 55:
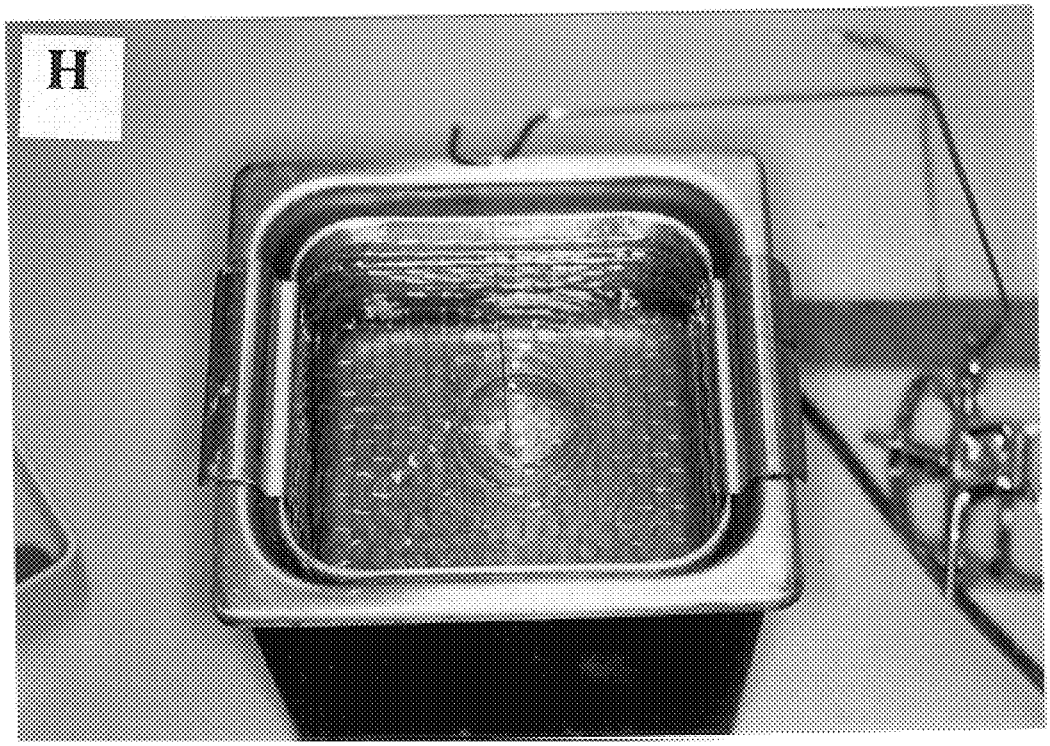
Figure 56:
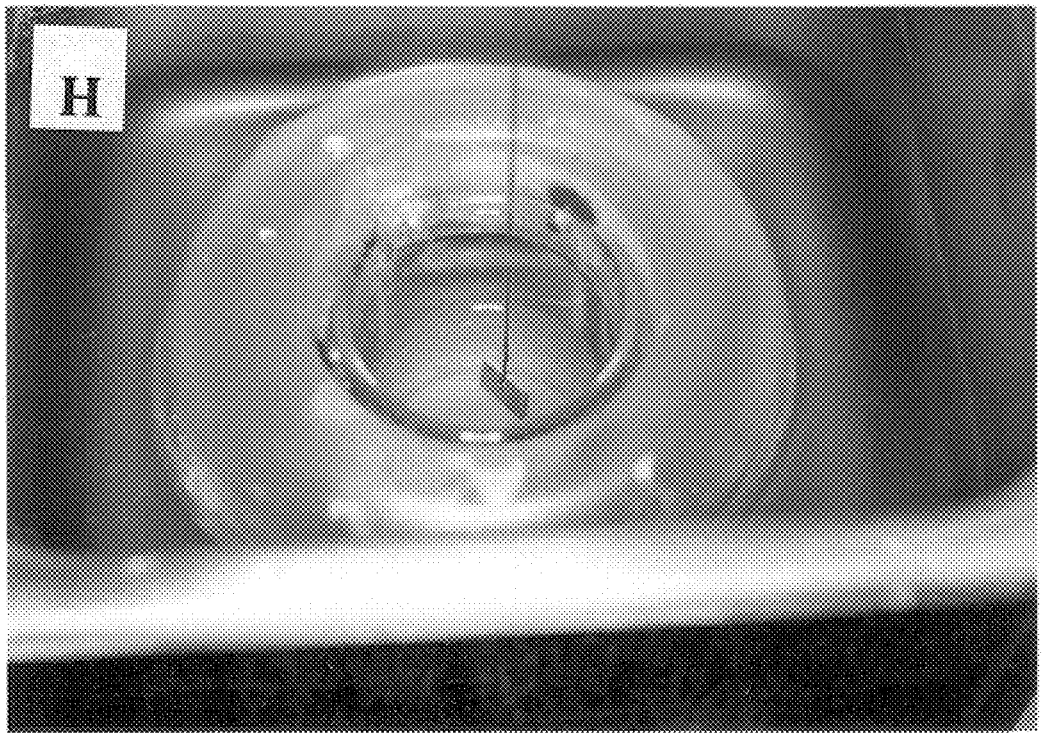
Figure 57:
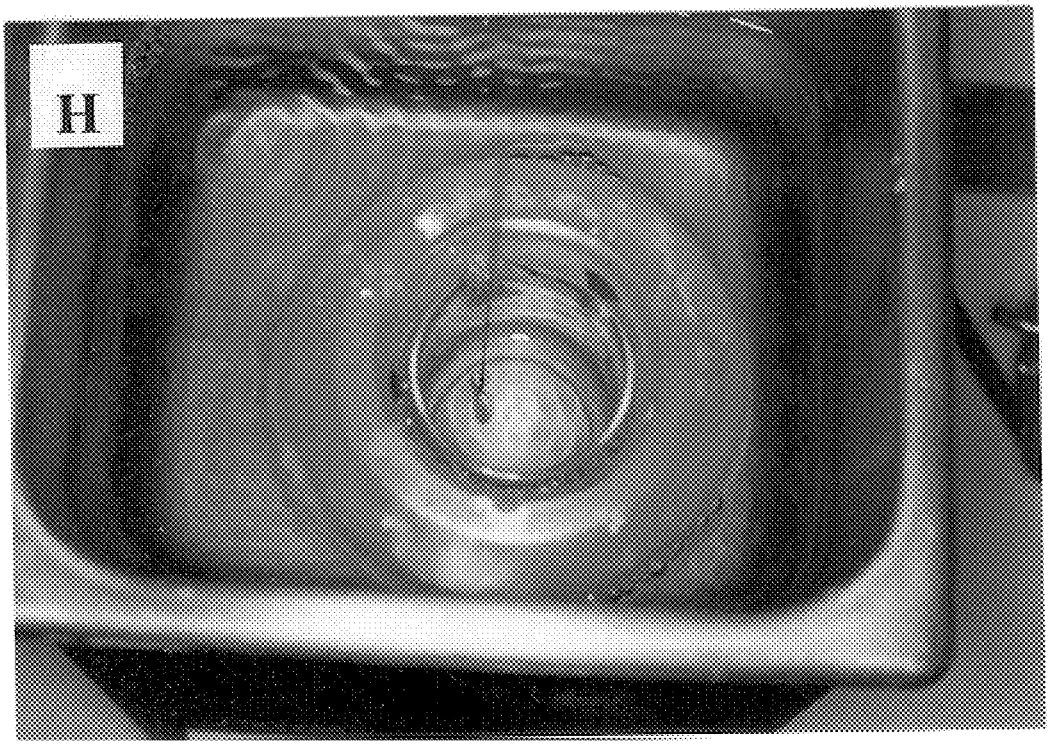
Figure 58:
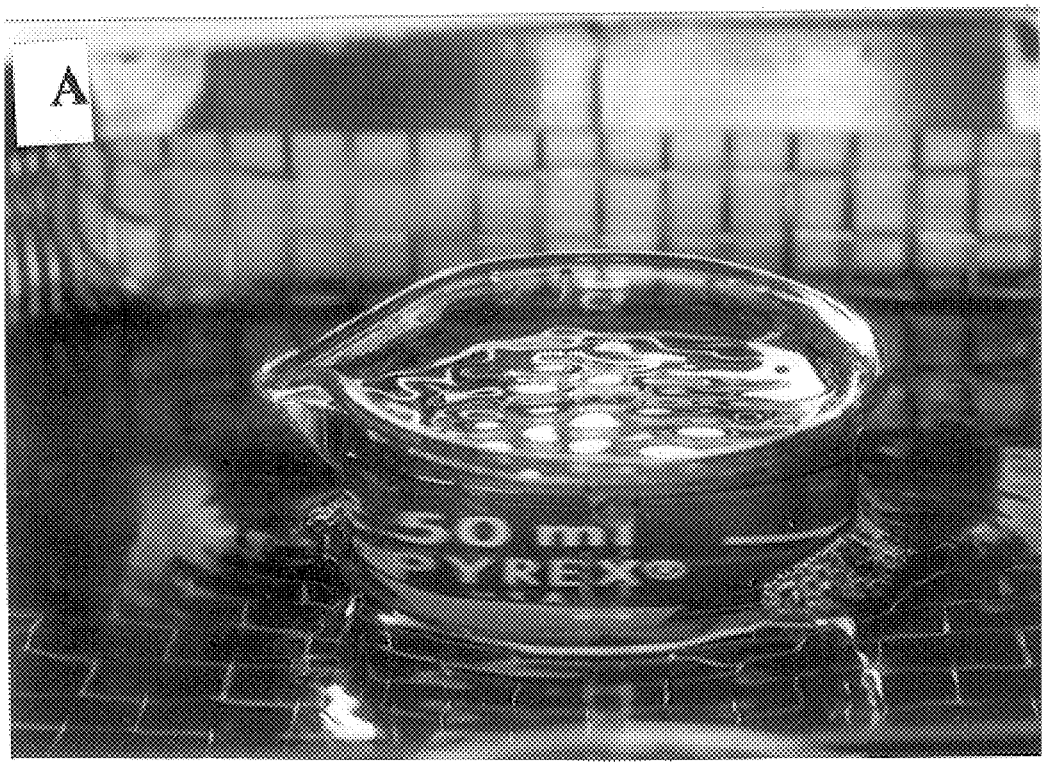
Figure 59:
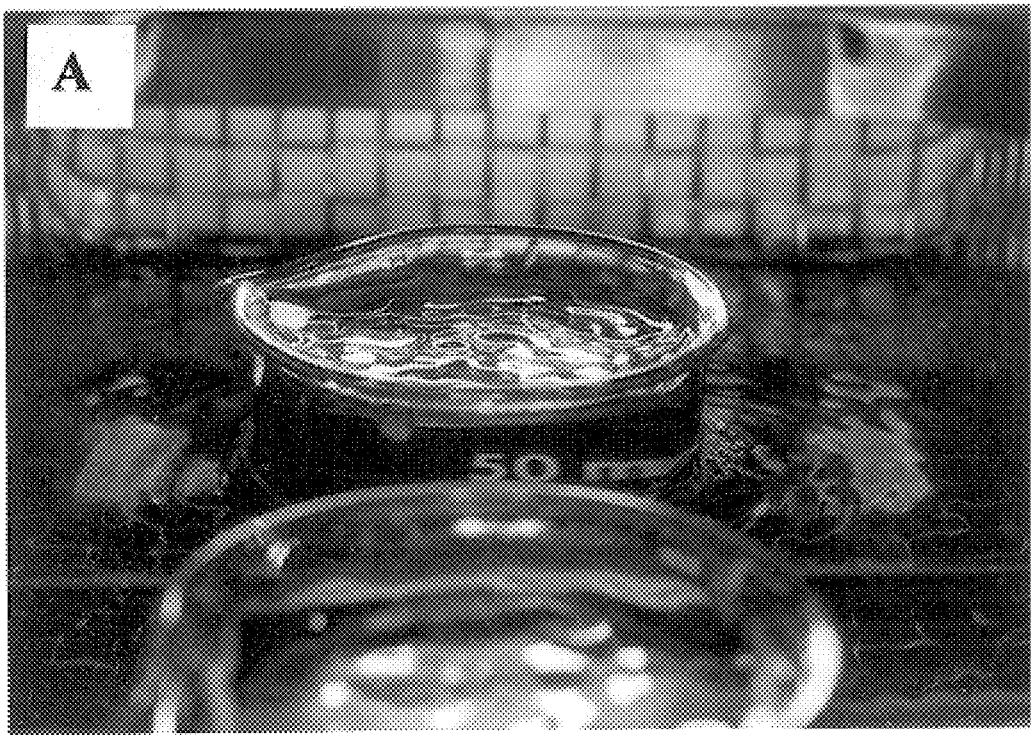
Figure 60:
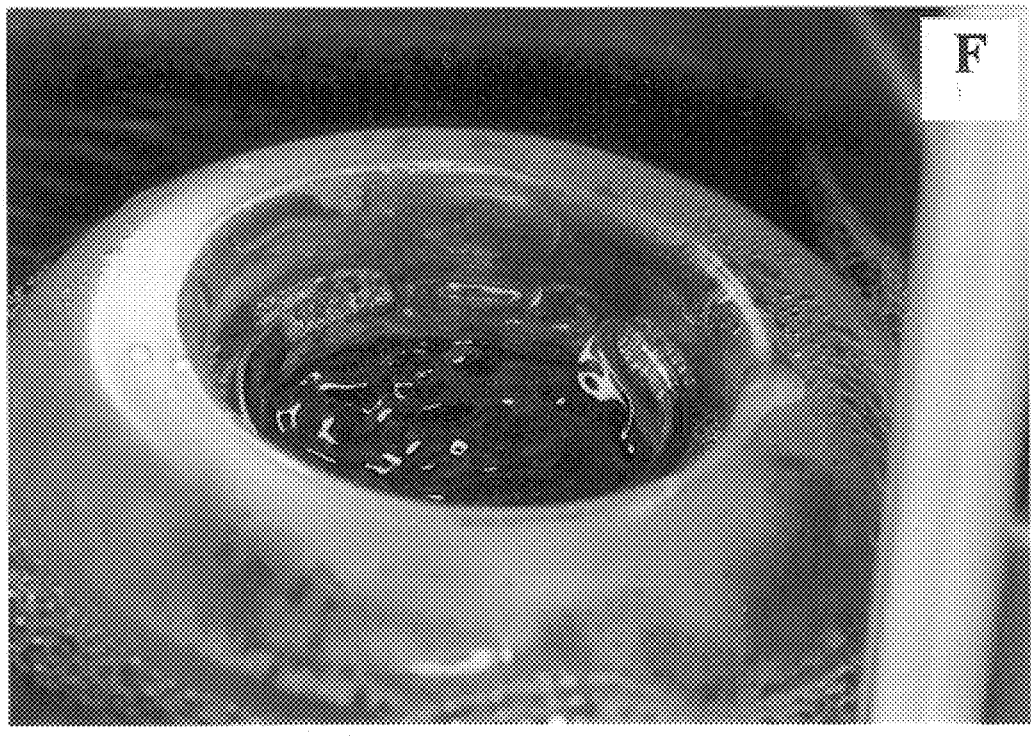
Figure 61:
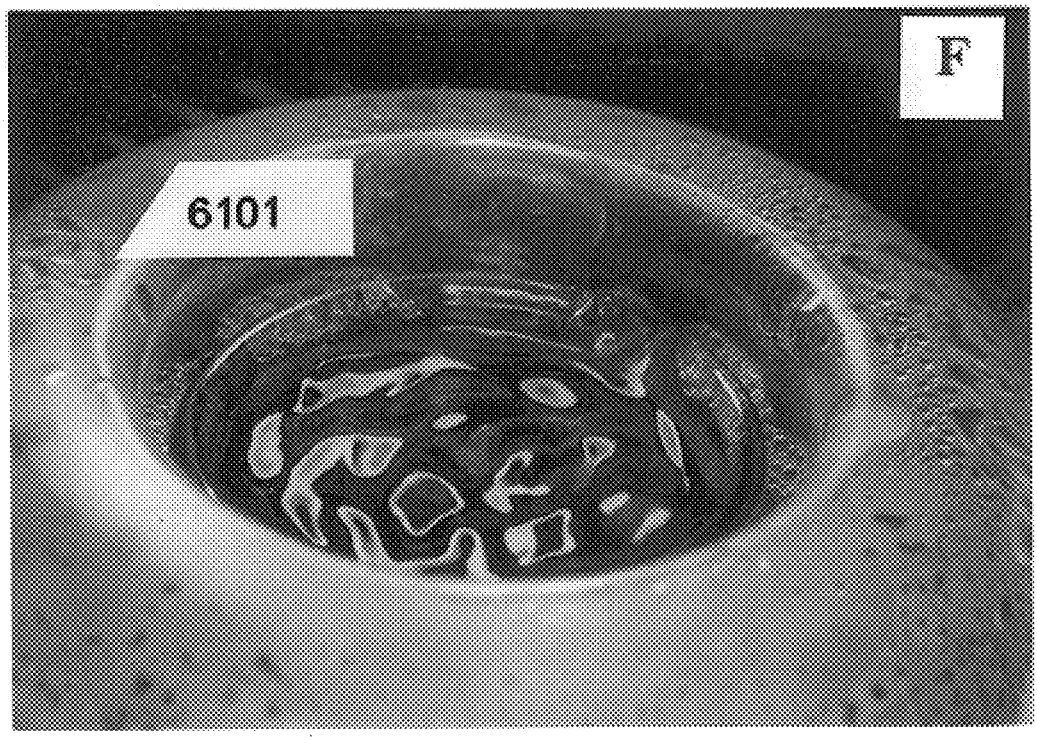
Figure 62:
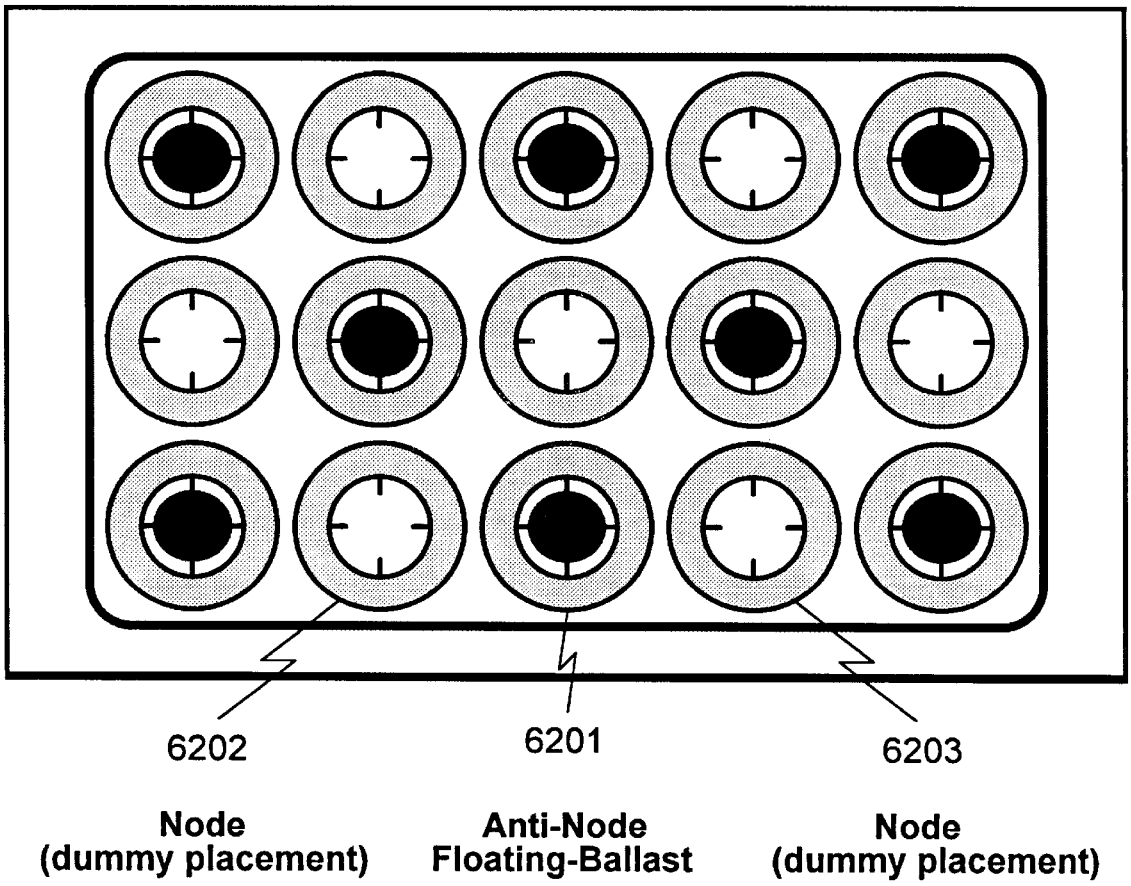
Figure 63:
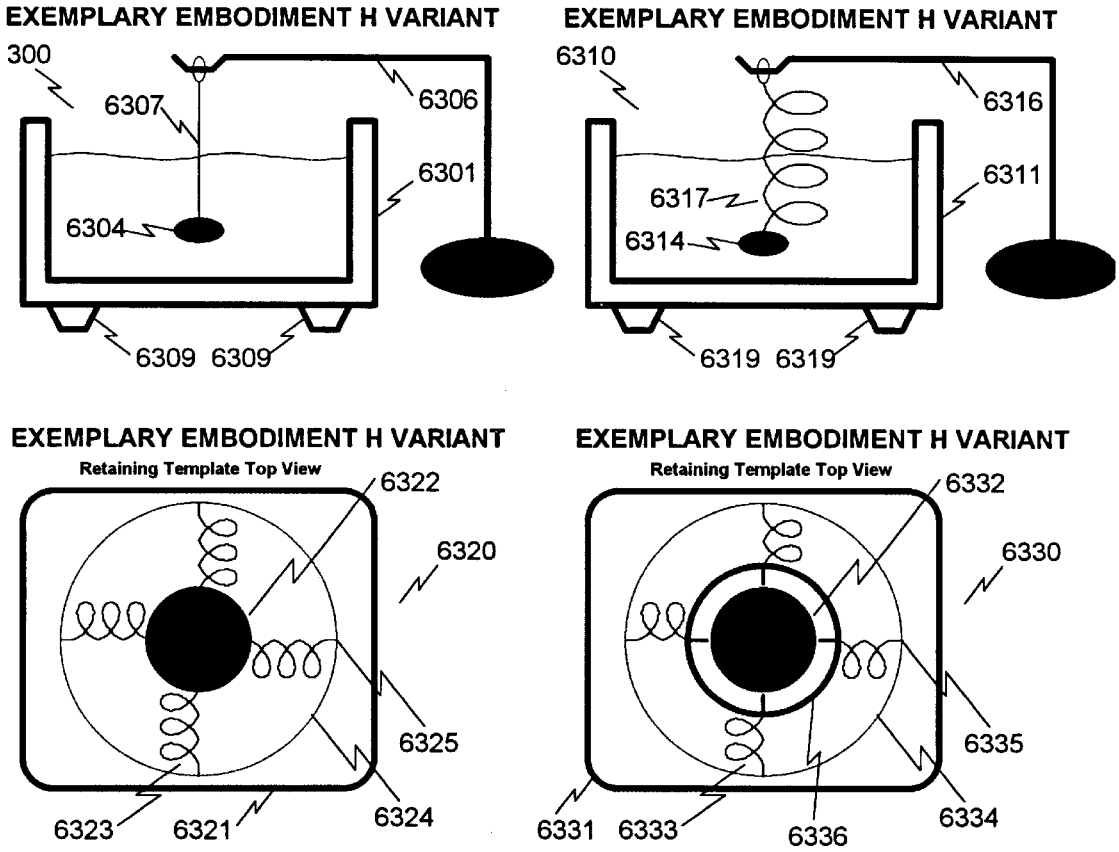

Prior art ultrasonic cleaning test results are designated with the identifier "A";

Floating-ballast embodiments and their associated experimental ultrasonic cleaning test results are designated with the identifier "F";

Pontoon-ballast embodiments and their associated experimental ultrasonic cleaning test results are designated with the identifier "P";

Bag-ballast embodiments and their associated experimental ultrasonic cleaning test results are designated with the identifier "B";

Hanging-ballast embodiments and their associated experimental ultrasonic cleaning test results are designated with the identifier "H";

FIG. 1 is a prior art illustration of a conventional ultrasonic cleaning system described in U.S. Pat. No. 3,937,236 by Robert R. Runnells;

FIG. 2 is a prior art illustration of a conventional containment vessel and associated support structure used in the ultrasonic cleaning system described in U.S. Pat. No. 3,937,236 by Robert R. Runnells;

FIG. 3 illustrates a functional schematic diagram prior art implementations of ultrasonic cleaning contrasted with four of the exemplary embodiments of the present invention;

FIG. 4 illustrates graphs of typical 1-D Bessel function wavefront of the first kind and higher order harmonics of a typical 1-D Bessel function wavefront of the first kind;

FIG. 5 illustrates graphs of typical 3-D Bessel function wavefront of the first kind for root solutions 2 and 3;

FIG. 6 illustrates graphs of typical 3-D Bessel function wavefront of the first kind for root solutions 4 and 5;

FIG. 7 illustrates graphs of typical 3-D Bessel function wavefront of the first kind for root solutions 6 and 7;

FIG. 8 illustrates typical standing wave patterns present in an activated ultrasonic bath which contains only bath fluid as used in prior art ultrasonic cleaning configurations (A);

FIG. 9 illustrates typical standing wave patterns present in an activated ultrasonic bath which incorporates one variation of a hanging-ballast embodiment (H) of the present invention;

FIG. 10 illustrates a view of a conventional ultrasonic cleaning system utilizing a wire basket to contain a glass beaker containment vessel;

FIG. 11 illustrates an expanded view of the wire basket and glass beaker containment vessel of FIG. 10;

FIG. 12 illustrates a conventional ultrasonic bath utilizing a cover containment support structure;

FIG. 13 illustrates the conventional ultrasonic bath cover containment support structure of FIG. 12, in which a glass beaker containment vessel is supported and constrained via the use of a rubber containment band;

FIG. 14 illustrates a top view of one potential floating-ballast embodiment of the present invention;

FIG. 15 illustrates a side view of one potential floating-ballast embodiment of the present invention as illustrated in FIG. 14;

FIG. 16 illustrates a top view of one potential floating-ballast embodiment of the present invention in which a glass beaker is used as the containment vessel;

FIG. 17 illustrates a side view of one potential floating-ballast embodiment of the present invention as illustrated in FIG. 16 in which a glass beaker is used as the containment vessel;

FIG. 18 illustrates a side view of one potential floating-ballast embodiment of the present invention in which the containment vessel is a glass beaker;

FIG. 19 illustrates placement of the invention embodiment illustrated in FIG. 18 in an ultrasonic bath, and shows how the containment vessel is free to spin in the ultrasonic bath fluid;

FIG. 20 illustrates how the invention embodiment illustrated in FIG. 19 can move throughout the ultrasonic bath fluid without the need for external agitating means;

FIG. 21 illustrates a close-up of the invention embodiment illustrated in FIG. 20, showing how the glass beaker containment vessel is supported, yet not constrained, by the floating-ballast means;

FIG. 22 illustrates a top view of one potential pontoon-ballast embodiment of the present invention;

FIG. 23 illustrates a side view of one potential pontoon-ballast embodiment of the present invention as illustrated in FIG. 22;

FIG. 24 illustrates a top view of one potential pontoon-ballast embodiment of the present invention as placed in an ultrasonic bath;;

FIG. 25 illustrates an expanded top view of one potential pontoon-ballast embodiment of the present invention as illustrated in FIG. 24;

FIG. 26 illustrates a top view of one potential bag-ballast embodiment of the present invention;

FIG. 27 illustrates a side view of one potential bag-ballast embodiment of the present invention as illustrated in FIG. 26;

FIG. 28 illustrates a top view of one potential bag-ballast embodiment of the present invention as placed in an ultrasonic bath;

FIG. 29 illustrates the relative surface area requirements of a pontoon-ballast as compared to that of the bag-ballast configuration of FIG. 28;

FIG. 30 illustrates the results of an aluminum foil cavitation test performed using a conventional ultrasonic basket/beaker combination;

FIG. 31 illustrates the results of an aluminum foil cavitation test performed using a floating-ballast embodiment of the present invention;

FIG. 32 illustrates the results of an aluminum foil cavitation test performed using a pontoon-ballast embodiment of the present invention;

FIG. 33 illustrates the results of an aluminum foil cavitation test performed using a bag-ballast embodiment of the present invention and the results of an aluminum foil cavitation test performed using a bag-ballast embodiment of the present invention in which the cleaning fluid has been degassed;

FIG. 34 illustrates the results of an aluminum foil cavitation test performed using a conventional ultrasonic beaker/basket (A), a floating-ballast embodiment of the present invention (F), and a bag-ballast embodiment of the present invention (B);

FIG. 35 illustrates the results of an aluminum foil cavitation test performed using a conventional ultrasonic beaker/basket (A), a floating-ballast embodiment of the present invention (F), and a bag-ballast embodiment of the present invention (B) with old and new cleaning fluid;

FIG. 36 illustrates two abraded gold ingots which have been prepared for use in an ultrasonic cleaning comparison test;

FIG. 37 illustrates a comparison of the results of an abraded gold ingots ultrasonic cleaning test in which a conventional ultrasonic beaker/basket combination (A) is benchmarked against a floating-ballast embodiment of the present invention (F);

FIG. 38 illustrates a comparison of the results of an aluminum foil ultrasonic cleaning test in which a conventional ultrasonic beaker/basket combination (A) is benchmarked against a floating-ballast embodiment of the present invention (F);

FIG. 39 illustrates a comparison of the results of a heavily abraded gold ingot ultrasonic cleaning test in which a conventional ultrasonic beaker/basket combination (A) is benchmarked against a floating-ballast embodiment of the present invention (F);

FIG. 40 illustrates the results of an abraded gold ingot ultrasonic cleaning test in which a conventional ultrasonic beaker/basket combination (A) is tested for cleaning efficacy;

FIG. 41 illustrates the results of an abraded gold ingot ultrasonic cleaning test in which a floating-ballast embodiment of the present invention (F) is tested for cleaning efficacy;

FIG. 42 illustrates a comparison of the results of a heavily abraded gold ingot ultrasonic cleaning test in which a conventional ultrasonic beaker/basket combination (A) is benchmarked against a pontoon-ballast embodiment of the present invention (P);

FIG. 43 illustrates the results of an abraded gold ingot ultrasonic cleaning test in which a pontoon-ballast embodiment of the present invention (P) is tested for cleaning efficacy;

FIG. 44 illustrates a comparison of the results of a heavily abraded gold ingot ultrasonic cleaning test in which a conventional ultrasonic beaker/basket combination (A) is benchmarked against a bag-ballast embodiment of the present invention (B);

FIG. 45 illustrates the results of an abraded gold ingot ultrasonic cleaning test in which a bag-ballast embodiment of the present invention (B) is tested for cleaning efficacy;

FIG. 46 illustrates a side view of a variation of the bag-ballast invention embodiment (B);

FIG. 47 illustrates a top view of a variation of the bag-ballast invention embodiment (B);

FIG. 48 illustrates a side view of a variation of the bag-ballast invention embodiment (B) positioned for insertion of a bag containment vessel;

FIG. 49 illustrates a side view of a variation of the bag-ballast invention embodiment (B) in which a bag containment vessel is configured for attachment to the ballast;

FIG. 50 illustrates a side view of a color coded variation of the bag-ballast invention embodiment (B);

FIG. 51 illustrates a side view of a color coded variation of the bag-ballast invention embodiment (B);

FIG. 52 illustrates a side view of a possible construction of a hanging-ballast invention embodiment (H);

FIG. 53 illustrates a top view of a possible construction of a hanging-ballast invention embodiment (H);

FIG. 54 illustrates top view of a possible construction of a hanging-ballast invention embodiment (H) as applied to the prior art;

FIG. 55 illustrates top view of a possible construction of a hanging-ballast invention embodiment (H) as applied to the prior art with the ultrasonic cleaning system activated;

FIG. 56 illustrates top view of a possible construction of a hanging-ballast invention embodiment (H) as applied to a floating-ballast invention embodiment (F);

FIG. 57 illustrates top view of a possible construction of a hanging-ballast invention embodiment (H) as applied to a floating-ballast invention embodiment (F) with the ultrasonic cleaning system activated;

FIG. 58 illustrates a view of containment vessel wavefronts in a beaker/basket embodiment of the prior art;

FIG. 59 illustrates another view of containment vessel wavefronts in a beaker/basket embodiment of the prior art;

FIG. 60 illustrates a view of containment vessel excited wavefronts in a floating-ballast embodiment of the present invention;

FIG. 61 illustrates another view of containment vessel wavefronts in a floating-ballast embodiment of the present invention, and shows cleaning fluid ejectant caused by violent excitation of the cleaning fluid;

FIG. 62 illustrates an exemplary embodiment of a number of floating-ballast/containment vessels as well as "dummy" floating-ballasts to permit positioning of cleaning targets over the ultrasonic anti-nodes within a typical ultrasonic cleaning tank;

FIG. 63 illustrates several exemplary embodiments illustrating some of the teachings of the hanging-ballast exemplary variants of the present invention.

DESCRIPTION OF THE PRESENTLY PREFERRED EXEMPLARY EMBODIMENTS

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

Overview and Contrast to Prior Art

Prior Art Configurations

Referencing FIG. 3, the prior art ultrasonic cleaning means can be categorized into two typical systems: containment vessel cover lids (310) and beaker/basket systems (320).

Prior Art Containment Vessel Cover Lid Systems

Containment vessel cover lid systems (310) use a metallic lid to cover (312) to cover the ultrasonic bath (311), which supports a beaker or other containment vessel (313) that contains the cleaning target (314).

The major loss component associated with this configuration is the mechanical contact (319) which is made between the cleaning target (314), containment vessel (313), retaining lid cover (312), and the ultrasonic bath (311). This mechanical connection tends to dampen ultrasonic harmonics within the containment vessel (313) and at the surface of the cleaning target (314).

Prior Art Beaker/Basket Systems

Beaker/basket systems (320) use a metallic basket (322) placed in the ultrasonic bath (321), which supports a beaker or other containment vessel (323) that contains the cleaning target (324).

The major loss component associated with this configuration is the mechanical contact (329) which is made between the cleaning target (324), containment vessel (323), metal basket (322) and the ultrasonic bath (321). This mechanical connection tends to dampen ultrasonic harmonics within the containment vessel (323) and at the surface of the cleaning target (324).

It should be noted here that most manufacturers do not suggest that the beaker/basket configuration come in contact with the bottom of the ultrasonic bath. This is to prevent cavitation burns from damaging the beaker and/or cleaning target. This warning is often ignored in practice, but remains a limitation of the teachings of the prior art.

Present Invention Floating-Ballast Embodiment

The floating-ballast embodiment (F) (330) of the present invention suspends the containment device (333) that contains the cleaning target (334) above the ultrasonic tank (331) via a floating ballast (332). This configuration permits full application of ultrasonic energy present in the tank to the containment vessel (333) and subsequently to the cleaning target (334).

Present Invention Pontoon-Ballast Embodiment

The pontoon-ballast embodiment (P) (340) of the present invention is similar in construction to the floating-ballast (330) configuration, but augments the floating ballast with one or more additional pontoons (345) which collect ultrasonic energy which is eventually applied to the cleaning target and/or containment vessel.

Present Invention Bag-Ballast Embodiment

The bag-ballast embodiment (B) (350) of the present invention is similar in construction to the floating-ballast (330) configuration, but uses a bag containment vessel (354) as compared to the more rigid containment structure of the floating ballast configuration. This permits easy identification of cleaning solutions and permits rapid and safe disposal of contaminated cleaning fluids.

Present Invention Hanging-Ballast Embodiment

The hanging-ballast embodiment (H) (360) of the present invention is an embodiment of the invention which may be applied to any of the other invention embodiments as well as to the prior art configurations (310) and (320). The gist of this invention embodiment is a reduction of the effective motional mass contained within the ultrasonic tank by suspending the cleaning target (364) within the cleaning fluid (or bath fluid) with an external support structure (366) which may include an optional support wire or the like (367). This prevents the mass of the cleaning target from dampening harmonics within the ultrasonic tank as would occur if it were allowed to touch the side of the ultrasonic tank (320) or come in contact with the containment vessel of configurations (310, 330, 340, 350).

Note that the use of rubber support feet on most commercial ultrasonic systems (319, 329) and some embodiments of the present invention (339, 349, 359, 369) permits the bath and its contents to move freely without rigid mechanical contact with the hanging-ballast support (366, 367) or the cleaning target (364). While these rubber support feet are useful in improving the efficacy of this particular embodiment, it is believed that the main increase in efficiency is the fact that the hanging-ballast structure permits a reduction of the in-phase ultrasonic excitation surrounding the cleaning target. By promoting the out-of-phase ultrasonic excitation modes, cavitation and therefore cleaning is increased. In contrast, prior art configurations by using a mechanical linkage between the ultrasonic bath and the cleaning target, tend to promote some in-phase movement of the cleaning target, which reduces cavitation and cleaning efficiency.

Method Embodiment Overview

The preferred method/process embodiments of the present invention include at their most fundamental level (a) supporting a cleaning target;

(b) generation and application of ultrasonic energy to the cleaning target; and (c) mechanically isolating the cleaning target from the ultrasonic energy source.

Note that variants of this basic disclosed method may include the support of a containment vessel which in turn is resonated to induce increased cavitation of the cleaning target. Such would be the case in the floating-ballast (F) (FIGS. 14, 15, 16, 17, 18, 19, 20, 21) and pontoon-ballast (P) (FIGS. 22, 23, 24, 25, 29) embodiments of the invention, as well as other variants of the invention described herein.

Waveguide Resonances

Note that one specific and useful embodiment of the present invention system and method not depicted in the schematics of FIG. 3 includes a variant in which the containment vessel has no bottom. While conventional prior art makes use of beakers and the like to provide physical containment of the cleaning target, the present invention method makes use of the containment vessel in a new way.

Since the presently disclosed method removes the mechanical connections between the source of ultrasonic energy and the containment vessel, the containment vessel and its contents is free to resonate at whatever mechanical resonance modes that are natural to its primary construction properties (cylindrical resonance modes, rectangular resonance modes, etc.). Thus, the present invention by design allows the containment vessel/cleaning target/cleaning fluid combination to be excited at motional frequencies not possible with the prior art. Since any cylindrical, tubular, rectangular, or other geometry waveguide can be constructed to generate resonance modes of a different character than a conventional beaker, it is possible to build a containment vessel with no bottom in which the Embodiment H of FIG. 3 is used to suspend the cleaning target within the waveguide. The resonance modes within the waveguide will be excited by the ultrasonic energy, and effective cleaning can be accomplished without any mechanical connection to the sides of the ultrasonic bath.

From the foregoing, it can be deduced that the present invention teaches that any resonating waveguide structure may be used to surround the cleaning target and localize the ultrasonic cavitation energy surrounding the cleaning target to affect greater cleaning efficiency. In fact, these resonating structures could be nested to increase this effect, consistent with minimizing overall system losses in the ultrasonic bath. Thus, the use of one or more high-Q resonating waveguide structures surrounding a given cleaning target could in some embodiments produce much greater cavitation than possible using conventional ultrasonic cleaning tanks and the like. More information on exemplary waveguide structures and Bessel functions suitable for this application may be gleaned from examples in the electrical arts. See Roger F. Harrington, TIME-HARMONIC ELECTROMAGNETIC FIELDS (ISBN 07-026745-6, 1961).

As an adjunct to the preceding discussion on waveguide resonances, it should be noted in general that the presence of cleaning fluid and/or cleaning targets within the waveguide alters the resonance characteristics of the entire system. However, it is possible to judiciously select the waveguide and/or cleaning fluid characteristics to obtain optimal ultrasonic resonance characteristics using the teachings of the present invention. For example, the physical characteristics of the waveguide can be changed to match that of the cleaning fluid to accentuate resonant modes in the entire system. In cases where the waveguide is implemented by a containment vessel, it may also be possible to change the cleaning fluid level to affect a change in the resonance characteristics of the cleaning fluid/containment vessel combination, thus permitting optimal resonance to promote maximum cavitation at the cleaning target. Of course, other combinations are possible to optimally modulate the ultrasonic resonance modes present at the cleaning target.

System Embodiment Overview

The preferred system embodiments of the present invention include at their most fundamental level (a) an ultrasonic excitation means;

(b) a cleaning fluid means; and (c) a means for mechanically isolating the cleaning target from the means which generates the ultrasonic excitation.

FIG. 1 is illustrative of what the present invention teaches away from. In this figure, the containment means (107, 108) is mechanically connected to the ultrasonic generator (101) via the support cover (104) and/or the support basket (103).

In contrast, the present invention as exemplified by the embodiments of FIG. 3 (F,P,B,H), FIGS. 14–30 and FIGS. 46–57 floats the containment vessel within the ultrasonic bath fluid and therefore provides a mechanical isolation of both the containment vessel and the cleaning target from the sidewalls of the ultrasonic bath. This permits ultrasonic energy radiated by the ultrasonic tub to fully cavitate the cleaning fluid surrounding the cleaning target. As described elsewhere, this mechanical isolation may take a wide variety of forms, some of which support the cleaning target via means external to the ultrasonic bath, as exemplified by the configuration illustrated in FIGS. 52–56.

It should be noted that as illustrated in FIG. 1 and FIG. 2, the prior art teaches in general that the ultrasonic tank should support the containment vessel and/or the cleaning fluid, and that the cleaning target should therefore be placed within the containment vessel which is supported by the sides of the ultrasonic bath. This conventional prior art configuration has as one objective the prevention of cavitation burns which may occur on containment vessels which are supported by the bottom of the ultrasonic bath, although many implementations of the Runnells apparatus pay little attention to this problem and place the cleaning target and/or containment vessel on the bottom of the ultrasonic tank.

The present invention teaches away from the prior art approach in general and suggests that more effective cleaning can be obtained by supporting the containment vessel and/or cleaning target by some means which mechanically isolates these items from the ultrasonic tank. This isolation permits the full force of the ultrasonic energy to impinge the surface of the cleaning target and thus generate more surface cavitation which implies greater cleaning. Additionally, this approach taken by the present invention reduces in-phase movement of the cleaning target with respect to the ultrasonic source, thus minimizing the ultrasonic losses associated with this phenomenon.

Apparatus Embodiment Overview

The preferred apparatus embodiments of the present invention include at their most fundamental level (a) a cleaning target suspension support;

(b) a means for mechanically isolating the cleaning target from the means which generates the ultrasonic excitation.

where the cleaning target suspension is typically a containment vessel but may be implemented using a wide variety of other means, such as the hanging-ballast exemplary embodiment illustrated in FIGS. 52–56.

The preferred apparatus invention embodiments may be used in a system context as described above in situations where it is desirable to increase the cleaning efficacy of an existing ultrasonic cleaning system. Of considerable importance to many industrial ultrasonic cleaning applications is the ability to increase cleaning efficiency while still using existing ultrasonic cleaning hardware. The present invention permits this goal to be achieved at minimal cost, and effects an energy savings and an improvement in environmental quality as side benefits to the attainment of this efficiency goal.

It should be noted that embodiments of the present invention have generally been constructed using circular and/or cylindrical geometries. Nothing in this disclosure should be construed to limit the construction of invention embodiments to these structures. A wide variety of geometries are possible, including polygonal, square, or irregular forms. All of these forms and others well known in the mathematical arts are possible and capable of implementing the teachings of the present invention.

In addition, the present invention embodiments have been implemented using cleaning target suspension supports which in some cases consist of containment vessels and ballast means. Nothing in this teaching is designed to so limit the construction of this particular embodiment of the invention. It is therefore possible to construct the functional equivalent of the cleaning target suspension support using one or more components, as either a fully integrated unit or as a unit consisting of a number of individual parts. As mentioned in the previous paragraph, any of these individual components can have any suitable shape which conforms to the requirements of the ultrasonic cleaning application, and are not necessarily limited to circular/cylindrical geometries.

Theoretical Foundation

Damped Harmonic Oscillator

The equation of motion for a damped harmonic mechanical oscillator having a non-zero frictional component is given by the relation:

$$\ddot{x} + \frac{b}{m}\dot{x} + \frac{k}{m}x = 0 \tag{4}$$

where x≡displacement vector m≡mass of the object being moved b≡friction coefficient $b/m \equiv 2h$=damping factor $k/m \equiv \omega_0^2$=oscillation frequency squared See A. A. Andronov, A. A. Vitt, and S. E. Khaikin, THEORY OF OSCILLATORS, at 15–19 (ISBN 0-486-65508-3, Dover, 1987).

The damping factor 2h represents loss in oscillation system due to mechanical friction. In the context of ultrasonic cleaning, this friction takes the form of heat conduction, viscous friction, elastic hysteresis, and scattering within the containment vessel and fluid friction losses in the cleaning fluid and surrounding bath fluid. All these losses contribute to internal damping of ultrasonic energy within the ultrasonic bath and its contents. See Theodore Hueter & Richard Bolt, SONICS at 371 (LOC # 55-6388, John Wiley & Sons, 1955).

Bessel Function Excitation Modes

Within the context of ultrasonic cleaning, the harmonic waves generated within the bath fluid and cleaning fluid have a cross section corresponding to a summation of Bessel functions. As illustrated in FIG. 4, these waves are oscillatory in nature. Depending on which harmonic mode is excited, any given number of oscillations can be excited within the ultrasonic tank. As depicted in FIG. 4, the amplitude of the higher frequency modes is attenuated.

While FIG. 4 does provide some insight into the nature of the modes which may be excited within an ultrasonic tank, a more instructive view of this typical activity is illustrated in FIGS. 5–7, which depict Bessel function excitation in a circular cavity with the roots of the Bessel function meeting the boundary conditions at the edges of the container (fixed edge displacement of zero). As contrasted by the progression from FIG. 5 to FIG. 6 to FIG. 7, these diagrams indicate that as the Bessel function harmonics are increased, the turbulence throughout the enclosed cavity is dramatically increased. This increased wavefront amplitude activity translates directly into increased cleaning fluid pressure which produces increased cavitation at the cleaning target surface.

Thus, in theory, the objective of any ultrasonic cleaning system should be to increase the higher order harmonics to affect greater cleaning fluid turbulence and higher cleaning fluid pressures, thus generating greater cavitation and cleaning. However, as is often the case, it is difficult to mate theory with practice, as the wavefronts within a conventional ultrasonic bath are more complex than illustrated in FIGS. 4–7. As illustrated in FIG. 8 (A), a conventional ultrasonic bath may have one or more patterns of excitation which are highly complex and depend on the geometry of the tank as well as the specifics of the bath fluid and the ultrasonic excitation.

What is clear, however, is that whatever modes are excited in the bath should be used to the greatest advantage possible. Specifically, since the introduction of anything into the ultrasonic bath represents an energy loss mechanism, it is important to minimize this loss mechanism. FIG. 8 (H) indicates how one embodiment of the present invention achieves this objective by using an external suspension means to support a cleaning target within the ultrasonic bath. This configuration represents significantly less loss than the prior art configurations illustrated in FIG. 10 and FIG. 11.

Exemplary Embodiment—Floating-Ballast (F)

FIG. 14 shows a top view and FIG. 15 shows a side view of the floating-ballast (F) exemplary embodiment of the present invention. This particular embodiment consists of a floating ballast means (1401) in which a plethora of tongs (1402) or other support members are used to support a containment vessel. This containment vessel may take a variety of forms, but in many cases is implemented with a conventional glass beaker as illustrated in the top view of FIG. 16 and side view of FIG. 17.

Once the floating ballast and the containment vessel have been mated as illustrated in FIG. 18, the containment vessel is filled with cleaning fluid and the combination is placed within the ultrasonic bath as illustrated in FIG. 19.

As illustrated in FIG. 19 and FIG. 20, this floating ballast is free to move within the confines of the ultrasonic bath, and as such ultrasonic energy can be freely transmitted to the containment vessel and cleaning target to promote cavitation and cleaning. Also note that the position of the tongs has been rotated, indicating that the floating-ballast embodiment is free to rotate within the confines of the ultrasonic bath.

Inspecting the top view of FIG. 21, it can be seen that the floating ballast may be configured with a notch (2101) to accommodate the pouring spout of the beaker and thus permit the support tongs to be the sole support means for the beaker.

As mentioned previously, while this embodiment consists of two pieces (the floating ballast and the containment vessel), there is nothing to restrict the teachings of this invention from combining these two structures into a single entity.

Exemplary Embodiment—Pontoon-Ballast (P)

FIG. 22 shows a top view and FIG. 23 shows a side view of the pontoon-ballast (P) exemplary embodiment of the present invention. This particular embodiment consists of a floating-ballast embodiment (2201) augmented with the use of a number of pontoon floating elements (2202) which gather ultrasonic energy within the confines of the ultrasonic bath and transmit this energy to the containment vessel. As with the floating-ballast embodiment (F), the containment vessel may take a variety of forms, but in many cases is implemented with a conventional glass beaker as illustrated in the top view of FIG. 24 and expanded view of FIG. 25.

Once the pontoon-ballast and the containment vessel have been mated as exemplified by the floating-ballast embodiment illustrated in FIG. 18, the containment vessel is filled with cleaning fluid and the combination is placed within the ultrasonic bath as illustrated in FIG. 24 and FIG. 25.

As illustrated in FIG. 24 and FIG. 25, this floating ballast is free to move within the confines of the ultrasonic bath. The pontoons collect ultrasonic energy and transmit this to the tongs which support the containment vessel, and in doing so trigger resonances in the containment vessel which promote cavitation at the cleaning target surface. The tongs which support the containment vessel in this configuration may optionally be spring loaded as illustrated in FIG. 24 and FIG. 25. This particular embodiment has the effect of stimulating additional resonances between the pontoon and the containment vessel, as the spring has associated with it a mechanical resonance which may be selected to be complementary to that of the ultrasonic bath and the containment vessel.

Note that the surface area requirements of the pontoon-ballast embodiment are larger than that of the floating-ballast embodiment, but this configuration may be of considerable use in situations where a large amount of ballast must be generated to support heavy cleaning targets. As with the floating-ballast embodiment, the pontoon-ballast embodiment is free to move and rotate within the confines of the ultrasonic bath.

Exemplary Embodiment—Bag-Ballast (B)

Integrated Bag/Ballast Combination

FIG. 26 shows a top view and FIG. 27 shows a side view of the bag-ballast (B) exemplary embodiment of the present invention. This particular embodiment consists of a floating ballast (2701) which uses a bag (2702) as the containment vessel. This configuration permits ultrasonic energy to be conveyed from the bath fluid to the cleaning fluid in a manner more efficient than possible with the prior art configurations.

Once the bag and ballast means have been mated, the bag is filled with cleaning fluid as illustrated in FIG. 27 and the combination is placed within the ultrasonic bath as illustrated in FIG. 28. Note that as illustrated by a comparison of FIG. 28 and FIG. 29, that this bag-ballast configuration consumes less bath surface area than the pontoon-ballast configuration of FIG. 29.

Replaceable Bag/Ballast Combination

A very useful variation of the bag-ballast embodiment is the ballast modification illustrated in the side view of FIG. 46 and the top view of FIG. 47. Here a retaining sleeve (4602) has been added to the basic ballast (4601) to permit attachment of a replaceable containment vessel bag. Referencing FIG. 48 and FIG. 49, this replaceable bag is fed through the center of the ballast and secured to the retaining sleeve by means of a rubber band or some other attachment means. Of significant note in FIG. 49 is the fact that the containment bag may be of arbitrary size, thus making it possible to bag a cleaning target, fill the bag with cleaning fluid, and configure a bag-ballast for ultrasonic cleaning.

As illustrated in FIG. 50 and FIG. 51, a variety of color coding schemes are possible using this embodiment to distinguish both the types and identity of the cleaning targets as well as the type of cleaning fluid used in the ultrasonic cleaning operation. This identification mechanism can prove to be a valuable safety feature of the present invention. Note that it is also possible to color the plastic used in any of the invention embodiments to affect a similar result.

It is significant to note that a wide variety of methods exist whereby which the containment bag illustrated in FIG. 50 and FIG. 51 may be attached to the retaining sleeve. These figures illustrate the use of a rubber band for this purpose, but this is by no means the only or most optimal method of implementing this attachment. The present invention envisions that a wide variety of metal, plastic, composition and the like clamps and attachment means may be used to temporarily fix the containment bag to the retaining sleeve. Note in some envisioned embodiments of the present invention, the attachment means may consist solely of tabs in the retaining sleeve which are mated to holes in the containment bag lip, thus permitting the containment bag to hang from the lip of the retaining sleeve. This envisioned embodiment has the desirable quality of reducing the resonant damping of the containment sleeve.

Additionally, a wide variety of bag-ballast embodiments are envisioned in which the mechanical retention of the bag to the retaining sleeve is accomplished via complementary mating structures in the bag and the retaining sleeve. In many cases this will take the form of a specially constructed bag to mechanically mate with the retaining sleeve. Other forms are also possible in which the bag need not necessarily be specially constructed. For example, the use of resealable Zip-Loc bags which are mated with corresponding Zip-Loc structures in the retaining sleeve is specifically envisioned, as this would permit existing bag technologies to be migrated towards ultrasonic cleaning applications. Here either the inner or outer face of the retaining sleeve could be fashioned with Zip-Loc mating structure grooves which complement those of a standard Zip-Loc (or the like) bag, permitting easy installation and removal of the bag from the bag-ballast retaining sleeve.

The bag-ballast invention embodiment is amenable for use with a wide variety of commercially available bags. Notably, the use of plastic resealable bags is envisioned as being a very useful variant of this exemplary embodiment.

Exemplary Embodiment—Hanging-Ballast (B)

Overview

FIG. 52 shows a side view and FIG. 53 shows a top view of one of many hanging-ballast (H) embodiments of the present invention. This particular embodiment illustrates that a suspension means (5201, 5202) may be used to support a cleaning target within an ultrasonic bath. This invention embodiment may be used in conjunction with prior art cleaning configurations as shown in FIG. 54 and FIG. 55 as well as combinations of other invention embodiments as illustrated in FIG. 56 and FIG. 57.

It must be stressed that the exemplary embodiment H of the present invention is one of a great many ways in which this variant of the invention may be implemented. The basic concept embodying the invention in this form is to suspend the cleaning target in the cleaning fluid rather than permit it to make intimate physical contact with the containment vessel or the sides of the ultrasonic tank. This means that ultrasonic energy will impinge on the side of the cleaning target without the motional losses associated with moving the cleaning target as part of the ultrasonic bath assembly.

Stylistic Embodiments

The embodiments of this invention variant shown are very stylistic and are capable of a wide variety of implementations. For example, a great number of hanging support structures (5201) are possible, including but not limited to roofing tie points and A-frames. Similarly, the string support means (5202) may be any suitable connection means, such as wire, cable, thread, spring, chain, or the like. The concept implemented is the mechanical isolation of the cleaning target from the ultrasonic bath. How this is accomplished is irrelevant with regard to the teachings of this invention.

Some exemplary embodiments of the hanging-ballast are illustrated in FIG. 63. Variant (6300) illustrates the cleaning target (6304) being suspended within the ultrasonic bath using a wide variety of vertical (6307) and/or horizontal (6306) supports. What is significant about this style of embodiment is the range of supports which may be effective in providing the required mechanical isolation from the ultrasonic bath.

For example, variant (6310) shows the vertical support (6307) replaced by a spring to provide the required mechanical isolation. This substitution is consistent with the goals of permitting the cleaning target to be fully motional with respect to impinging ultrasonic waves.

Yet another variation of this technique is illustrated as variant (6320) in which a conventional Runnells-style retaining template (6321) that supports a containment vessel (6322) is augmented with one or more springs (6323) which are attached between the outer lip of the retaining ring cutout (6324) along one or more fixed points on this edge (6325) and attach directly to the containment vessel. This arrangement permits the containment vessel to remain substantially mechanically isolated from the retaining template (6321) and thus permits the containment vessel to promote higher resonance modes than if it were directly supported by the retaining template cutout lip (6324).

The technique illustrated by variant (6320) may be further enhanced by integrating other teachings of the present invention as illustrated in variant (6330). For example, the use of a support ring (6336) having tongs which support the containment vessel permits the containment vessel to move freely within the context of the ultrasonic bath. Thus, the use of springs (6333) and a retaining support ring (6336) that supports the containment vessel at one or more points serve to provide a substantial amount of mechanical isolation and thus promote higher order harmonic resonances at the cleaning target within the containment vessel.

The exemplary embodiments of FIG. 63 illustrate a general teaching of the present invention that a suspension support may integrate a mechanical isolator to affect greater cavitation at the cleaning target. As will be evident to one skilled in the art, the variations presented in FIG. 63 and elsewhere in this disclosure teach a very broad range of possible embodiments of the present invention, as the spring structures may be replaced with a wide variety of other devices to affect the same results. Furthermore, one skilled in the art will recognize that combinational variations of these teachings may be accomplished to generate an extremely broad set of possible invention embodiments.

Testing Methodology

While a variety of methodologies are available for testing the efficacy of ultrasonic cleaning, two methods predominate in the industry: the aluminum foil test and the gold ingot test.

Aluminum Foil Test

The aluminum foil ('tin foil') test has proven to be a inexpensive, easy tool for testing, controlling, and calibrating ultrasonic cleaning systems and determining the efficacy of these systems at generating cavitation on the surface of a cleaning target. See John M. Kolyer, A. A. Passchier, and Q. M. Tran, "Aluminum Foil Erosion Helps Determine Ultrasonic Damage," PRECISION CLEANING (June, 1998).

The basic test involves placing vertically aluminum foil (heavy-duty Reynolds Wrap is suitable) of approximately 0.1–1.0 mm in thickness in a cleaning fluid which is excited by an ultrasonic system. The ultrasonic system will cavitate the cleaning fluid surrounding the aluminum foil and begin to pit the foil. This pitting is an indication of cleaning effectiveness, and the amount of aluminum removed from the surface of the foil can be quantitatively determined to gauge the amount of cleaning performed given a specified ultrasonic excitation time.

While it is possible to quantify the amount of cleaning performed using this method, to be precise in this measurement requires a highly accurate micro-gram scale, which in many cases has significant cost. As an alternative, this method may be used to obtain a qualitative measurement of the cleaning effectiveness of the ultrasonic system, by comparing identical foil materials which have been subjected to different ultrasonic systems under identical conditions for a fixed period of time. This is the method which has been used in developing the instant invention and its embodiments and has proved quite effective in providing meaningful comparative data.

It should be noted that the method of micro-gram scale measuring of the aluminum foil has been applied primarily because the differences in cleaning between ultrasonic cleaning systems and methods are usually minor in their effect. Thus, to determine the efficacy in these situations requires the ability to detect small differences in the amount of aluminum removed from the surface of the test foil. However, in circumstances such as the testing of the present invention in which the differences between a benchmark and a new process produce gross differentials in cleaning efficacy, the aluminum foil test may be evaluated visually with no loss of effectiveness. The present invention typically produced a 20–60% or better cleaning effectiveness using the aluminum foil tests, and thus the differential between the prior art benchmark results and that obtained by the present invention embodiments was sufficiently wide to dispense with micro-gram scale testing.

Examples of aluminum foil cavitation cleaning tests are illustrated in FIGS. 30–35 and FIG. 38. These tests clearly indicate the cleaning differential between the prior art and that of a variety of embodiments of the present invention. These experimental results are best documented with the use of color photographs, as this provides in some ways the only method of properly illustrating the differences in cavitation pitting between the prior art and that produced by embodiments of the present invention teachings.

Gold Ingot Test

The gold ingot test is similar in function to that of the aluminum foil test. A fresh, shiny, gold ingot is abraded with aluminum oxide (via sand blasting) or some other abrasive with the use of a Dremel tool or some other circular/rotating instrument to generate a variety of irregular scratch grooves within the surface of the ingot. These scratch grooves are then impregnated with a metal polish such as tin oxide or some other impurity as illustrated in FIG. 36 to simulate the presence of an unwanted element which must be removed via ultrasonic cleaning.

The gold ingot is then subjected to ultrasonic cleaning for a fixed time and then visually inspected to see to what degree the ultrasonic cleaning has been effective. While this test is somewhat subjective, it is highly effective in generally qualifying the efficacy of a wide variety of ultrasonic cleaning systems and methods. As is illustrated in the color photographs illustrated in the various figures, this method seems to provide the most striking indication of the differential in cleaning effectiveness between the instant invention and the systems and methods of the prior art.

Examples of gold ingot cavitation cleaning tests are illustrated in FIG. 37 and FIGS. 39–45. These tests clearly indicate the cleaning differential between the prior art and that of a variety of embodiments of the present invention. These experimental results are best documented with the use of color photographs, as this provides in some ways the only method of properly illustrating the differences in deep cleaning between the prior art and that produced by embodiments of the present invention teachings. It should be noted that the micro-gram scale measurement technique used in the aluminum foil testing may in some cases not be useful in quantifying gold ingot testing, due to the large weight of the gold ingots as compared to that of the aluminum foil test strips.

Experimental Results

A variety of embodiments of the present invention have been constructed and tested using the aluminum foil and gold ingot tests as described above. The data presented here is only illustrative of observed performance of these specific embodiments. Presentation of this data in no way limits either the range of possible embodiments nor the potential performance of the present invention if embodied in other forms for specific ultrasonic cleaning applications.

As mentioned previously, throughout this discussion of test results, the following identifiers will apply:

(a) identifier (A) will refer to the prior art basket/beaker ultrasonic cleaning technique and its variants described by Runnells-class structures and illustrated in FIGS. 1, 2, 10, 11, 12, and 13;

(b) identifier (F) will refer to the general floating-ballast embodiment of the invention illustrated by FIGS. 14, 15, 16, 17, 18, 19, 20, and 21;

(c) identifier (P) will refer to the general pontoon-ballast embodiment of the invention illustrated by FIGS. 22, 23, 24, 25, and 29;

(d) identifier (B) will refer to the general bag-ballast embodiment of the invention illustrated by FIGS. 26, 27, and 28.

(e) identifier (H) will refer to the general hanging-ballast schematic embodiment of the invention illustrated by FIG. 3 Embodiment (H) and variants stylistically illustrated in FIGS. 52–57.

It is envisioned that a person skilled in the art when given this disclosure would be capable of mixing or combining these disclosed embodiments to generate a wide variety of permutations of these tested embodiments.

Aluminum Foil Tests

A series of aluminum foil tests were performed using ultrasonic cleaning systems (A), (F), (P), and (B). FIG. 30 illustrates the cleaning performance of a conventional prior art ultrasonic cleaning system (A). Comparing this to the cleaning performance of the floating-ballast (F) invention embodiment in FIG. 31, the pontoon-ballast invention embodiment in FIG. 32, and the bag-ballast invention embodiment in FIG. 33 reveals that all of the present invention embodiments outperform the existing prior art configuration.

Note especially that the cavitation pitting in FIG. 33 using the bag-ballast system is better than that of the conventional ultrasonic cleaning system even when using cleaning fluid which has not been degassed. As illustrated at the bottom of FIG. 33, the use of degassed cleaning fluid further increases this performance differential, making the bag-ballast embodiment far superior to that of conventional ultrasonic cleaning methods.

FIG. 34 provides a side-by-side comparison of aluminum foil ultrasonic cleaning test results and indicates again that the floating-ballast (F) and bag-ballast (B) embodiments outperform conventional beaker/basket (A) ultrasonic cleaning systems by a significant factor. The heavy cavitation of the (F) and (B) invention embodiments contrasts dramatically with that of the conventional ultrasonic cleaning methods (A).

The use of fresh cleaning fluid as illustrated in FIG. 35 further increases this performance differential. This test result indicates directly that the presently disclosed system and method can be used to extend the life of existing cleaning fluids so that they do not have to be replaced as often. This meets the goal of both reducing environmental pollution and saving the energy needed to create the cleaning fluids in the first place. Thus, the reduced quantity of cleaning fluid solution used results in a direct savings in energy consumption expended in cleaning materials manufacture. Additionally, the degassing time in this situation is also minimized, creating a greater overall system cleaning thruput while simultaneously reducing overall energy consumption per cleaning target processed. While this may not seem a significant environmental and/or energy savings, given the widespread use of ultrasonic cleaning in industrial environments, this can amount to significant savings if applied over an entire cleaning industry.

It should be noted that the cleaning efficacy illustrated in these tests is a fair comparison, since all aluminum foil strips were subjected to the same ultrasonic cleaning time using the same cleaning fluid conditions (unless otherwise mentioned).

Gold Ingot Tests

A series of gold ingot tests were performed using ultrasonic cleaning systems (A), (F), (P), and (B). FIG. 36 illustrates the condition of two gold ingots which have been abraded, scratched, and surfaced prepared with contamination prior to an ultrasonic cleaning test.

FIG. 37 illustrates the results of a comparison of cleaning performance of a conventional prior art ultrasonic cleaning system (A) contrasted with a floating-ballast (F) embodiment of the present invention. Note that the cleaning of the (F) invention embodiment is almost complete, whereas the prior art cleaning methodology (A) fails to produce even 50% surface cleaning. It should be noted that the gold ingots in FIG. 37 were abraded with 50 micron aluminum oxide abrasive (via sand blasting), whereas gold ingot tests shown in other figures were more deeply abraded using a rotating Dremel tool with abrasive wheel. This accounts for the smooth surface features in FIG. 37 as compared to the deeply abraded and scratched surface features in the other figures illustrating the experimental cleaning results. It is believed that the deep abrasions generated by an abrasive wheel produce a better benchmark on which to judge the true cleaning efficacy of a given ultrasonic cleaning system. From the pictures of the experimental results it is clear that the present invention in all its embodiments outperforms the present art in both surface cleaning and deep cleaning applications.

FIG. 38 and FIG. 39 are instructive because they compare the results of an aluminum foil cleaning test and that of a gold ingot cleaning test using the prior art cleaning methodology (A) and the floating-ballast (F) invention embodiment system and method. Both the foil pitting and surface cleaning of the gold ingot are substantially improved using the floating-ballast (F) embodiment as compared to the prior art cleaning methodology (A).

Yet another comparison of this disparity in cleaning efficacy is illustrated in FIG. 40 which shows prior art cleaning (A), and FIG. 41, which shows floating-ballast (F) cleaning efficacy. It is important to realize that the cleaning efficacy of the prior art system as illustrated in FIG. 39 and FIG. 41 is much lower than that illustrated in FIG. 37, whereas the disclosed invention embodiments are nearly constant. The reason for this is that the present invention tends to excite more high frequency harmonics in the cleaning fluid, which in turn increase cavitation and affect higher cleaning efficacy for deeply embedded surface impurities. Since the surface was not deeply abraded in FIG. 37 (A), the prior art system seems to be doing better than it would in many industrial environments.

FIG. 42 illustrates the results of a comparison of cleaning performance of a conventional prior art ultrasonic cleaning system (A) contrasted with a pontoon-ballast (P) embodiment of the present invention. Note that the cleaning of the (P) invention embodiment is almost complete, whereas the prior art cleaning methodology (A) fails to produce even 25% surface cleaning. A second view of the cleaning results illustrated in FIG. 42 (P) is illustrated in FIG. 43 (P).

FIG. 44 illustrates the results of a comparison of cleaning performance of a conventional prior art ultrasonic cleaning system (A) contrasted with a bag-ballast (B) embodiment of the present invention. Note that the cleaning of the (B) invention embodiment is almost complete, whereas the prior art cleaning methodology (A) fails to produce even 25% surface cleaning. A second view of the cleaning results illustrated in FIG. 44 (B) is illustrated in FIG. 45 (B).

Materials

It should be noted that a wide variety of plastics, glass, and other materials may be used to affect the teachings of the present invention. Experience has shown that there is a relationship between the ultrasonic excitation frequency, the bath fluid, and the cleaning fluid, such that depending on the choice of these elements the type of material used for the containment vessel and the floating-ballast may be varied to affect maximum cleaning.

Guidelines

However, some guidelines can be extracted from experiments that have been performed. First, the mass of the containment vessel and floating-ballast should be minimized, as the total mass of the object subject to the ultrasonic energy should be minimized such that the maximum amount of ultrasonic energy is transferred to the cleaning target. Mathematically, the desired relationship is $$\frac{M_X}{M_F + M_V + M_B + M_C + M_X} \rightarrow 1 \tag{5}$$

where $M_X$≡mass of cleaning target (item to be cleaned)

$M_F$≡mass of floating ballast $M_V$≡mass of containment vessel $M_B$≡mass of bath fluid $M_C$≡mass of cleaning fluid Thus, in an ideal situation, the mass of the floating-ballast, containment vessel, bath fluid, and cleaning fluid would be negligible, thus permitting all of the ultrasonic energy to be used to cavitate the cleaning fluid and clean the cleaning target.

Second, the materials chosen for the floating-ballast and containment vessel should not be acoustic in nature. Thus, sound absorbing materials such as soft rubber or styrofoam are generally unsuitable for use in constructing the floating-ballast and/or containment vessel, as contrasted with the prior art embodiment of FIG. 13. The dampening nature of these materials tends to attenuate the ultrasonic harmonics and result in poor cavitation and thus poor cleaning.

The reasons behind these requirement are threefold:

1. The resonant frequency of the system (and its individual components) is inversely proportional to the mass of the system components $$\left[\omega_0^2 = \frac{k}{m} \Rightarrow \omega_0 \propto \sqrt{\frac{k}{m}}\right].$$

See A. A. Andronov, A. A. Vitt, and S. E. Khaikin, THEORY OF OSCILLATORS, ISBN 0-486-65508-3, at 15–19 (ISBN 0-486-65508-3, Dover, 1987). Thus, reducing the system mass increases the resonant frequency of the system and/or its constituent components. Since a mechanical system may resonate at many frequencies (multiple excitation modes are present in any mechanical system), it is important to match as closely as possible the resonant frequency of the containment vessel with that of the ultrasonic excitation. Reducing the mass of the containment vessel is one method of achieving this goal.

2. The resonant frequency of the system (and its individual components) is proportional to the frictional loss of the system components $$\left[x = Ae^{-\left(h-j\sqrt{\omega_0^2-h^2}\right)t} + Be^{-\left(h+j\sqrt{\omega_0^2-h^2}\right)t}\right].$$

See A. A. Andronov, A. A. Vitt, and S. E. Khaikin, THEORY OF OSCILLATORS, ISBN 0-486-65508-3, at 15–19 (ISBN 0-486-65508-3, Dover, 1987). Thus, minimizing the frictional loss increases the resonant frequency of the system and/or its constituent components. This reduction in frictional loss also permits the oscillations to last for a longer period of time (at a higher amplitude) and thus increase the amount of cavitation activated by a given oscillation.

3. Mechanical systems tend to have multiple resonant frequencies, and although the higher harmonic resonances are less efficient than the primary resonant frequency, they can affect significant ultrasonic cavitation and subsequent cleaning. The key in the disclosed invention and its embodiments is the promotion of these alternate harmonic resonances to increase cavitation activity by making maximum use of the available ultrasonic energy at all excitation frequencies. Current ultrasonic cleaning techniques focus on promoting the generation of fundamental and harmonic ultrasonic frequencies, but fail to consider that harmonic energy may be quickly dissipated by the transfer mechanisms used to convey this energy to the cleaning target. Thus, while manufacturers have sought to increase harmonic energy production to affect greater and more effective cavitation, they have completely ignored losses due to transfer mechanisms present in the ultrasonic bath, containment vessel, and vessel support structures.

These guidelines are general, but are consistent with the construction of the prototype embodiments of the present invention. It should be noted that in contrast to present-day practice, none of the invention embodiments have been constructed of metal, as this material experiences all four of the loss components (heat conduction, viscous friction, elastic hysteresis, and scattering) possible in ultrasonic environments. It is significant that all current industrial ultrasonic cleaning systems make use of metal in their cleaning target containment means and in other apparatus which is associated with the ultrasonic bath. The present invention expressly recognizes this as a weakness in prior design methodologies and makes an effort where possible to avoid metallic entities within the confines of the ultrasonic bath.

Acoustic Impedance Considerations

It should be noted here that at least some of the literature misconstrues the impact of acoustic materials on the propagation of ultrasonic waves. For instance, the NASA paper "Physical Interpretation and Development of Ultrasonic Nondestructive Evaluation Techniques Applied to the Quantitative Characterization of Textile Materials" by James G. Miller (Washington University Department of Physics, Laboratory for Ultrasonics, NASA report NASA-CR-1.26:190962, NASA Langley Research Center grant NSG-001, 1992) states that > "The styrofoam-filled holes display the highest degree of signal loss . . . . This is to be expected because styrofoam consists primarily of air bubbles which have an acoustic impedance very different from that of Lucite [the surrounding material]."

Miller goes on to show grayscale images indicating a 15 dB signal loss in styrofoam as compared to approximately 5 dB in other materials such as Lucite, epoxy, or glass/epoxy compounds. These statements are misdirected in the context of ultrasonic cleaning, since it is not the difference in acoustic impedance which results in the attenuation of ultrasonic energy, but rather the fact that the acoustic impedance is higher in styrofoam than materials such as Lucite. Information on the subject of acoustic impedance and its relevance to the topic of ultrasonics is generally available in the literature. See Karl F. Herzfeld and Theodore A. Litovitz, ABSORPTION AND DISPERSION OF ULTRASONIC WAVES (LOC #59-7683, 1959).

This is not to imply that a suitable ballast cannot be constructed of styrofoam. However, the present invention envisions that the best construction method in this instance would be to use the styrofoam as a mold form over which a material with a low acoustic impedance is coated. This configuration prevents the ultrasonic energy associated with resonances in the containment vessel from being dissipated within the ballast support. Suitable mold coatings might include plastic, wax, and the like, although a wide variety of materials are both suitable and envisioned by the scope of the present invention.

Thus, the containment vessel should be constructed of a material which has a low acoustic impedance, with minimal real and imaginary loss components. This makes most substances such as styrofoam and other gas-filled materials unsuitable for use in containment vessels. Furthermore, this result means that common industrial techniques such as the use of rubber bands and the like to hold/retain the containment vessel (beaker, etc.) as illustrated in FIG. 13 should be avoided, as ultrasonic energy is damped by these materials. This damping permits ultrasonic energy to be drained from any containment vessel in contact with such a lossy material, resulting in less cavitation at the cleaning target than could be had otherwise.

Containment Vessel Resonances

The present invention and its embodiments attempt to reduce these losses by eliminating any lossy contact between the containment vessel and the floating-ballast. In some invention embodiments, the containment vessel is a small glass beaker or the like which rests on supporting tongs extending from the inside walls of the floating-ballast. This permits resonances within the beaker to be permitted to activate cavitation at the cleaning target with minimal damping by the floating-ballast. Additionally, any ultrasonic energy which is picked up by the floating-ballast may be concentrated and transferred to the beaker at defined points along the outer edge of the beaker lip. These localized excitation points tend to generate resonances within the beaker and support higher order Bessel function harmonics within the cleaning fluid and at the cleaning target surface, much as a wine glass sets up Bessel function resonance waves when struck with a spoon or other eating utensil.

Note that a variety of tong support methods are possible, including a complete circular support of the beaker in this embodiment. However, it is thought that supporting the beaker at a fixed number of points is the best method to excite ultrasonic harmonics within the cleaning fluid contained within the beaker. Experimentation has shown that the support tongs should not be formed of an acoustic material, as this tends to dampen resonances within the beaker.

Of note in the foregoing discussion is the fact that glass is not technically a solid, but rather a very viscous liquid. This means that the surface stresses (tension and compression) in a glass beaker can be used to advantage to convey ultrasonic energy from the outside of the beaker surface to its inner surface. Furthermore, these surface stresses can also increase the Q, or quality factor of the mechanical resonances of the beaker itself. In short, the selection of a glass beaker can result in lower losses than would be achievable with other containment vessel means, if care is taken to properly excite the natural modes of the beaker. This observation also paves the way for the construction of high-Q glass sonic waveguides and/or containment vessels which are specifically designed to accentuate the resonance properties of the waveguide and/or containment vessel.

As an exemplary example of the teachings in this section, refer to FIG. 58 and FIG. 59 which illustrate the cleaning fluid excitations present in a typical prior art beaker/basket ultrasonic cleaning combination. While the ultrasonic action in these figures is noticeable, it pales in comparison to the ultrasonic action present in the corresponding floating-ballast experiments illustrated in FIG. 60 and FIG. 61. Here, the containment vessel has been locally resonated by the floating-ballast, producing greater nonuniformity in the cleaning fluid wavefronts, and much higher amplitude wavefront peaks within the cleaning fluid. While the photographs of FIG. 60 and FIG. 61 cannot demonstrate the violent dynamic activity of the cleaning solution, evidence of this is present in cleaning solution which has splashed to the sides of the floating-ballast (6101) in FIG. 61. Note also that the violent nature of the cleaning fluid agitation in FIG. 60 and FIG. 61 requires in general that the cleaning fluid level be lowered to prevent excessive loss of the cleaning fluid using the illustrated embodiment. Even with this lowered fluid level, the splashing (6101) was observed in the illustrated invention embodiment of FIG. 61. This illustrates in an indirect way the efficacy of the resonating effect promoted by a wide variety of embodiments of the present invention.

Exemplary Construction Materials

The ballast means can be constructed of a wide variety of materials, including glass and a variety of plastics without loss of generality in the teachings of the present invention.

One such suitable plastic is ethylene vinyl acetate (EVA), a soft pliable plastic used in dental mouthguards and the like.

However, good results have been obtained in many prototypes with the use of acetate, a harder plastic which may be heat formed/modified after molding is complete. Experiments generally indicate that acetate may be the better of the two plastics in this application because its mechanical damping losses appear to be less than that of EVA. Both of these plastics may typically be obtained from a dental laboratory supply wholesaler as 5×5 thermoforming material mouthguard (EVA) or crown and bridge coping forming (acetate) material.

While a variety of plastic colors and thicknesses are available, the prototypes developed used clear plastic thicknesses in the range 0.030–0.040 inch. Other plastic thicknesses can be used without loss of generality in the teachings of the present invention. Note that a variety of plastic colors may be used to color code various types of containment vessels within a single ultrasonic cleaning bath, to permit differentiation of cleaning fluids and/or cleaning targets. This can be especially important when acids and other hazardous chemicals are used in the cleaning process. Color coding (red for example) to distinguish hazardous materials or potential biohazards can provide an additional degree of operational safety in environments which deal with both safe and hazardous cleaning agents.

Both of these plastics may be obtained from a plastics manufacturer such as T&S Dental & Plastics Co. Inc., 52 W. King, Myerstown, Pa. 17067-2519 (717) 866-7517 or through one of their distributors such as Dental Laboratory Discount Supply (DLDS), 810 East Main, Box 700, Branford, Conn. 06405, 800-243-4571.

OPERATION OF THE PRESENT INVENTION

Cleaning

The present invention is amenable to a wide variety of implementations to support the goal of ultrasonic cleaning. In general, one significant benefit of the present invention is that there is a minimal change in the operation of current ultrasonic cleaning hardware.

When the present invention is used in the context of existing ultrasonic cleaning, all that is necessary to implement more effective cleaning is to augment the current cleaning system by removing the mechanical connections between the cleaning target and the ultrasonic excitation means. This can be accomplished by use of any of the various embodiments F, P, B, or H as described previously, or some other embodiment of the invention can be constructed using the teachings of this document. Furthermore, it will be clear to those skilled in the art that combinations of the teachings of this document can produce acceptable solutions to the problem of ultrasonic cleaning and still outperform the current state of the art.

Degreasing

Ultrasonics has been applied to the problem of degreasing as well as part cleaning. Within the context of the present invention, degreasing has particular application in that use of a floating-ballast to support the containment vessel permits the containment vessel to rotate within the bath, thus permitting a more uniform application of cavitation to the cleaning process. This advantage is not possible with conventional baskets or rigid containment vessel mounts as taught in the current art.

This feature of the present invention is especially important in many cleaning/degreasing applications where 'blind holes' exist within the cleaning target. In these circumstances, it may not be feasible to perform additional inspection/cleaning after the ultrasonic process, as the areas on the cleaning target which require cleaning/inspection are hidden within 'blind spots' in the cleaning target. The ability of the several of the present invention embodiments to automatically rotate the cleaning target permits more uniform cleaning of these blind holes, and permits more efficacious overall cleaning target processing as compared with the prior art techniques.

Additionally, one of the biggest problems in degreasing applications is the need for additional inspection/cleaning after the initial degreasing operation is complete. Invariably, due to nonuniformities in cavitation across the surface of the cleaning target, the cleaning target must be manually cleaned after an initial ultrasonic cleaning and then reinserted in the ultrasonic bath for further cleaning. The present invention, by performing a more uniform and more thorough cavitation of the cleaning fluid surrounding the cleaning target minimizes or eliminates this additional manual cleaning operation, thus saving the ultrasonic operator time and money to affect the cleaning process.

Chemical/Biohazard Safe-guards

The present invention permits an additional degree of safety to be incorporated in situations where dangers are associated with chemicals or biohazards. Some of these safeguards are summarized as follows:

1. The floating-ballast containment supports may be color coded to indicate different types of cleaning fluids to be used within each containment vessel. This permits easy identification of dangerous materials such as acids, etc., which require special handling or disposal. Similar color coding schemes can be used to indicate biological hazards such as blood-contaminated items used in surgery, etc.
2. The floating-ballast containment support may be integrated into the containment vessel to generate an integrated ballast/containment vessel which may be disposed of once cleaning is completed for applications where contamination is a primary concern. Here color coding may be highly beneficial to indicate biohazardous materials.
3. The use of a floating-ballast in conjunction with a plastic bag containment vessel is ideal for situations in which the containment vessel and its contents are to be discarded as a whole. These situations include instances where the cleaning fluid is an acid or some other harmful chemical which cannot be safely disposed of in public sewer systems. In these cases a plastic bag having a resealable (Zip-Loc or the like) style seal may be used as the containment vessel. In this circumstance, the bag may be sealed and disposed of using conventional industrial and/or biomedical waste disposal methods without the fear of spillage or contamination which would be associated with normal chemical disposal methods. This is ideal for situations in which low volumes of chemical and/or biomedical waste must be disposed of by untrained technicians.
4. The floating-ballast embodiment mentioned above when used in conjunction with plastic bags or resealable plastic containment vessels is ideal for situations where conventional biomedical waste is disposed in standard biomedical waste lock boxes which are placed outside of hospitals, doctor offices, dental offices, and the like. Since biomedical waste disposal is increasingly becoming an issue in patient treatment, ultrasonic cleaning systems which are used in these environments must somehow be integrated into this new operational paradigm. The present invention in all its embodiments specifically envisions integration into this environment as one useful application of the teachings disclosed herein.

It must be stressed that the above list is non-exhaustive. The increasing need for stringent biohazard controls in the health care industry will undoubtedly uncover more reasons why the present invention is superior over the present art.

Anti-Node Cleaning Target Placement

One advantage of the present invention not available with the prior art is the ability to selectively place the cleaning target over the areas of maximum ultrasonic activity (anti-nodes) and thus affect maximum cavitation and cleaning. FIG. 62 illustrates one preferred embodiment of this invention variant in which a number of floating-ballasts configured with containment vessels exemplified by (6201) are placed in an ultrasonic bath and surrounded by 'dummy' floating-ballasts exemplified by (6202, 6203) which may or may not have containment vessels installed.

Depending on a wide variety of mechanical, construction, and operational parameters, the nodes and anti-nodes within an ultrasonic bath system may be present in a wide variety of patterns and configurations. Thus, it would be useful to be able to place the cleaning target in areas of maximum ultrasonic activity without fixing this position for all ultrasonic cleaning applications. The method illustrated in FIG. 62 accomplishes this generally by permitting the anti-nodes to be identified and then the cleaning target (floating-ballast, etc.,) configurations are placed over these nodes and then surrounded with unused invention embodiments.

In general, this embodiment of the invention follows the same principle used in other embodiments: the mechanical isolation of the cleaning target from points which tend to decrease the overall cavitation surrounding the cleaning target. In this instance, the nodes in the ultrasonic bath represent areas which inhibit cavitation, and thus should be avoided to achieve high cleaning efficacy. The use of ballast means embodiments of the present invention as illustrated in FIG. 62 achieves this goal without introducing excessive loss in the ultrasonic system as would the introduction of a Runnells-style basket configuration illustrated in FIG. 1 and FIG. 2.

Cleaning Target Products-by-Process

It should be mentioned here that the effectiveness of the present invention in promoting ultrasonic cleaning may be used to generate a new class of processed cleaning targets that are qualitatively different than cleaning targets processed by conventional ultrasonic cleaning systems. The reason for this is because in many circumstances conventional ultrasonic cleaning techniques do not promote the level of cavitation at the cleaning target necessary to fully clean the cleaning target. While some manufacturing processes have utilized exotic excitation means and longer ultrasonic cleaning times to affect more thorough cleaning, these approaches do not in general produce the same quality of cleaning as in the present invention.

Thus, the present invention may be utilized to create a whole new class of 'ultraclean' products using ultrasonic cleaning techniques taught in this disclosure. This would, for example, permit the use of ultrasonic cleaning in areas heretofore not amenable to the use of ultrasonic cleaning. Additionally, for practical considerations, the shorter cleaning time of the present invention promotes ultrasonic cleaning as a practical alternative to many less environmentally-friendly methods now in use in the semiconductor and other industries.

CONCLUSION

A system and method for ultrasonic cleaning and degreasing has been presented which significantly improves the cavitation performance over the previously described prior art. The use of ballast means for supporting containment vessels has proven that cavitation can be dramatically improved by isolating the containment vessel and the cleaning target from the sides of the ultrasonic bath, permitting placement of the cleaning target within ultrasonic anti-nodes within the bath.

While a variety of methods of providing this support are envisioned, the presently preferred embodiments work well to promote cavitation and permit the placement of the cleaning target within an optimal part of the ultrasonic excitation wave front. Specifically, the use of a floating-ballast used in conjunction with a glass/plastic beaker has proven to be highly effective in increasing cavitation, and the use of a bag-ballast in conjunction with a plastic bag enclosure permits a significant degree of mechanical linkage between the cleaning bath and the bath fluid to occur, resulting in a high cavitation efficiency.

Additionally, the use of an external support means to suspend the cleaning target has been shown to illustrate that the teachings of the present invention may be implemented in a wide variety of ways, and in many cases combined to produce advantageous cleaning systems and methods. In fact, it is clear from the teachings of the present invention that many of the embodiments of the present invention are directly compatible with existing ultrasonic cleaning systems. This compatibility is a great strength in situations where it is desired to increase the efficacy of existing ultrasonic cleaning systems without the expenditure of large sums of money.

Finally, the present invention specifically teaches the use of resonating waveguides and containment structures within an ultrasonic bath system to increase hydrostatic pressure and thus affect greater cavitation and more efficient cleaning. It is specifically envisioned that this teaching will be applied to containment vessel technologies as well as to the generation of sonic waveguides which are specifically designed to resonate at ultrasonic frequencies. Generally, however, any excitation of a resonating structure within the confines of a closed proximity to a cleaning target will dramatically improve the cavitation and cleaning of the cleaning target using the teachings of the present invention.

What is also clear from the teachings of the present invention is that an entirely new class of cleaning targets may be produced using the ultrasonic cleaning methods taught by the present invention. These 'ultraclean' cleaning targets may be effectively cleaned to a degree not previously possible with existing ultrasonic cleaning systems, methods, and techniques. The reason for this difference in kind is that the cavitation produced by the present method affects cavitation at a completely different level and at completely different frequencies than that promoted by existing ultrasonic cleaning equipment. Furthermore, other benefits such as autorotation of the cleaning target as well as promotion of deep cleaning and cleaning of 'blind holes' within the cleaning target are performed at a much higher quality level that can be performed using existing ultrasonic cleaning techniques. For this and other reasons, the present invention permits a whole new class of 'ultraclean' products to be produced that have performance characteristics which are of a different kind than possible with previous ultrasonic cleaning techniques.

It is obvious from the invention embodiments disclosed and their experimental performance characteristics that the present invention may be broadly implemented and applied to a wide variety of cleaning problems which will be well known to those skilled in the art of ultrasonic cleaning. Nothing in the foregoing discussion should be construed to limit the nature, construction, application, or scope of the envisioned use of the disclosed invention teachings.

CLAIMS

Although a preferred embodiment of the present invention has been illustrated in the accompanying Drawings and described in the foregoing Detailed Description, it will be understood that the invention is not limited to the embodiments disclosed, but is capable of numerous rearrangements, modifications, and substitutions without departing from the spirit of the invention as set forth and defined by the following claims.

What is claimed is:

1. An apparatus for enhancing the efficiency of cleaning and/or degreasing systems utilizing ultrasonic wave energy, said apparatus comprising:

(a) A cleaning target suspension support; and (b) A mechanical isolator to prevent mechanical contact between said cleaning target and the generator of said ultrasonic energy, wherein said mechanical isolator permit the cleaning target to be motional with respect to impinging ultrasonic waves.

2. An apparatus for enhancing the efficiency of cleaning and/or degreasing systems utilizing ultrasonic wave energy, said apparatus comprising:

(a) Means for suspending a cleaning target; and (b) Means for mechanically isolating said cleaning target means and the generator of said ultrasonic energy, wherein said means for mechanically isolating permit the cleaning target to be motional with respect to impinging ultrasonic waves.

3. The apparatus of claim 1 wherein said suspension support is a containment vessel.

4. The apparatus of claim 1 wherein said suspension support is a spring.

5. The apparatus of claim 1 wherein said suspension support is a containment vessel supported by one or more springs.

6. The apparatus of claim 1 wherein said suspension support is a containment vessel supported by one or more springs connected to a retaining template.

7. The apparatus of claim 1 wherein said suspension support is a containment vessel supported by a support ring connected by one or more springs attached to a retaining template.

8. The apparatus of claim 1 wherein said suspension support is fixed external to said ultrasonic wave generator.

9. The apparatus of claim 8 wherein said suspension support integrates said mechanical isolator.

10. The apparatus of claim 1 wherein said mechanical isolator is a floating-ballast.

11. The apparatus of claim 10 wherein said floating-ballast is constructed of plastic.

12. The apparatus of claim 10 wherein said floating-ballast is constructed of glass.

13. The apparatus of claim 10 wherein said floating-ballast incorporates an integrated containment vessel.

14. The apparatus of claim 10 wherein said floating-ballast contains a plethora of tongs to support said cleaning target suspension support.

15. The apparatus of claim 14 wherein said suspension support is a containment vessel.

16. The apparatus of claim 1 wherein said mechanical isolator is a pontoon-ballast.

17. The apparatus of claim 16 wherein said pontoon-ballast is constructed of plastic.

18. The apparatus of claim 16 wherein said pontoon-ballast is constructed of glass.

19. The apparatus of claim 16 wherein said pontoon-ballast incorporates an integrated containment vessel.

20. The apparatus of claim 16 wherein said pontoon-ballast contains a plethora of tongs to support said cleaning target suspension support.

21. The apparatus of claim 20 wherein said suspension support is a containment vessel.

22. The apparatus of claim 16 wherein said pontoon-ballast has spring-loaded pontoons.

23. The apparatus of claim 1 wherein said mechanical isolator is a bag-ballast.

24. The apparatus of claim 23 wherein said bag-ballast is constructed of plastic.

25. The apparatus of claim 23 wherein said bag-ballast is constructed of glass.

26. The apparatus of claim 23 wherein said bag-ballast further comprises (a) a containment bag; and (b) a containment bag retaining sleeve.

27. The apparatus of claim 26 wherein said bag is made of plastic.

28. The apparatus of claim 26 wherein said bag is resealable.

29. The apparatus of claim 26 wherein said bag is color coded.

30. The apparatus of claim 26 wherein said bag is attached to said retaining sleeve with a rubber band.

31. The apparatus of claim 26 wherein said bag is attached to said retaining sleeve with a clamp.

32. The apparatus of claim 31 wherein said clamp is metal.

33. The apparatus of claim 31 wherein said clamp is plastic.

34. The apparatus of claim 26 wherein said bag is attached to said retaining sleeve with a complementary mating structure.

35. The apparatus of claim 1 wherein said suspension support and said mechanical isolator are integrated into a unified structure.

36. The apparatus of claim 1 further comprising a waveguide surrounding said cleaning target.

37. The apparatus of claim 36 wherein said waveguide has ultrasonic resonance modes.

38. The apparatus of claim 36 wherein said waveguide is a containment vessel.

39. The apparatus of claim 38 wherein said containment vessel has ultrasonic resonance modes.

40. The apparatus of claim 38 wherein said containment vessel is a beaker.

41. The apparatus of claim 40 wherein said beaker is constructed of glass.

42. The apparatus of claim 40 wherein said beaker is constructed of plastic.

43. The apparatus of claim 2 wherein said suspension means is a containment vessel.

44. The apparatus of claim 2 wherein said suspension means is a spring.

45. The apparatus of claim 2 wherein said suspension means is a containment vessel supported by one or more springs.

46. The apparatus of claim 2 wherein said suspension means is a containment vessel supported by one or more springs connected to a retaining template.

47. The apparatus of claim 2 wherein said suspension means is a containment vessel supported by a support ring connected by one or more springs attached to a retaining template.

48. The apparatus of claim 2 wherein said suspension means is fixed external to said ultrasonic wave generator.

49. The apparatus of claim 48 wherein said suspension means integrates said mechanical isolation means.

50. The apparatus of claim 2 wherein said mechanical isolation means is a floating-ballast means.

51. The apparatus of claim 50 wherein said floating-ballast means is constructed of plastic.

52. The apparatus of claim 50 wherein said floating-ballast means is constructed of glass.

53. The apparatus of claim 50 wherein said floating-ballast means incorporates an integrated containment vessel.

54. The apparatus of claim 50 wherein said floating-ballast means contains a plethora of tongs to support said cleaning target suspension means.

55. The apparatus of claim 54 wherein said suspension means is a containment vessel.

56. The apparatus of claim 2 wherein said mechanical isolation means is a pontoon-ballast means.

57. The apparatus of claim 56 wherein said pontoon-ballast means is constructed of plastic.

58. The apparatus of claim 56 wherein said pontoon-ballast means is constructed of glass.

59. The apparatus of claim 56 wherein said pontoon-ballast means incorporates an integrated containment vessel.

60. The apparatus of claim 56 wherein said pontoon-ballast means contains a plethora of tongs to support said cleaning target suspension means.

61. The apparatus of claim 60 wherein said suspension means is a containment vessel.

62. The apparatus of claim 56 wherein said pontoon-ballast means has spring-loaded pontoons.

63. The apparatus of claim 2 wherein said mechanical isolation means is a bag-ballast means.

64. The apparatus of claim 63 wherein said bag-ballast means is constructed of plastic.

65. The apparatus of claim 63 wherein said bag-ballast means is constructed of glass.

66. The apparatus of claim 63 wherein said bag-ballast means further comprises (a) a containment bag; and (b) a containment bag retaining sleeve.

67. The apparatus of claim 66 wherein said bag is made of plastic.

68. The apparatus of claim 66 wherein said bag is resealable.

69. The apparatus of claim 66 wherein said bag is color coded.

70. The apparatus of claim 66 wherein said bag is attached to said retaining sleeve with a rubber band.

71. The apparatus of claim 66 wherein said bag is attached to said retaining sleeve with a clamp.

72. The apparatus of claim 71 wherein said clamp is metal.

73. The apparatus of claim 71 wherein said clamp is plastic.

74. The apparatus of claim 66 wherein said bag is attached to said retaining sleeve with a complementary mating structure.

75. The apparatus of claim 2 wherein said suspension means and said mechanical isolation means are integrated into a unified structure.

76. The apparatus of claim 2 further comprising a waveguide means surrounding said cleaning target.

77. The apparatus of claim 76 wherein said waveguide means has ultrasonic resonance modes.

78. The apparatus of claim 76 wherein said waveguide means is a containment vessel.

79. The apparatus of claim 78 wherein said containment vessel has ultrasonic resonance modes.

80. The apparatus of claim 78 wherein said containment vessel is a beaker.

81. The apparatus of claim 80 wherein said beaker is constructed of glass.

82. The apparatus of claim 80 wherein said beaker is constructed of plastic.

83. A system for ultrasonic cleaning and/or degreasing comprising:

(a) A ultrasonic wave generator;

(b) A cleaning target suspension support; and (c) A mechanical isolator to prevent mechanical contact between said cleaning target and said ultrasonic wave generator, wherein said mechanical isolator permit the cleaning target to be motional with respect to impinging ultrasonic waves.

84. A system for ultrasonic cleaning and/or degreasing comprising:

(a) Means for generating ultrasonic waves;

(b) Means for suspending a cleaning target; and (c) Means for mechanically isolating said cleaning target and said ultrasonic wave generation means, wherein said means for mechanically isolating permit the cleaning target to be motional with respect to impinging ultrasonic waves.

85. The system of claim 83 wherein said suspension support is a containment vessel.

86. The system of claim 83 wherein said suspension support is a spring.

87. The system of claim 83 wherein said suspension support is a containment vessel supported by one or more springs.

88. The system of claim 83 wherein said suspension support is a containment vessel supported by one or more springs connected to a retaining template.

89. The system of claim 83 wherein said suspension support is a containment vessel supported by a support ring connected by one or more springs attached to a retaining template.

90. The system of claim 83 wherein said suspension support is fixed external to said ultrasonic wave generator.

91. The system of claim 90 wherein said suspension support integrates said mechanical isolator.

92. The system of claim 83 wherein said mechanical isolator is a floating-ballast.

93. The system of claim 92 wherein said floating-ballast is constructed of plastic.

94. The system of claim 92 wherein said floating-ballast is constructed of glass.

95. The system of claim 92 wherein said floating-ballast incorporates an integrated containment vessel.

96. The system of claim 92 wherein said floating-ballast contains a plethora of tongs to support said cleaning target suspension support.

97. The system of claim 96 wherein said suspension support is a containment vessel.

98. The system of claim 83 wherein said mechanical isolator is a pontoon-ballast.

99. The system of claim 98 wherein said pontoon-ballast is constructed of plastic.

100. The system of claim 98 wherein said pontoon-ballast is constructed of glass.

101. The system of claim 98 wherein said pontoon-ballast incorporates an integrated containment vessel.

102. The system of claim 98 wherein said pontoon-ballast contains a plethora of tongs to support said cleaning target suspension support.

103. The system of claim 102 wherein said suspension support is a containment vessel.

104. The system of claim 98 wherein said pontoon-ballast has spring-loaded pontoons.

105. The system of claim 83 wherein said mechanical isolator is a bag-ballast.

106. The system of claim 105 wherein said bag-ballast is constructed of plastic.

107. The system of claim 105 wherein said bag-ballast is constructed of glass.

108. The system of claim 105 wherein said bag-ballast further comprises (a) a containment bag; and (b) a containment bag retaining sleeve.

109. The system of claim 108 wherein said bag is made of plastic.

110. The system of claim 108 wherein said bag is resealable.

111. The system of claim 108 wherein said bag is color coded.

112. The system of claim 108 wherein said bag is attached to said retaining sleeve with a rubber band.

113. The system of claim 108 wherein said bag is attached to said retaining sleeve with a clamp.

114. The system of claim 113 wherein said clamp is metal.

115. The system of claim 113 wherein said clamp is plastic.

116. The system of claim 108 wherein said bag is attached to said retaining sleeve with a complementary mating structure.

117. The system of claim 83 wherein said suspension support and said mechanical isolator are integrated into a unified structure.

118. The system of claim 83 further comprising a waveguide surrounding said cleaning target.

119. The system of claim 118 wherein said waveguide has ultrasonic resonance modes.

120. The system of claim 118 wherein said waveguide is a containment vessel.

121. The system of claim 120 wherein said containment vessel has ultrasonic resonance modes.

122. The system of claim 120 wherein said containment vessel is a beaker.

123. The system of claim 122 wherein said beaker is constructed of glass.

124. The system of claim 122 wherein said beaker is constructed of plastic.

125. The system of claim 84 wherein said suspension means is a containment vessel.

126. The system of claim 84 wherein said suspension means is a spring.

127. The system of claim 84 wherein said suspension means is a containment vessel supported by one or more springs.

128. The system of claim 84 wherein said suspension means is a containment vessel supported by one or more springs connected to a retaining template.

129. The system of claim 84 wherein said suspension means is a containment vessel supported by a support ring connected by one or more springs attached to a retaining template.

130. The system of claim 84 wherein said suspension means is fixed external to said ultrasonic wave generator.

131. The system of claim 130 wherein said suspension means integrates said mechanical isolation means.

132. The system of claim 84 wherein said mechanical isolation means is a floating-ballast means.

133. The system of claim 132 wherein said floating-ballast means is constructed of plastic.

134. The system of claim 132 wherein said floating-ballast means is constructed of glass.

135. The system of claim 132 wherein said floating-ballast means incorporates an integrated containment vessel.

136. The system of claim 132 wherein said floating-ballast means contains a plethora of tongs to support said cleaning target suspension means.

137. The system of claim 136 wherein said suspension means is a containment vessel.

138. The system of claim 84 wherein said mechanical isolation means is a pontoon-ballast means.

139. The system of claim 138 wherein said pontoon-ballast means is constructed of plastic.

140. The system of claim 138 wherein said pontoon-ballast means is constructed of glass.

141. The system of claim 138 wherein said pontoon-ballast means incorporates an integrated containment vessel.

142. The system of claim 138 wherein said pontoon-ballast means contains a plethora of tongs to support said cleaning target suspension means.

143. The system of claim 142 wherein said suspension means is a containment vessel.

144. The system of claim 138 wherein said pontoon-ballast means has spring-loaded pontoons.

145. The system of claim 84 wherein said mechanical isolation means is a bag-ballast means.

146. The system of claim 145 wherein said bag-ballast means is constructed of plastic.

147. The system of claim 145 wherein said bag-ballast means is constructed of glass.

148. The system of claim 145 wherein said bag-ballast means further comprises (a) a containment bag; and (b) a containment bag retaining sleeve.

149. The system of claim 148 wherein said bag is made of plastic.

150. The system of claim 148 wherein said bag is resealable.

151. The system of claim 148 wherein said bag is color coded.

152. The system of claim 148 wherein said bag is attached to said retaining sleeve with a rubber band.

153. The system of claim 148 wherein said bag is attached to said retaining sleeve with a clamp.

154. The system of claim 153 wherein said clamp is metal.

155. The system of claim 153 wherein said clamp is plastic.

156. The system of claim 148 wherein said bag is attached to said retaining sleeve with a complementary mating structure.

157. The system of claim 84 wherein said suspension means and said mechanical isolation means are integrated into a unified structure.

158. The system of claim 84 further comprising a waveguide means surrounding said cleaning target.

159. The system of claim 158 wherein said waveguide means has ultrasonic resonance modes.

160. The system of claim 158 wherein said waveguide means is a containment vessel.

161. The system of claim 160 wherein said containment vessel has ultrasonic resonance modes.

162. The system of claim 160 wherein said containment vessel is a beaker.

163. The system of claim 162 wherein said beaker is constructed of glass.

164. The system of claim 162 wherein said beaker is constructed of plastic.

165. A system for ultrasonic cleaning comprising:

(a) A ballast means;

(b) A cleaning fluid container means, said cleaning fluid container means supported by said ballast means;

(c) Cleaning fluid, said cleaning fluid contained within said cleaning fluid container means;

(d) Bath fluid, said bath fluid supporting said ballast means; and (e) Ultrasonic wave excitation means, said ultrasonic excitation means capable of producing mechanical wave excitation and applying said wave excitation to said bath fluid.

166. A method for ultrasonic cleaning and/or degreasing comprising the steps of:

(a) Suspending a cleaning target in a cleaning fluid;

(b) Exciting said cleaning fluid with ultrasonic waves; and (c) Mechanically isolating said cleaning target suspension from said ultrasonic wave excitation, wherein said mechanically isolating permit the cleaning target to be motional with respect to impinging ultrasonic waves.

167. The method for ultrasonic cleaning of claim 166 further comprising the steps of (a) Placing said cleaning target over anti-nodes in said cleaning fluid;

(b) Mechanically isolating said cleaning target from nodes in said cleaning fluid using a ballast means.

168. A method for ultrasonic cleaning and/or degreasing comprising the steps of:

(a) Suspending a cleaning target in a cleaning fluid;

(b) Exciting said cleaning fluid with ultrasonic waves;

(c) Resonating at least one waveguide surrounding said cleaning target in said cleaning fluid; and (d) Mechanically isolating said cleaning target suspension from said ultrasonic wave excitation, wherein said mechanically isolating permit the cleaning target to be motional with respect to impinging ultrasonic waves.

169. The method for ultrasonic cleaning of claim 168 wherein said resonating step excites at least one ultrasonic resonance mode in said waveguide.

170. The method for ultrasonic cleaning of claim 168 wherein said resonating step excites at least one ultrasonic resonance mode in said waveguide and/or said cleaning fluid.

171. The method for ultrasonic cleaning of claim 169 wherein said resonance mode is cylindrical.

172. The method for ultrasonic cleaning of claim 168 wherein said resonance mode is cylindrical.

173. A method for ultrasonic cleaning and/or degreasing comprising the steps of:

(a) Suspending a cleaning target in a cleaning fluid;

(b) Exciting said cleaning fluid with ultrasonic waves;

(c) Resonating a containment vessel surrounding said cleaning target in said cleaning fluid; and (d) Mechanically isolating said cleaning target suspension from said ultrasonic wave excitation, wherein said mechanically isolating permit the cleaning target to be motional with respect to impinging ultrasonic waves.

174. The method for ultrasonic cleaning of claim 173 wherein said resonating step excites at least one ultrasonic resonance mode in said waveguide.

175. The method for ultrasonic cleaning of claim 173 wherein said resonating step excites at least one ultrasonic resonance mode in said waveguide and/or said cleaning fluid.

176. The method for ultrasonic cleaning of claim 174 wherein said resonance mode is cylindrical.

177. The method for ultrasonic cleaning of claim 173 wherein said resonance mode is cylindrical.

* * * * *